US007909938B2

(12) United States Patent
Cerruti et al.

(10) Patent No.: US 7,909,938 B2
(45) Date of Patent: Mar. 22, 2011

(54) WASHING AGENT DISPENSER FOR A HOUSEHOLD WASHING MACHINE, IN PARTICULAR A DISHWASHER, AND PROCESS FOR MANUFACTURING SAID DISPENSER

(75) Inventors: Daniele Cerruti, Fontanetto Po (IT); Marco Moro, S. Maurizio di Conzano (IT); Costanzo Gadini, Frassineto Po (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 700 days.

(21) Appl. No.: 11/718,874

(22) PCT Filed: Nov. 4, 2005

(86) PCT No.: PCT/IB2005/003400

§ 371 (c)(1),
(2), (4) Date: Dec. 17, 2007

(87) PCT Pub. No.: WO2006/048765

PCT Pub. Date: May 11, 2006

(65) Prior Publication Data

US 2008/0223417 A1 Sep. 18, 2008

(30) Foreign Application Priority Data

Nov. 8, 2004 (IT) ..... TO2004A0772

(51) Int. Cl.
*B08B 3/02* (2006.01)

(52) U.S. Cl. ..... 134/56 D; 134/57 D; 134/94.1

(58) Field of Classification Search ..... 134/56 D, 134/57 D, 94.1
See application file for complete search history.

(56) References Cited

U.S. PATENT DOCUMENTS 2,150,536 A * 3/1939 Ziehm, Jr. ..... 220/259.2
2,531,737 A * 11/1950 Lyon, Jr. ..... 220/345.3
2,618,884 A * 11/1952 Low ..... 312/242

(Continued)

FOREIGN PATENT DOCUMENTS

FR 2 430 753 2/1980

(Continued)

OTHER PUBLICATIONS

WIPO WO 03/045214 Jun. 2003.*

(Continued)

*Primary Examiner* — Frankie L Stinson
(74) *Attorney, Agent, or Firm* — Heslin Rothenberg Farley & Mesiti P.C.

(57) ABSTRACT

A washing-agent dispenser for a household washing machine having a main casing, defining at least a container for a washing agent, and a member for closing the container. The closing member includes a substantially rigid body made of a first material, associated to which there are sealing means, made at least in part with a second substantially elastic or soft material. Associated to the rigid body of the closing member there are at least partially elastic or yielding complements, which are functionally distinct from the sealing means and are able to undergo deformation in the course of the use of the closing member. The complements are made at least in part of an elastic, soft, or yielding material, in particular of a synthetic type, which can be overmoulded directly on the rigid body of the closing member. Preferably, a plurality of complements is formed in a single component, which can include also said sealing means.

37 Claims, 27 Drawing Sheets

U.S. PATENT DOCUMENTS

| | | | | | |
|---|---|---|---|---|---|
| 3,262,604 | A | * | 7/1966 | Barnard et al. | 222/504 |
| 3,397,823 | A | * | 8/1968 | Kirkpatrick | 222/480 |
| 3,458,113 | A | * | 7/1969 | Swartzbaugh | 220/324 |
| 3,954,179 | A | * | 5/1976 | Warmath | 206/528 |
| 4,088,355 | A | * | 5/1978 | Dey | 292/251 |
| 4,306,398 | A | * | 12/1981 | Duckett | 52/394 |
| 4,444,359 | A | * | 4/1984 | Butler | 242/598.6 |
| 4,454,889 | A | * | 6/1984 | Contreras, Sr. | 132/301 |
| 4,890,742 | A | * | 1/1990 | Allison | 206/540 |
| 5,082,137 | A | * | 1/1992 | Weinstein | 220/345.3 |
| 5,273,177 | A | * | 12/1993 | Campbell | 220/281 |
| 5,275,291 | A | * | 1/1994 | Sledge | 206/531 |
| 5,344,024 | A | * | 9/1994 | Cohu | 206/526 |
| 5,577,779 | A | * | 11/1996 | Dangel | 292/80 |
| 5,603,431 | A | * | 2/1997 | Tuller | 222/63 |
| 5,772,028 | A | * | 6/1998 | Marsilio et al. | 206/387.1 |
| 5,884,821 | A | * | 3/1999 | Wilhelmstaetter et al. | 222/511 |
| 5,951,504 | A | * | 9/1999 | Iglesias et al. | 602/27 |
| 6,029,848 | A | * | 2/2000 | Cha et al. | 220/837 |
| 6,667,004 | B2 | * | 12/2003 | Cha et al. | 264/484 |
| 7,207,341 | B2 | * | 4/2007 | Cantave et al. | 134/56 D |
| 2006/0144424 | A1 | * | 7/2006 | Marchitto et al. | 134/25.2 |

FOREIGN PATENT DOCUMENTS

| | | | |
|---|---|---|---|
| JP | 06-207163 | * | 7/1994 |
| JP | 07-285383 | * | 10/1995 |
| JP | 08-168460 | * | 7/1996 |
| JP | 2000-128202 | * | 5/2000 |
| JP | 2001-072105 | * | 3/2001 |
| JP | 2004-142821 | * | 5/2004 |
| WO | WO 03/045214 A2 | | 6/2003 |
| WO | WO 03/053213 A1 | | 7/2003 |

OTHER PUBLICATIONS

International Search Report dated May 12, 2006 from International Application No. PCT/IB2005/003400, filed Nov. 4, 2005.

* cited by examiner

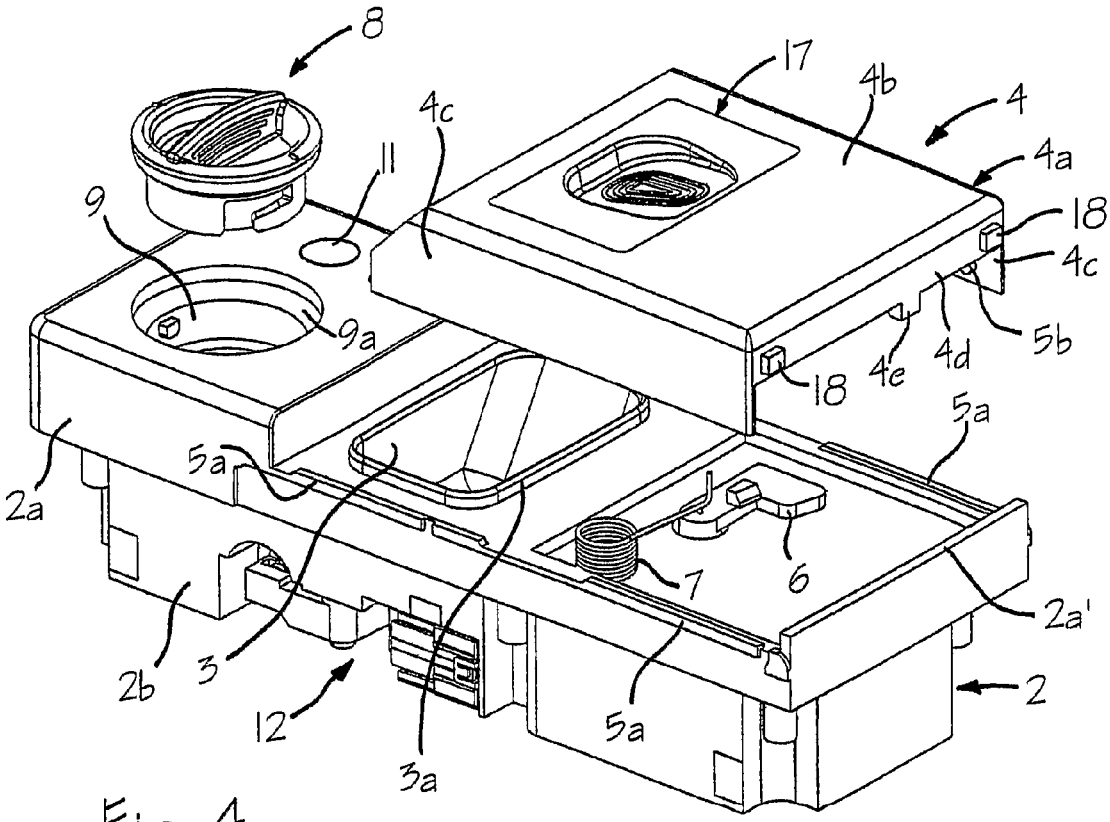
Fig. 4
Fig. 5
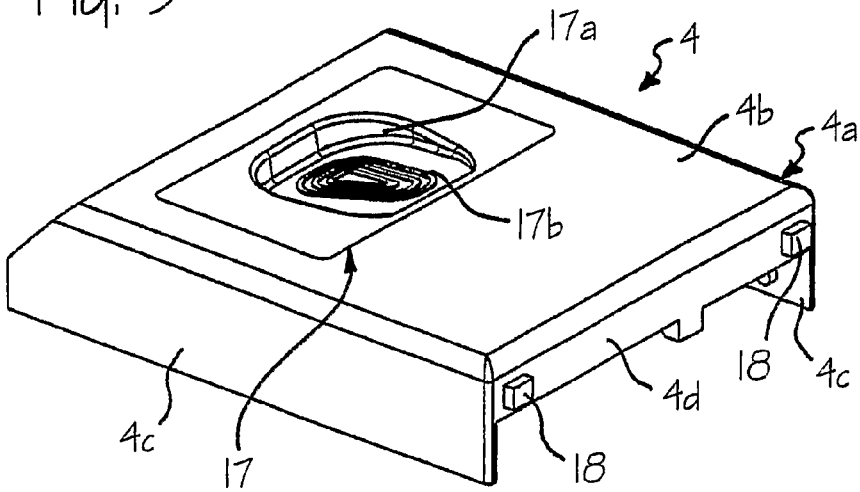

Fig. 33
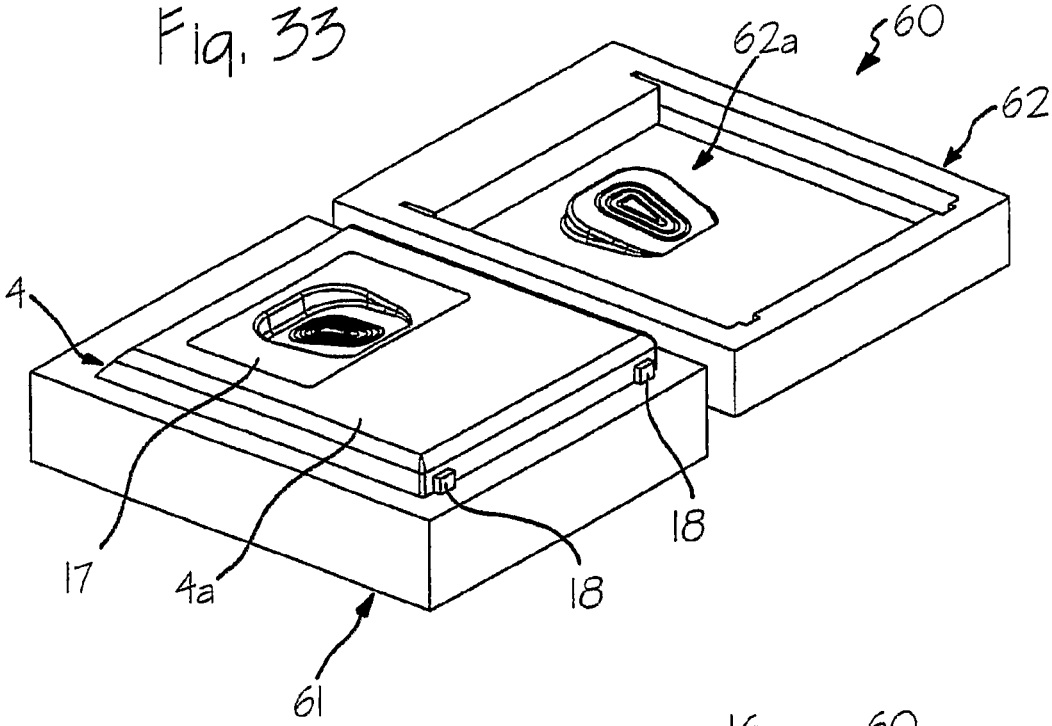
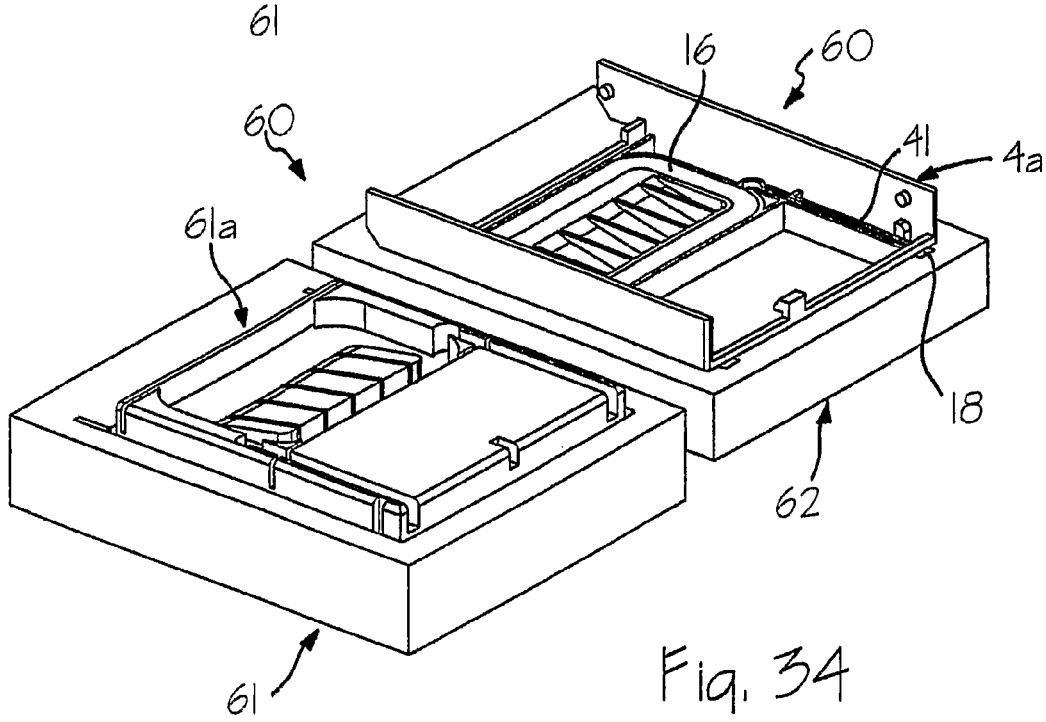
Fig. 34

Fig. 40
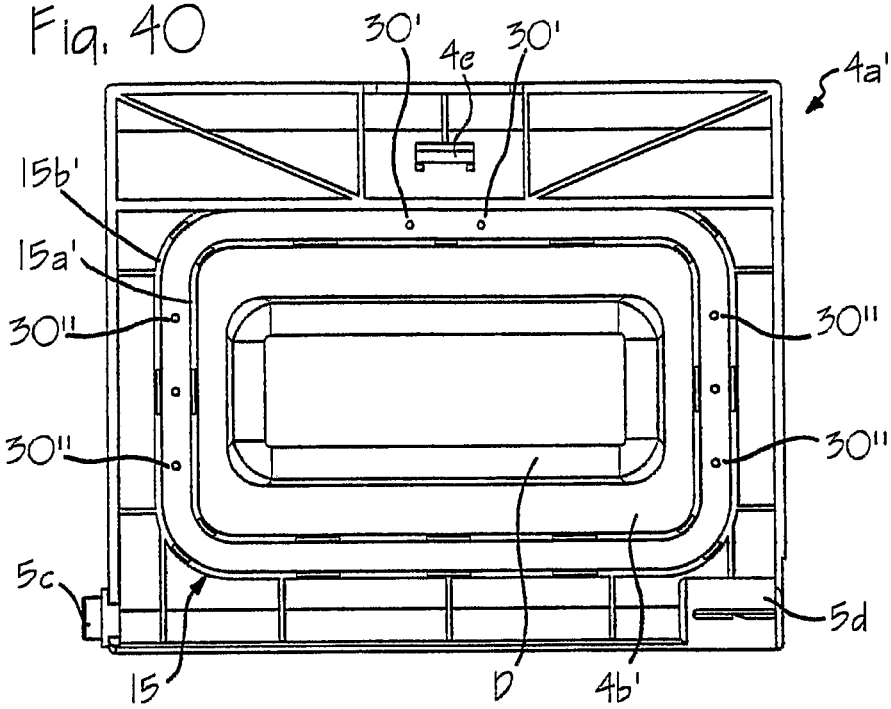
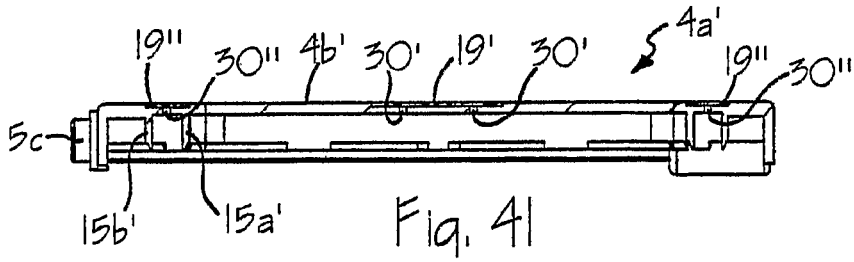
Fig. 41
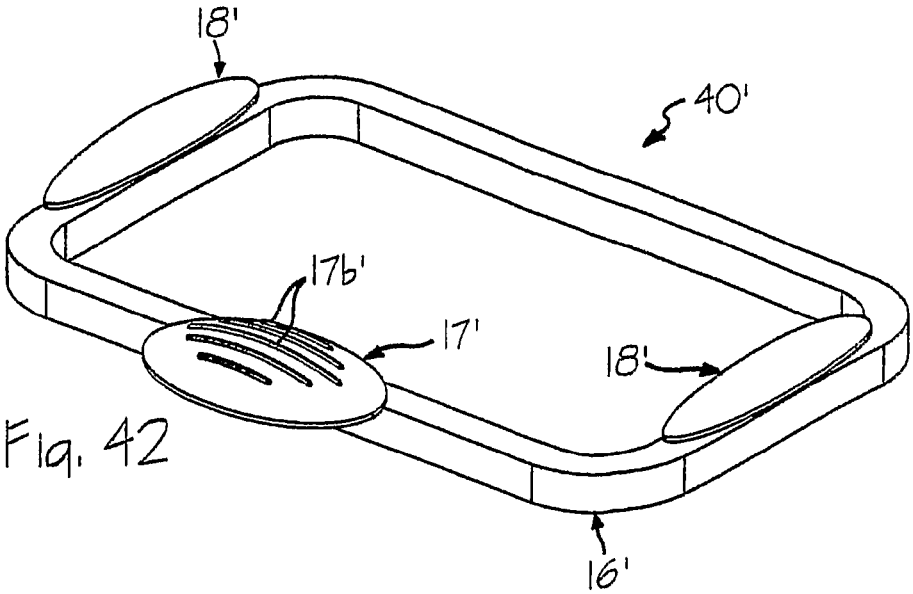
Fig. 42

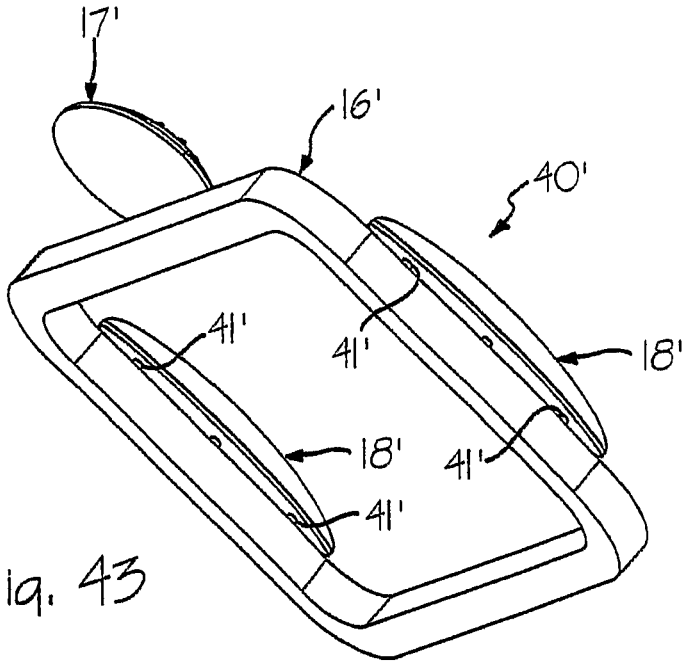
Fig. 43
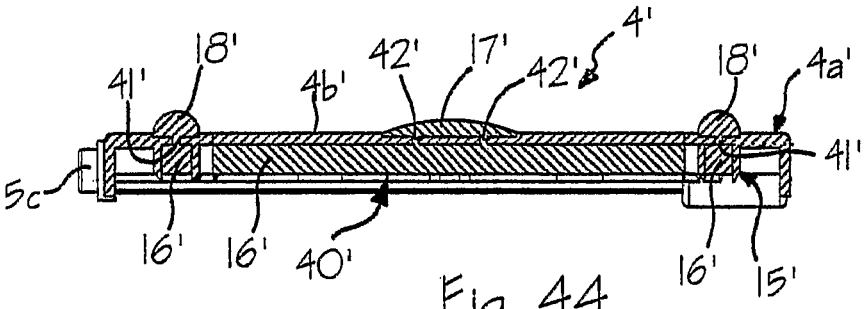
Fig. 44
Fig. 45
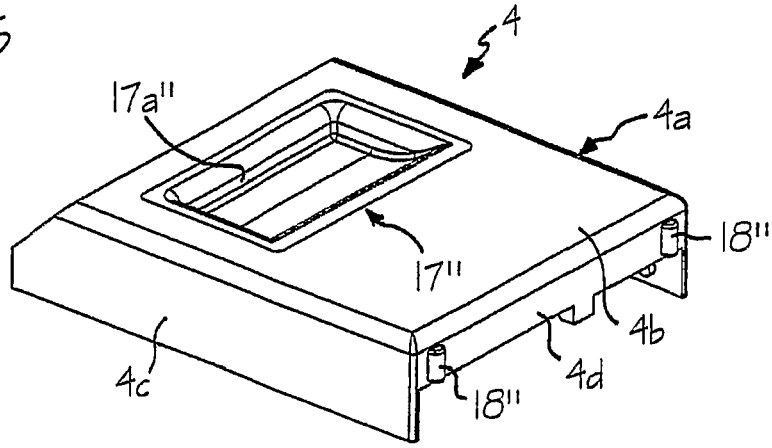

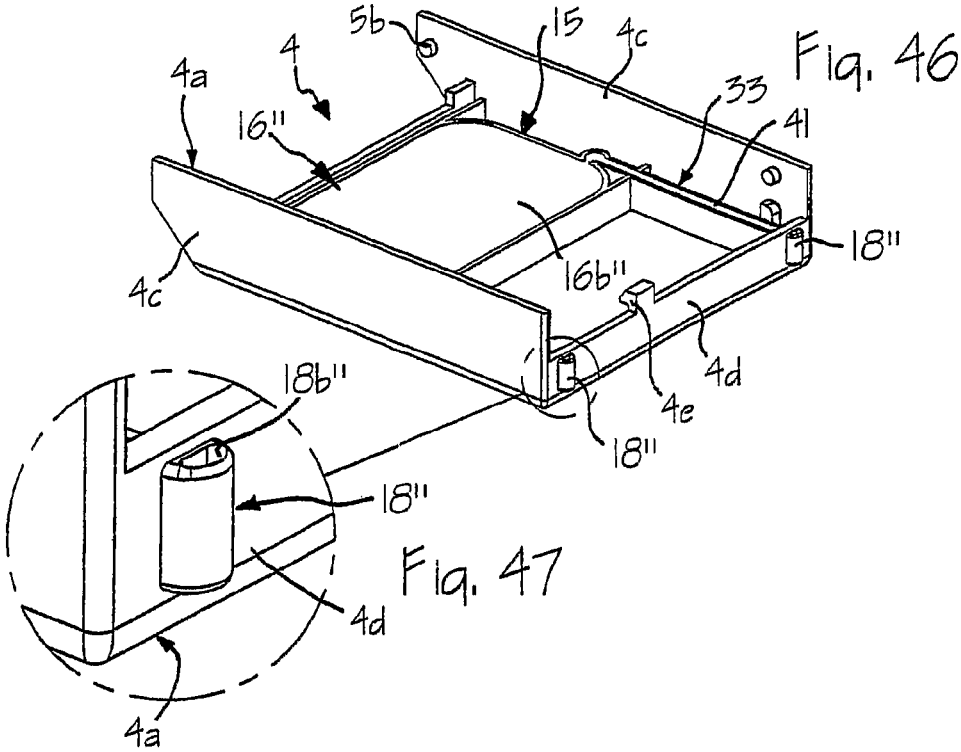
Fig. 46
Fig. 47
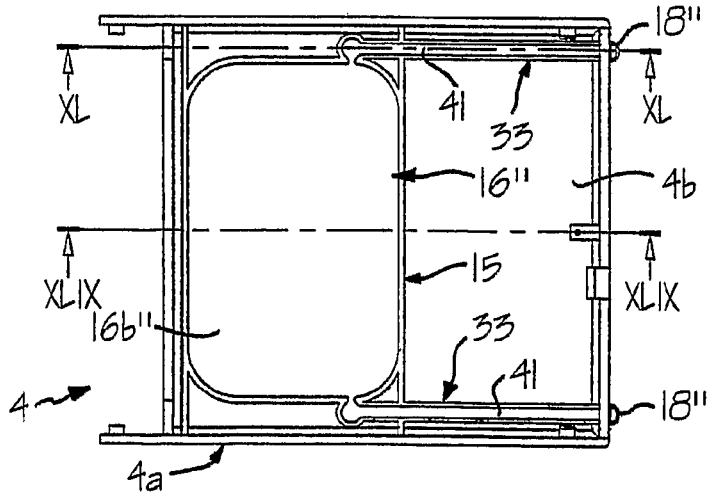
Fig. 48
Fig. 49
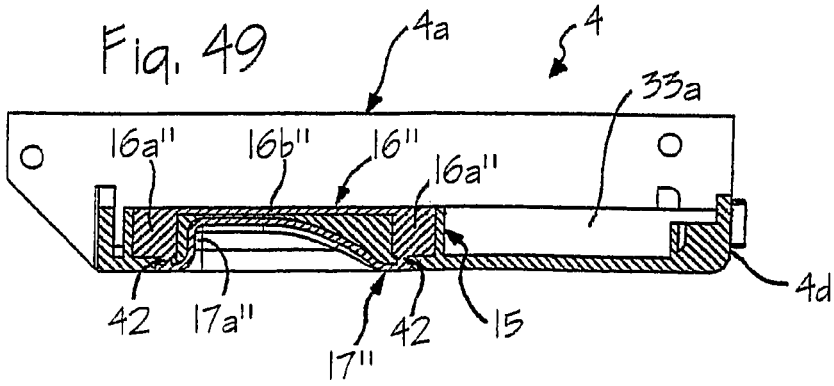

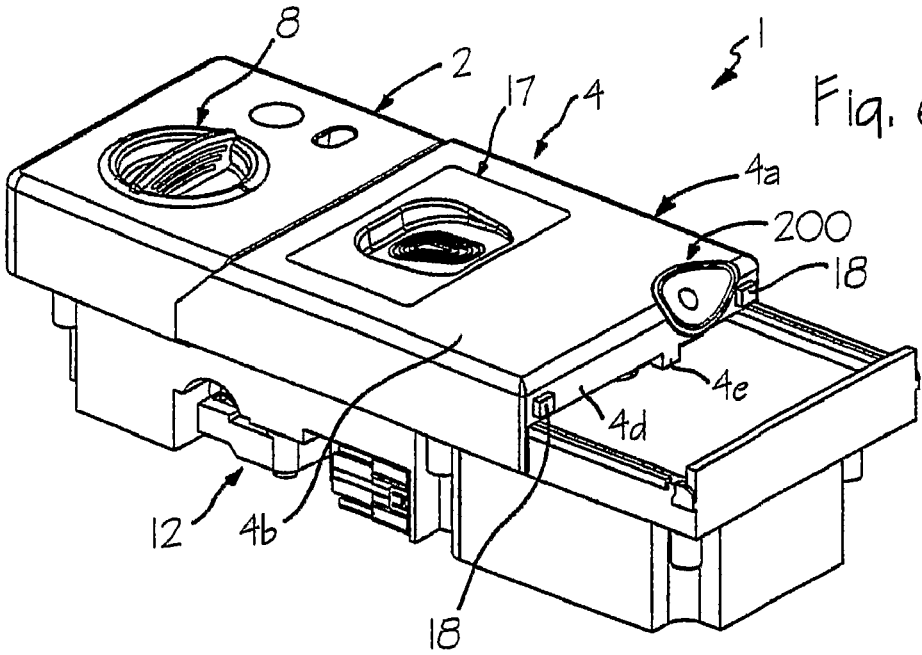
Fig. 68
Fig. 69
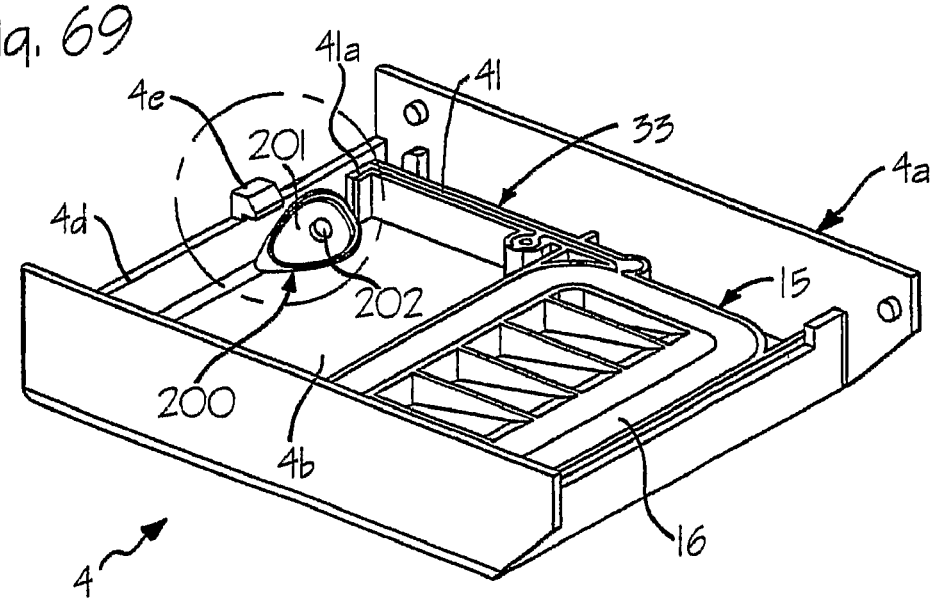
Fig. 70
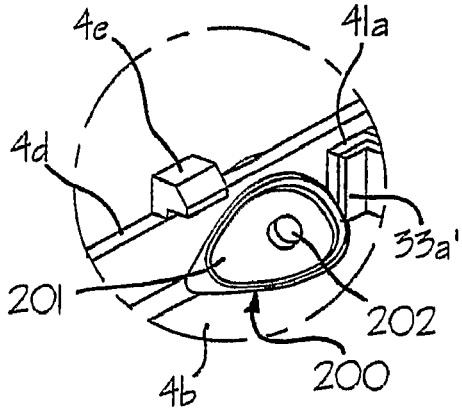

Fig. 71
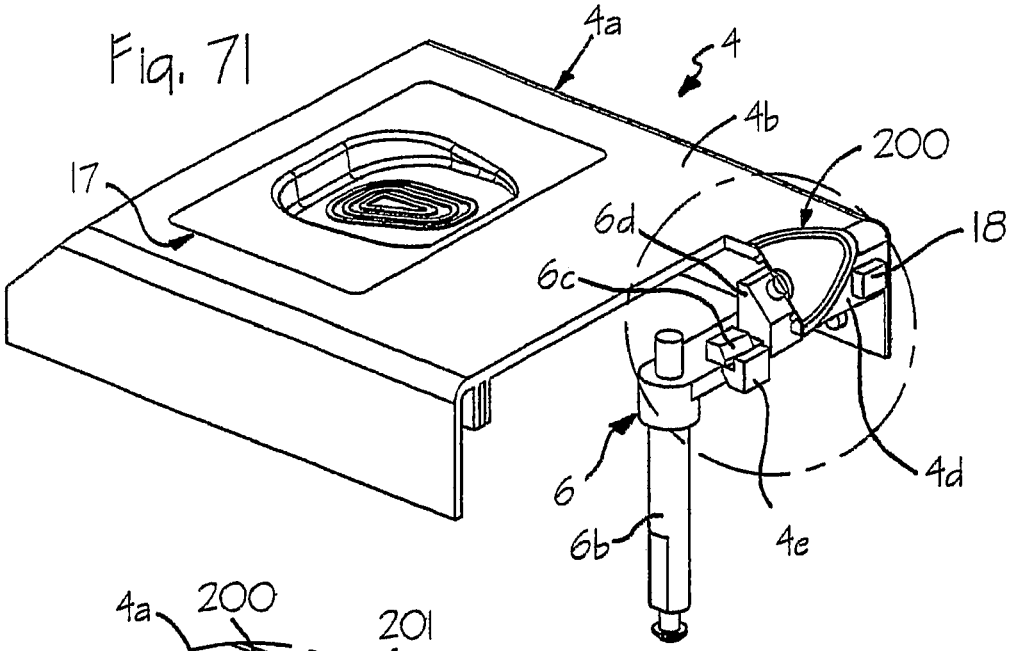
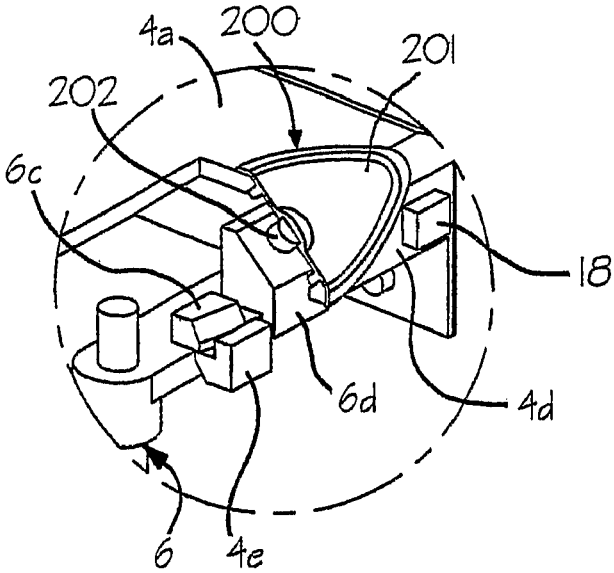
Fig. 72
Fig. 73
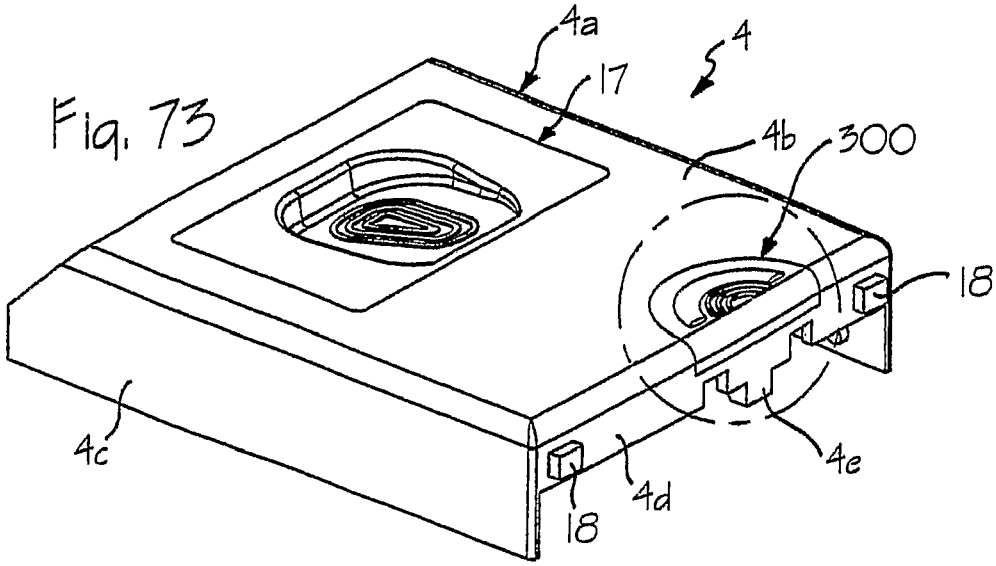

Fig. 80
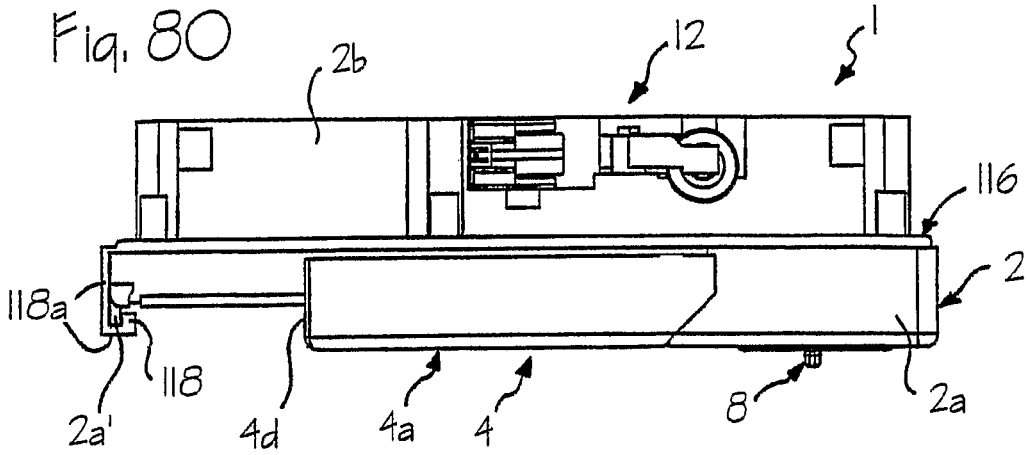
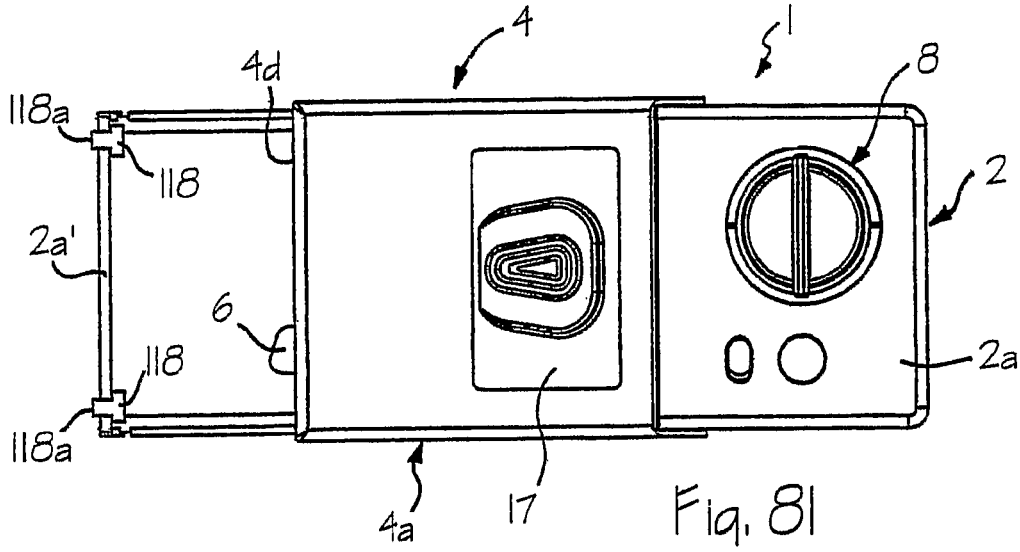
Fig. 81
Fig. 82
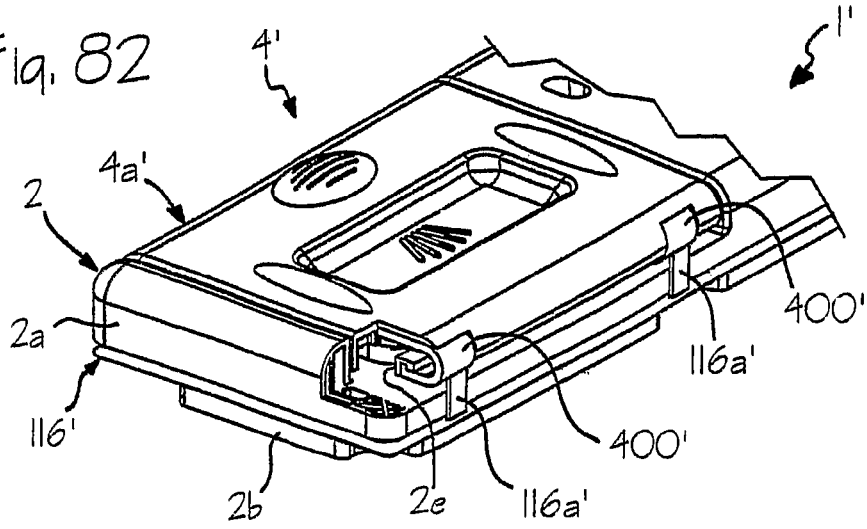

WASHING AGENT DISPENSER FOR A HOUSEHOLD WASHING MACHINE, IN PARTICULAR A DISHWASHER, AND PROCESS FOR MANUFACTURING SAID DISPENSER

CROSS REFERENCE TO RELATED APPLICATIONS

This application is a 371 national stage filing of PCT International Application No. PCT/IB2005/003400, filed on Nov. 4, 2005, and published in English on May 11, 2006, as WO 2006/048765 A2, which claims priority to Italian Patent Application No. TO2004a000772 filed on Nov. 8, 2004, the entire disclosures of which are incorporated herein by reference.

The present invention relates to a dispenser of washing agents for a household washing machine, in particular a dish washer, and to a process for manufacturing such a dispenser.

Some dispensers of the type referred to, typically for dish washers, comprise a main body or casing made of plastic material, associated to one of the vertical walls that delimit the washing tub of the machine. In the majority of cases, the aforesaid vertical wall is constituted by the so-called "counterdoor" or inner door panel, i.e., that part of the front loading door of the machine that faces the inside of the washing tub, and the main body of the dispenser is partially set-in in a sealed way in an opening provided in said inner door panel. In the front area of the body of the dispenser a compartment is defined, for containing a given amount of a first washing agent, usually a detergent in the form of powder or in the form of tablets, necessary for execution a washing cycle. The aforesaid compartment is provided with a respective door for closing, which can be tilted or can slide, and the dispenser comprises a system for locking/release of the door. In the course of a washing cycle, the opening of the small door referred to is controlled appropriately by a programmer, or timer, of the machine, which governs an actuator forming part of the aforesaid locking/release system. The latter is usually devised also for enabling, if need be and with the machine not running, manual opening of the small door.

Within the body of the dispenser a reservoir is provided, for containing a second washing agent of a liquid type, typically a rinse aid. In general, the reservoir referred to has a capacity such as to be able to contain an amount of liquid agent sufficient for carrying out a number of washing cycles. In this way, the user of the machine is called upon only periodically to carry out filling of the reservoir through a purposely provided filler cap. The aforesaid reservoir is in fluid communication with an internal receptacle, for dosage of the amount of liquid agent to be supplied in the course of a washing cycle. Some types of systems for dosage of the liquid rinse aid exploit the movement of opening and closing of the door of the machine, which is horizontal when open and vertical when closed, for transferring part of the agent from the reservoir to the dosing receptacle. Whilst the machine is running, the programmer controls an actuator (which may be the same as the locking/release system referred to above), which is operative for freeing a discharge passage present in a position corresponding to the dosing receptacle, so that the dose of rinse aid can flow from the latter to the washing tub of the dish washer.

The purpose of the present invention is to provide a dispenser of washing agents for a household washing machine which, even though it can be made in a simple and inexpensive way, is distinguished by improved characteristics of operativeness and of use as compared to those of the known art. Another purpose of the invention is to provide a simple and inexpensive process for manufacturing such a dispenser.

The above and yet other purposes, which will emerge clearly from what follows, are achieved according to the present invention by a device for dispensing washing agents for a household washing machine, in particular a dish washer, and by a process for manufacturing a dispenser of washing agents having the characteristics referred to specifically in the annexed claims, which form an integral part of the descriptive content of the present patent application.

The invention will now be described, purely by way of non-limiting example, with reference to the annexed plate of drawings, in which:

FIG. 4 is a partial exploded view of the dispenser of FIG. 1;

FIGS. 5 and 6 are, respectively, a perspective view and a plan view from beneath of a door of the dispenser according to the invention, in a first embodiment;

FIGS. 33 and 34 are two perspective views of the apparatus of FIG. 30, in two different conditions;

FIGS. 39 and 40 are two plan views, respectively from above and from beneath, of a rigid body of the door of FIGS. 36-38;

FIG. 41 is a cross-sectional view taken according to the line XLI-XLI of FIG. 39;

FIGS. 42 and 43 are two perspective views, from different angles, of a body made of elastic or soft material, which in use is integrated in the rigid body of FIGS. 39-41;

FIG. 44 is a cross-sectional view taken according to the line XLIV-XLIV of FIG. 36;

FIGS. 45 and 46 are two perspective views, from different angles, of a door of the dispenser according to the invention, in a fourth embodiment;

FIG. 47 is an enlarged detail of FIG. 46;

FIG. 48 is a plan view from beneath of the door of FIGS. 45-46;

FIG. 49 is a cross-sectional view taken according to the line XLIX-XLIX of FIG. 48, at a larger scale;

FIG. 68 is a perspective view of a dispenser having a door provided with a push-button for opening;

FIG. 69 is a perspective view of the bottom part of the door used in the dispenser of FIG. 68;

FIG. 70 is an enlarged detail of FIG. 69;

FIG. 71 is a partially sectioned perspective view of the door of FIG. 69, together with part of a respective locking/release system;

FIG. 72 is an enlarged detail of FIG. 71;

FIG. 73 is a perspective view of the top part of a further door provided with a push-button for opening;

FIGS. 80 and 81 are, respectively, a side view and a plan view of a dispenser according to a further embodiment of the invention, with a respective door in the closed condition; and FIG. 82 is a partially sectioned perspective view of a part of a dispenser according to a further embodiment of the invention, with a respective door in the open condition.

Figure 1:
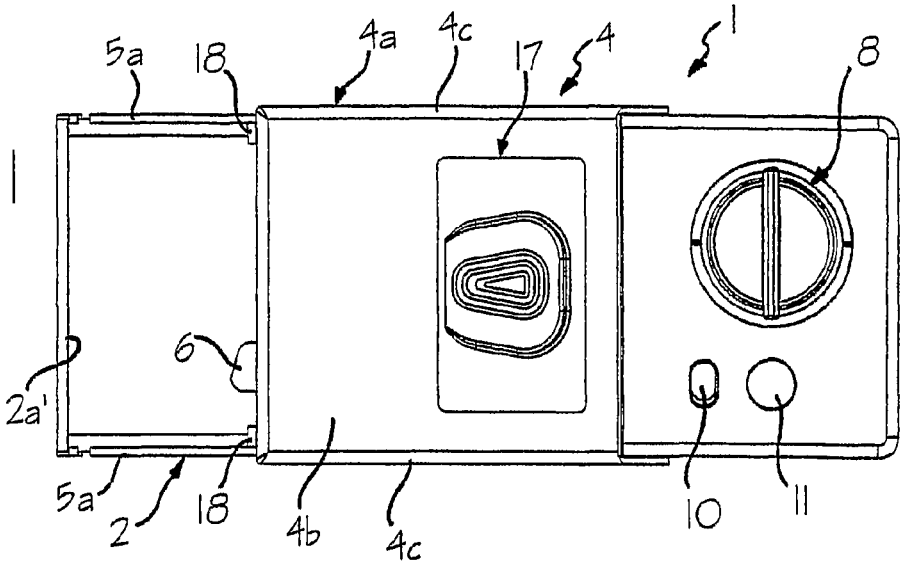
FIGS. 1 and 2 are, respectively, a plan view and a side view of a dispenser according to the invention, in a first operative condition.
Figure 2:
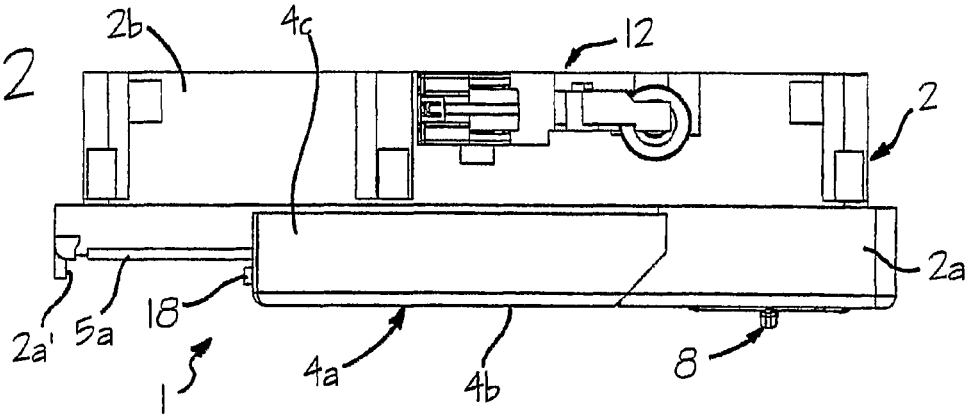
Figure 3:
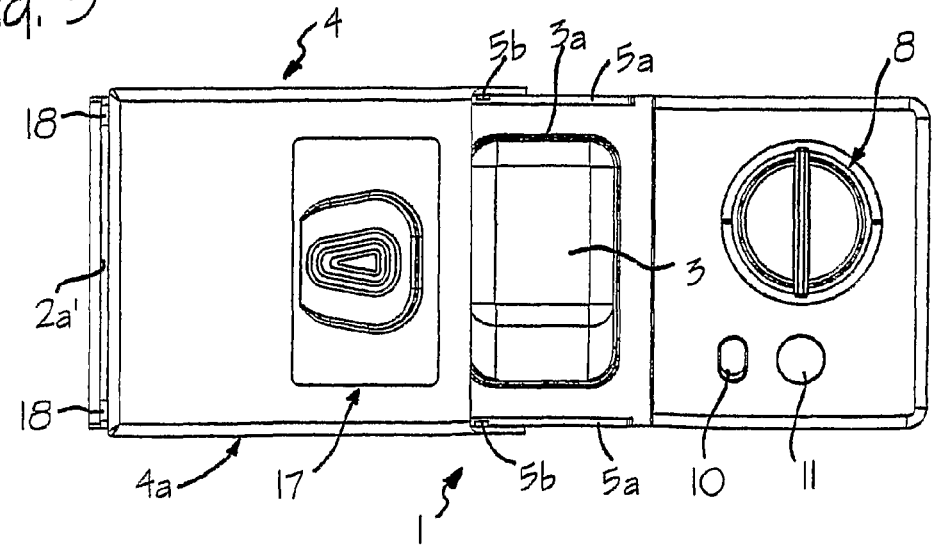
FIG. 3 is a side view of the dispenser of FIG. 1, in a second operative condition.

In FIGS. 1 to 4, the reference number 1 designates as a whole a dispenser of washing agents built in accordance with the present invention, designed for use on a washing machine (not represented) which is here assumed as being a dish washer. The dispenser 1 has a main body or casing 2, preferably designed to be housed at least in part in an opening provided on the inner side of the main door of the dish washer. As in the known art, the body 2 can be obtained by welding of a front piece and a rear piece, designated, respectively, by 2*a* and 2*b* in FIG. 2, made of thermoplastic material. In the front piece 2*a* a compartment or tray 3 is defined, open in the direction of the front part of the dispenser 1, which constitutes a space for containing a certain dose of detergent, necessary for the execution a washing cycle. For the purposes of the ensuing description, it is assumed that said detergent is in the form of powder, but it should be borne in mind that the compartment 3 is suitable for containing also detergent in the form of tablets, gel, foam, liquid, etc.

The number 4 designates as a whole a movable door for the compartment 3, comprising a rigid body made of thermoplastic material, designated by 4*a*. In the non-limiting embodiment exemplified herein, the door 4 is mounted on the body 2 of the dispenser 1 so as to be able to slide between a closed position (shown in FIGS. 1 and 2), in which the compartment 3 is closed, and an open position (shown in FIG. 3), in which the compartment 3 is open, the door 4 being made and coupled to the body 2 so as to be able to slide in a prevalently linear way between the two aforesaid positions, i.e., translate during at least part of its own travel on a plane that is substantially parallel or else inclined with respect to the front surface of the body 2. Dispenser devices with linearly sliding doors are in themselves known. Except for the peculiar characteristics of the invention described hereinafter, the general structure of the dispenser 1 as described in FIGS. 1-4 can be considered similar to the one described in the documents Nos. EP-A-0 780 087 or U.S. Pat. No. 5,884,821, the teachings of which in this regard are considered as being incorporated herein for reference.

Preferably, the most part of the travel allowed for the door 4 takes place according to a plane that is substantially parallel or else inclined with respect to at least one part of the surface of the wall of the washing tub to which the dispenser 1 is associated. It should on the other hand be noted that, in a possible embodiment, the door could perform a stretch of travel with a slightly different inclination or movement, as for example described also in the document No. EP-A-1 450 661, the teachings of which in this regard are to be considered incorporated herein for reference. For the purposes of an understanding of the invention, it will suffice to say herein that:

- in the front part of the piece 2*a* of the body 2 slide guides 5*a* are defined, which can co-operate with guide means 5*b* formed in the body 4*a* of the door 4;
- the dispenser 1 comprises a system for locking/release of the door 4, having a lever for engagement/release, designated by 6 in FIG. 4, which is able to co-operate with a projection or engagement tooth 4*e* of the body 4*a*; and
- the door 4 is biased in the direction of the respective open position via an elastic element, herein constituted by a torsion spring designated by 7 in FIG. 4, which is in a pre-loaded condition when the door 4 is closed.

In the main body or casing 2 an internal space or reservoir is defined (not visible in the figures) for containing a liquid washing agent, such as a rinse aid. For said purpose, the reference number 8 designates the filler cap of a mouth 9, in communication with the reservoir referred to above, used for charging said reservoir with the rinse aid. Number 10 designates a discharge opening, through which a dose of said rinse aid can be made to flow off in the direction of the washing tub of the dish washer. Number 11 designates a warning light for the level of the rinse aid present within the corresponding reservoir. Also the modalities of construction and operation of the reservoir for the rinse aid, as well as of the corresponding system for dosage and delivery, will not be described in detail, in so far as they are irrespective of the purposes of the present invention and can be obtained using any known technique. It will suffice herein to point out that the dispenser is preferably provided with a actuation system, designated as a whole by 12 in FIGS. 2 and 4, which comprises a mechanism that enables, preferably via a single actuator controlled by a programmer of the machine, actuation, at different times of a washing cycle, of both the lever 6, in order to enable opening of the door 4, and the system of delivery of the rinse aid through the opening 10.

As will emerge clearly in what follows, the invention specifically regards the main body or casing of the dispenser, as well as to at least one (but possibly both) of the members for closing the dispenser 1 constituted by the door 4 and by the cap 8, which likewise comprise a respective body made of substantially rigid material, for example polypropylene or polyamide, to which respective sealing means made of elastic, soft or rubbery material are associated.

According to an aspect of the invention, the rigid body of the dispenser and/or of at least one of the aforesaid closing members 4, 8, in addition to being equipped with respective gaskets, is also equipped with other elastic, soft or rubbery elements, formed for example with elastomeric, silicone or similar synthetic resilient materials, said additional elements constituting specific functional complements aimed at increasing the operativeness of the dispenser 1. As will be seen, said functional complements can be conceived at least for facilitating the manual operations of opening and/or closing which, according to the needs, a user must perform by acting directly on the members 4, 8, and/or for improving the characteristics of quietness of operation of the dispenser 1, and/or possibly improving its aesthetic appearance. In advantageous embodiments of the invention, the aforesaid additional elements are obtained, like the sealing means, via operations of overmoulding or co-moulding of material on the main body of the dispenser or of a respective closing member or else of overmoulding of an elastic or soft material on a rigid material. In a particularly advantageous embodiment, a number of additional elements are made of a single piece with the sealing means, both the ones and the others being obtained via a single overmoulding or co-moulding operation.

Figure 6:
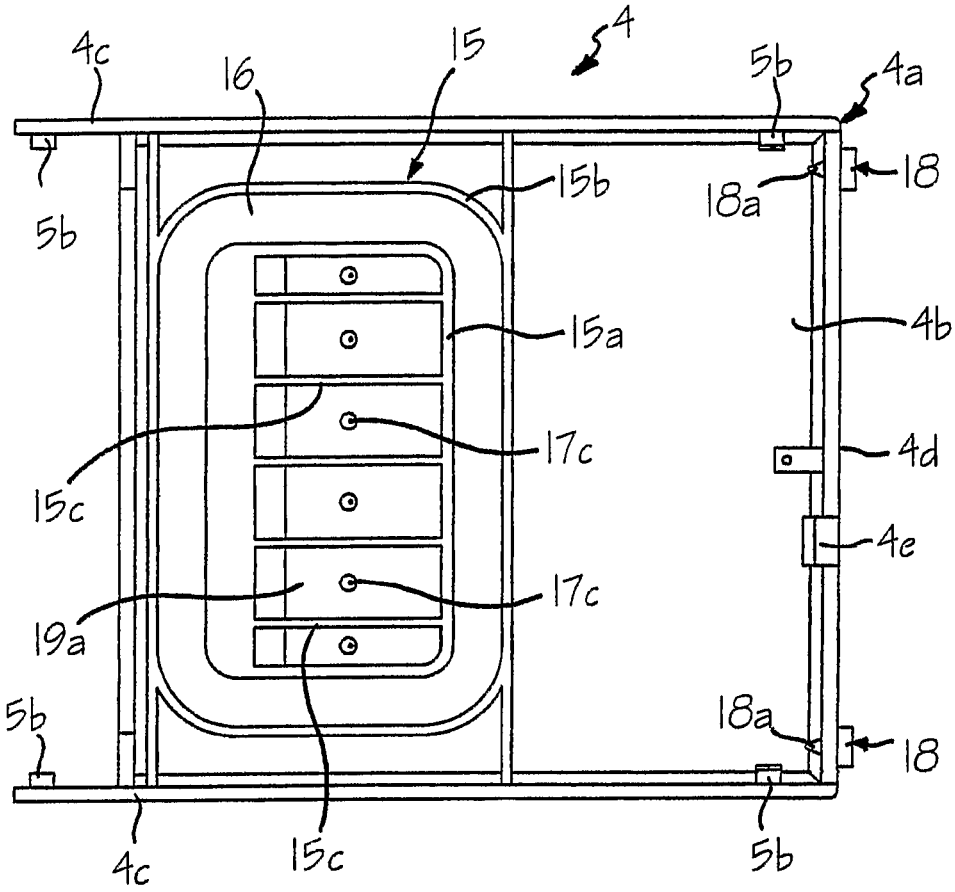

In FIGS. 5 and 6 the door 4 of the dispenser 1 according to a first possible embodiment of the invention is represented.

The body 4*a* of the door 4 is made of moulded thermoplastic material, for example polypropylene, and basically has a main wall or bottom wall 4*b*, from two opposite edges of which there branch off orthogonally two side walls 4*c*, carrying respective guide means 5*b* for linear sliding of the door. According to a known technique, and as may be seen in FIG. 6, in the part of the wall 4*b* designed to face the compartment 3 a housing seat 15 for a sealing gasket is present, designated as a whole by 16, made, for example, of silicone or synthetic rubber. The seat 15 is basically formed by two walls 15*a*, 15*b* with a closed profile, which are concentric with respect to one another, so that in the space defined between them there can be housed the gasket 16. In this way, an active surface of the gasket 16 is directly exposed with respect to the body 4*a*, in order to be able to co-operate at least partially in a relationship of sealing with a lip or projecting profile 3*a* (see FIGS. 3 and 4) that surrounds the opening of the compartment 3. Preferably, the walls 15*a* and 15*b* define a substantially quadrangular profile with chamfered or rounded corners. In the case exemplified, moreover, in the area of the body 4*a* delimited by the wall 15*a* longitudinal ribbings 15*c* are formed, with ends substantially flush to the sealing surface of the gasket 16. Said ribbings 15*c* are provided for preventing any jamming of the movement of the door 4, when a tablet of detergent is inserted in the compartment 3, i.e., to prevent said tablet from possibly getting jammed in the area of the body 4*a* delimited by the wall 15*a*.

To the body 4*a* of the door 4 there are also associated additional elements or complements made of elastic or soft material, for example silicone rubber, which are designated by 17 and 18. The element 17 constitutes a gripping means, aimed at facilitating gripping or friction of one or more fingers of a user on the door 4, when the latter must be displaced manually. In such a perspective, the element 17 constitutes a means designed to facilitate the thrust or tensile force to be exerted manually on the door 4. The elements 18 constitute, instead, attenuation means, aimed both at buffering any impact due to an end-of-travel position for opening of the door 4 being reached and at reducing and/or damping the noise and the vibrations of operation of the dispenser 1 and at preventing damage over time due to repeated impact or mechanical stresses.

In the embodiment in question, the attenuation elements 18 are operative in a position corresponding to an end surface 4*d* of the door 4, orthogonal with respect to the walls 4*a* and 4*b*, so as to face a wall in relief of the piece 2*a* of the body 2 of the dispenser 1, which constitutes a mechanical end-of-travel means. The aforesaid wall in relief is designated by 2*a*' in FIGS. 1-4. The attenuation means 18 constitute, together with the wall in relief 2*a*', damped end-of-travel means for the door 4, which prevent any direct impact between the two substantially rigid materials that constitute the body 4*a* of the door and the piece 2*a* of the body of the dispenser 1. Thanks to said characteristic, any sharp impact is prevented between the parts, with consequent elimination of noise and vibrations during opening and whilst the machine is running.

Figure 7:
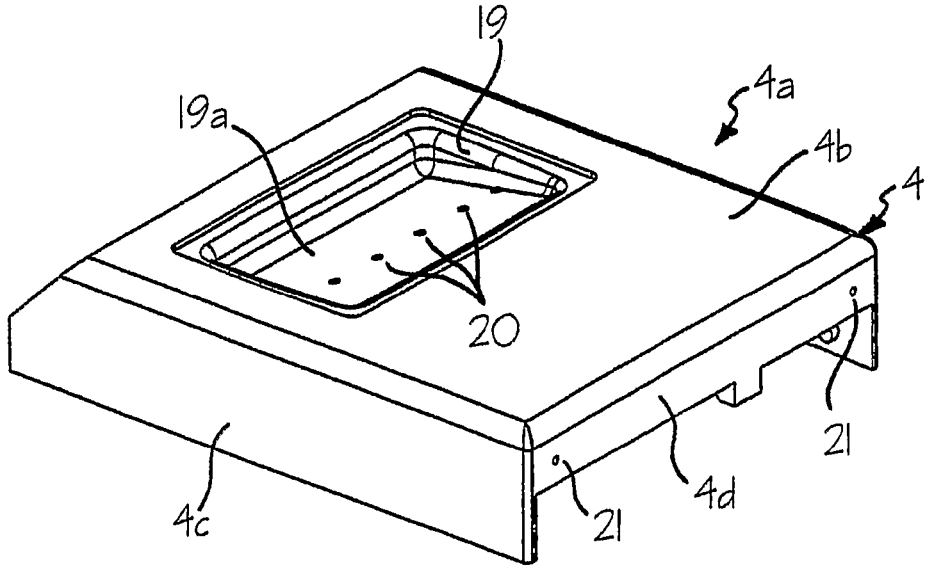
FIGS. 7 and 8 are, respectively, a perspective view and a plan view of a rigid body of the door of FIG. 5.
Figure 8:
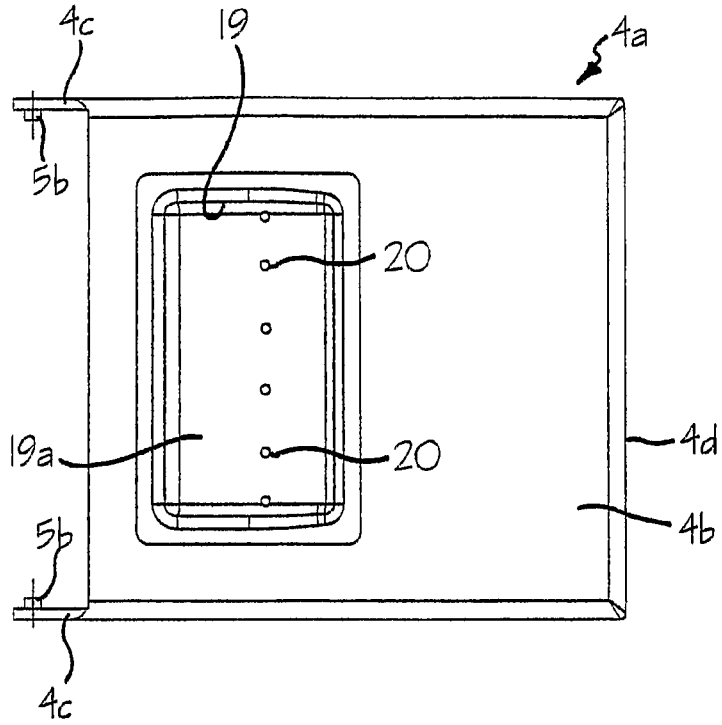
Figure 9:
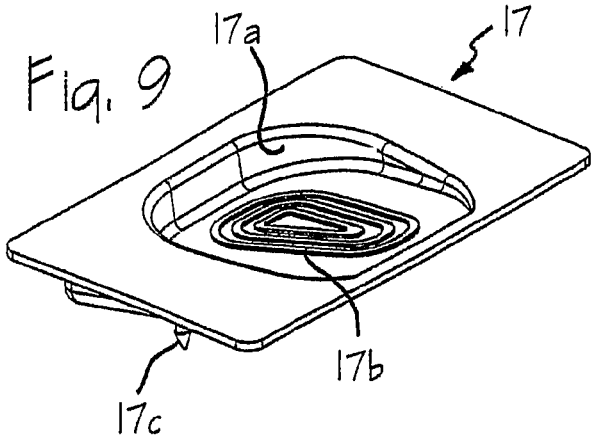
FIGS. 9 and 10 are perspective views, from different angles, of a gripping element designed to be associated to the body of FIGS. 7 and 8.
Figure 10:
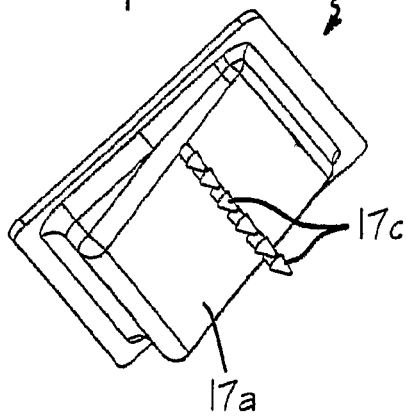
Figure 11:
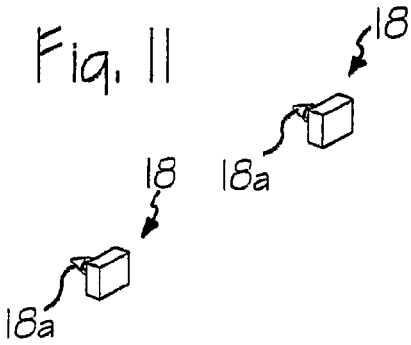
FIGS. 11 and 12 are perspective views, from different angles, of two damping elements designed to be associated to the body of FIGS. 7 and 8.
Figure 12:
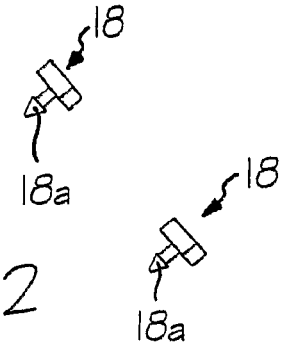
Figure 13:
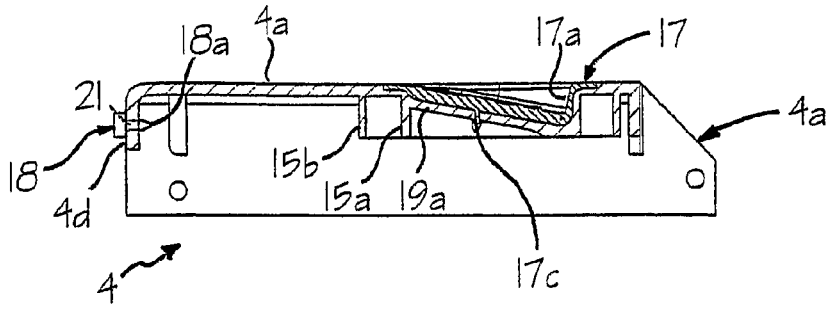
FIG. 13 is a longitudinal cross-sectional view of the door of FIGS. 5 and 6.

FIGS. 7 and 8 represent just the body 4*a* of the door 4. As may be noted, the body 4*a* has at the top a concave seat, designated by 19, which is designed to house the gripping element 17 and has an inclined wall or bottom 19*a*. It should be noted that the ribbings 17*c* rise from said bottom 19*a*, in the lower face of the body 4*a*, as may be seen in FIG. 6. In the bottom 19*a* of the seat 19 a series of holes 20 is formed. Two holes, designated by 21, are formed also in the end surface 4*d* of the body 4*a*, the aforesaid holes 20 and 21 being provided for fixing the elements 17 and 18. In FIGS. 9 and 10 is visible just the gripping element 17. In the case exemplified, the body of the gripping element 17 has a top part, visible in FIG. 9, in which a central depression 17*a* is defined, within which reliefs and/or cavities or surface corrugations 17*b* are formed, which have, for example, a closed profile and are concentric. Said corrugations, together with the elasticity of the material constituting the element 17, facilitate gripping or friction of the finger of a hand (typically the thumb) on the door 4, in order to then bring about its sliding in the direction of closing. Substantially mushroom-shaped hookings 17*c*, rise from the rear part of the body of the element 17 having a substantially cylindrical and conically tipped stem, the base of said cone being of a diameter greater than that of the stem. In FIGS. 11 and 12 there are visible just the attenuation elements 18. In the case exemplified, each element 18 has a full parallelepipedal part with a larger face, from which there branches off at least one hooking 18*a*, having a shape similar to that of the hookings 17*c* of the gripping element 17. In FIG. 13 it may be noted how the hookings 17*c* of the gripping element 17 are designed to be slid into the holes 20 provided on the bottom 19*a* of the seat 19, which are of a diameter smaller than that of the bases of the aforesaid conical tips. As may be appreciated, given the elasticity of the material constituting the entire gripping element 17, the hookings 17*c* can be conveniently fully inserted into the holes 20, with the base of the conical tips that then prevent undesired removal of the element 17 itself from the body 4*a*, thus providing snap-action engagement. From the same FIG. 13 it is then possible to note how the hookings 18*a* of the attenuation elements 18 are designed to be slid into the holes 21 provided in the surface 4*d* of the body 4. Also in this case, given the elasticity of the material constituting each attenuation element 18, the hooking 18*a* can be conveniently and rapidly inserted into a hole 21, with the base of the respective conical tip that then prevents undesired removal of said element 18 from the body 4*a*.

In FIGS. 14-24 there is illustrated a second embodiment of the invention, in accordance with which the gasket 16, and at least one of the additional elements 17 and 18 are made of a single piece of elastic or soft material, for example a silicone rubber.

Figure 14:
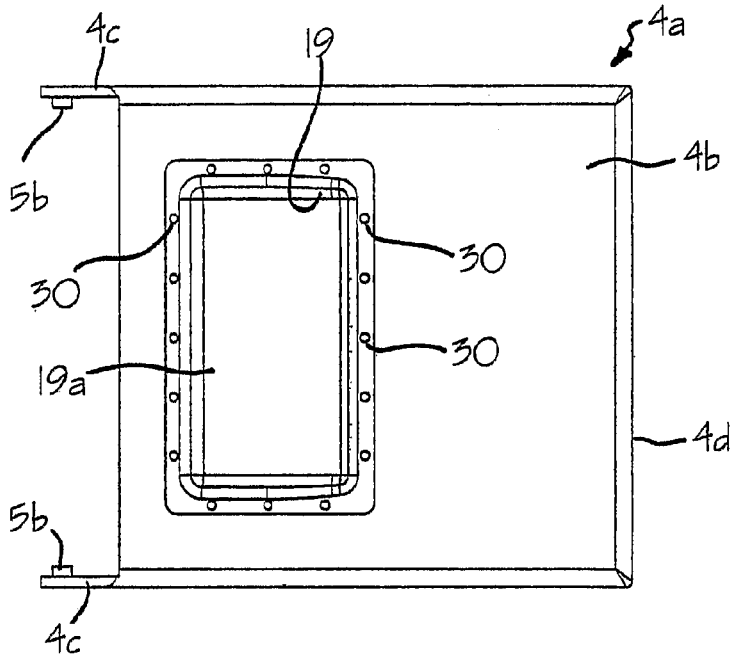
FIGS. 14 and 15 are two plan views, respectively, from above and from beneath, of a rigid body of a door of the dispenser in accordance with the invention, in a second embodiment.
Figure 15:
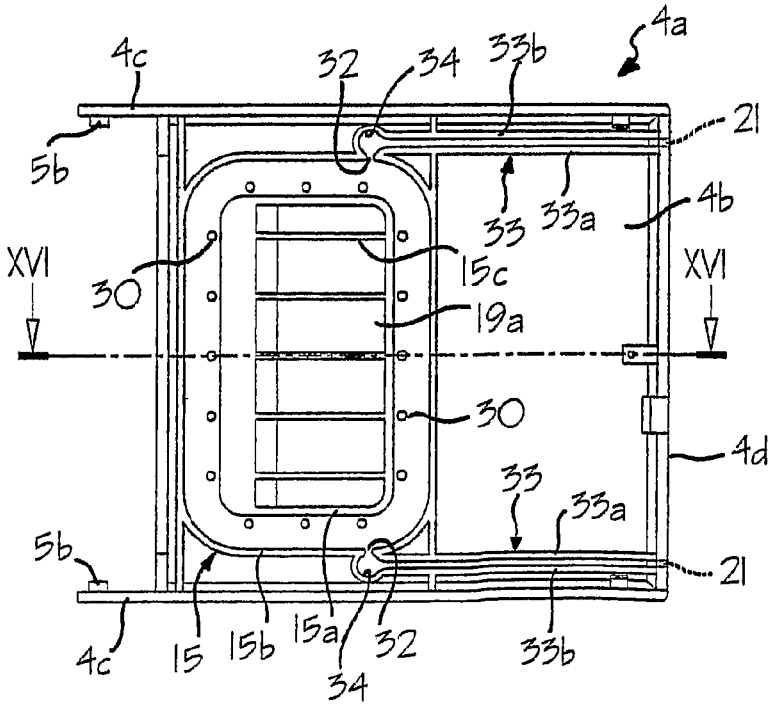
Figure 16:
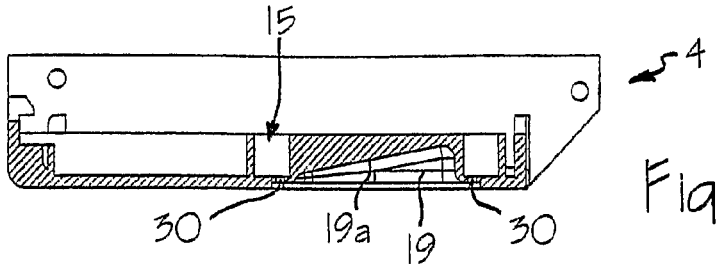
FIG. 16 is a cross-sectional view taken according to the line XVI-XVI of FIG. 15.
Figure 17:
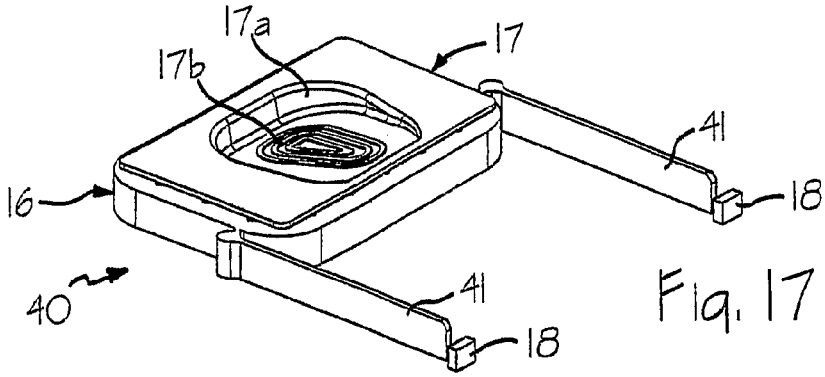
FIGS. 17 and 18 are two perspective views, at different scales and from different angles, of a body made of elastic or soft material, which in use is integrated to the rigid body of FIGS. 14-16.
Figure 18:
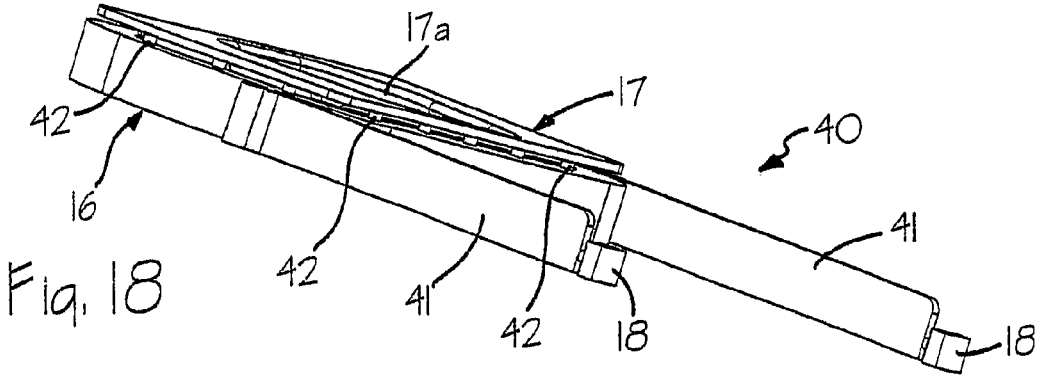
Figure 19:
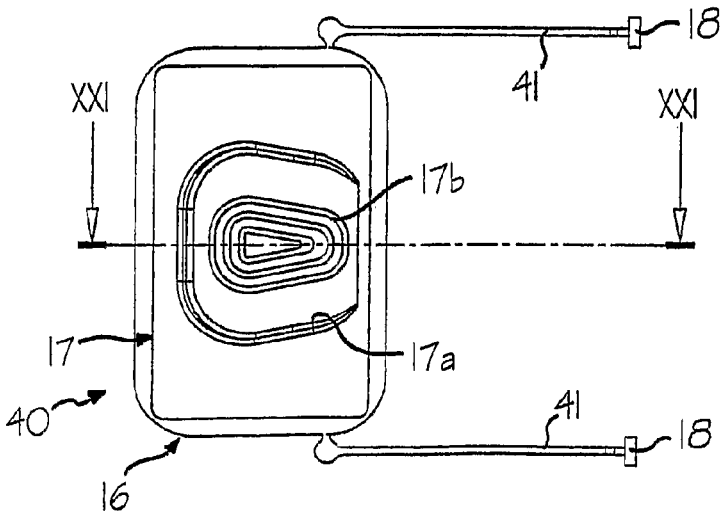
FIGS. 19 and 20 are two plan views, respectively from above and from beneath, of the body made of elastic material of FIGS. 16 and 17.
Figure 20:
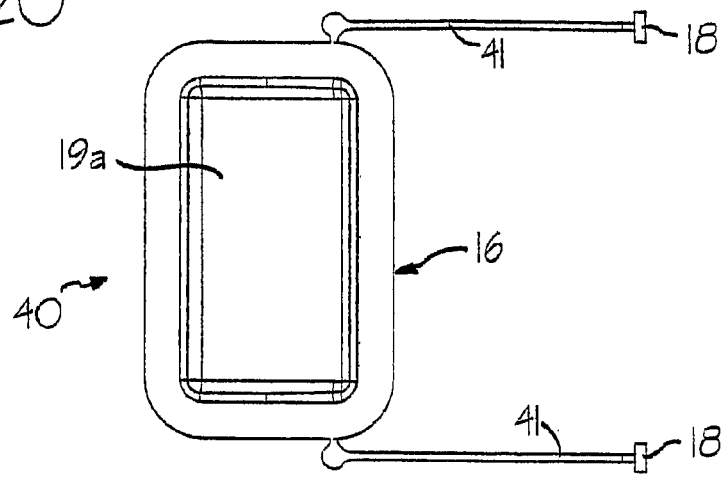

In FIGS. 14-16 there is illustrated just the rigid body 4*a* of the door 4, made of thermoplastic material, such as polypropylene. As may be seen in FIGS. 14 and 15, also in this case the body 4*a* has a slot or concave seat 19, the bottom 19*a* of which is, however, without the holes 20 provided in the previous embodiment. A series of through holes 30 is, instead, present along the periphery of the seat itself. As may be noted in FIGS. 15 and 16, the aforesaid holes 30 terminate, on the opposite side of the body 4*a*, in the bottom of the seat 15 delimited by the internal wall 15*a* and external wall 15*b*. In this case, the external wall 15*b* has, in a position corresponding to each of its two smaller sides, an interruption 32, from which there branch off two respective wall portions 33*a*, 33*b*, substantially parallel to one another, which form a channel or additional seat 33 that extends between a respective hole 21 and the seat 15, said additional seat being substantially parallel to a side of the seat 15. As may be noted, substantially in a position corresponding to the interruption 32, i.e., in the area of connection between the seats 15 and 33, the latter has a widening, herein of a substantially circular cross section, designated by 34. Via the holes 30 and the additional seats 33, the seat 15 is connected both to the concave seat 19 for the element 17 and to the holes 21 for the elements 18, respectively. Thanks to said solution, the door 4 in accordance with the second embodiment can be provided with a respective gasket 16, a gripping element 17 and at least two attenuation elements 18 formed in a single component or body, obtainable via a single overmoulding operation of elastic or soft material on the body 4*a*.

Figure 21:
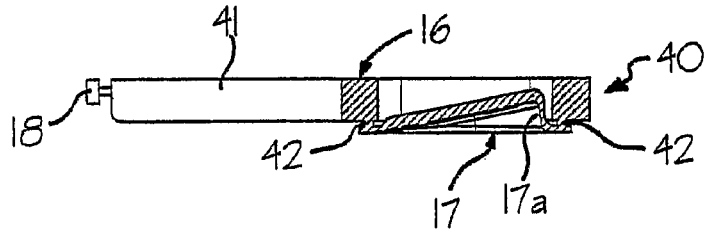
FIG. 21 is a cross-sectional view taken according to the line XXI-XXI of FIG. 19.
Figure 22:
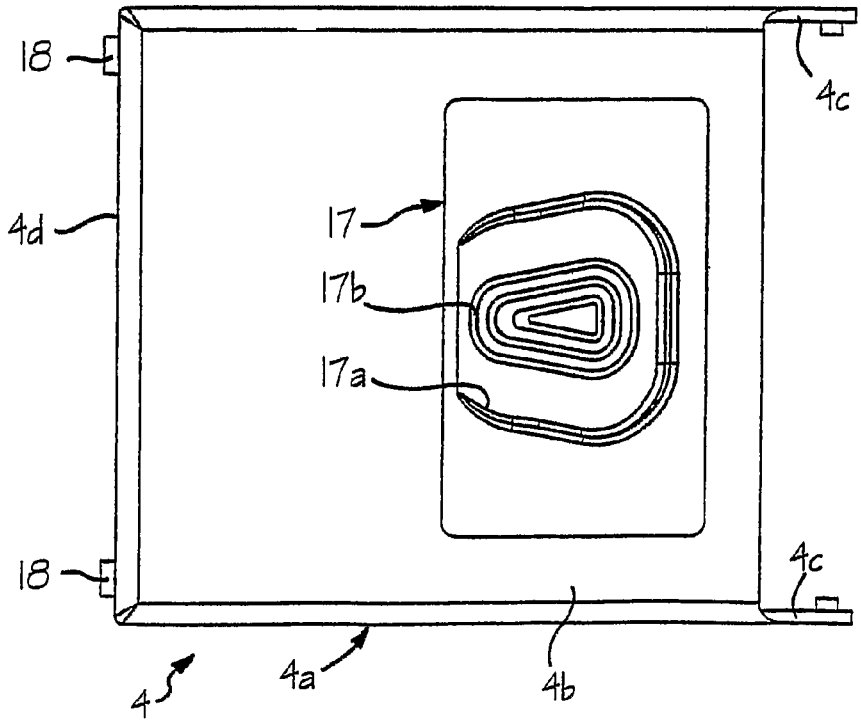
FIGS. 22 and 23 are two plan views, respectively from above and from beneath, of the door according to the aforesaid second embodiment of the invention.
Figure 23:
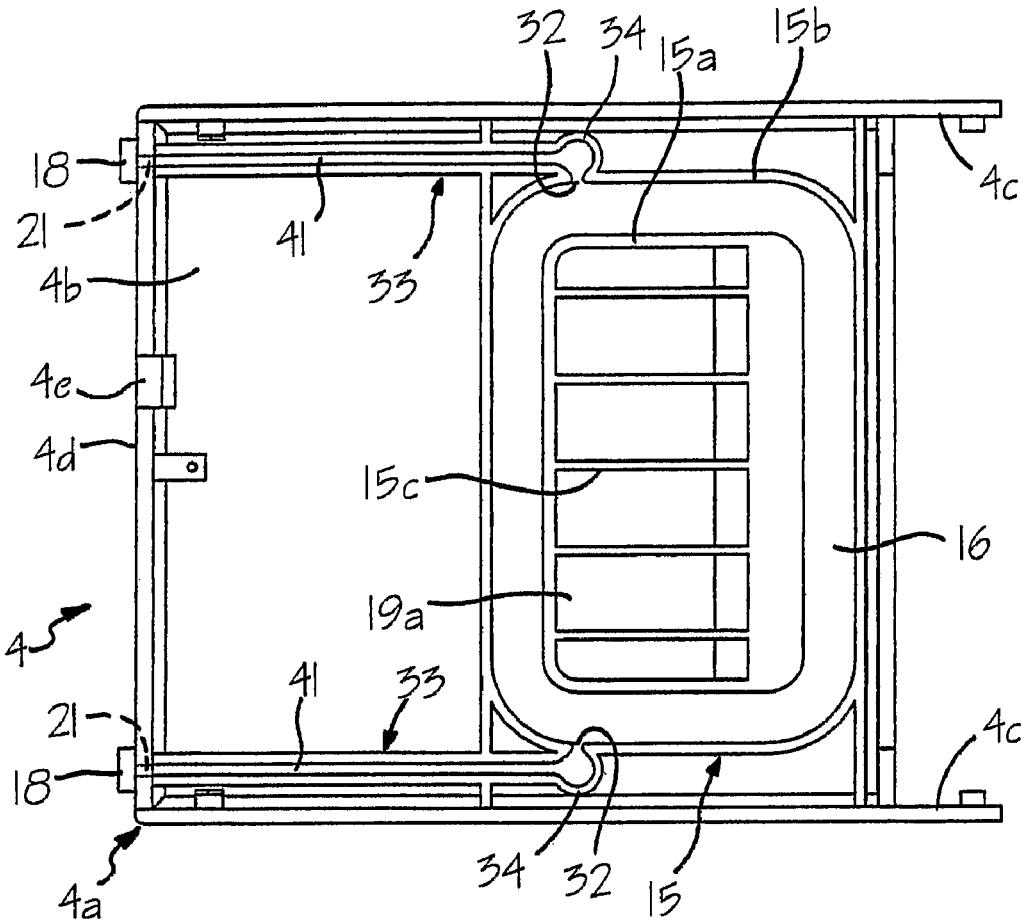
Figure 24:
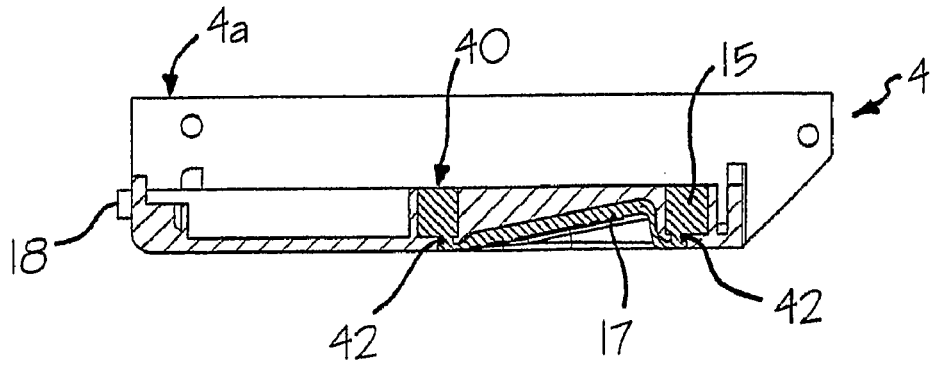
FIG. 24 is a longitudinal cross-sectional view of the door of FIGS. 22 and 23.

In FIGS. 17-20 there is represented for reasons of greater clarity just the single body made of elastic material, designated as a whole by 40, that can be obtained via the aforesaid overmoulding operation. As may be noted, in the single body 40 the respective parts that form the gasket 16, the gripping element 17, and the attenuation elements 18 may be identified. The attenuation elements 18 are connected to the gasket 16 via first, substantially parallelepipedal, body portions 41 formed by the overmoulding material that has filled the additional seats 33 of FIG. 15. On the other hand, the gripping element 17 is connected to the gasket 16 via second substantially cylindrical body portions 42 (which can be seen particularly in FIGS. 17 and 18), formed by the overmoulding material that has filled the holes 30 represented in FIGS. 14-16. In FIG. 21 it may moreover be noted how the end of the central depression 17*a* of the gripping element 17 is located within the quadrangular profile formed by the gasket 16. In FIGS. 22-24 there is represented the door 4, including the bodies 4*a* and 40 made of, respectively, rigid material and of elastic material. As may be seen in FIG. 22, the door 4 in accordance with the second embodiment is, on the outside, altogether similar to the door of FIG. 5 since it is provided with the gripping element 17 and the attenuation elements 18. On the other hand, in the internal part of the door 4, i.e., the part designed to be set facing the body 2 of the dispenser 1, the gasket 16 is housed in the seat 15, which, as has been said, is joined to the gripping element 17 via the body portions 42 passing through the holes 30, as may be seen in FIG. 24. The attenuation elements 18 are, instead, joined to the gasket 16 via the body portions 41 positioned in the additional seats 33 and through the holes 21.

It should be emphasized how provision of the single body 40 always guarantees maintenance of the correct working position by the gasket 16 and the elements 17 and 18, by virtue of a union between said elements and hence without the need for the hookings 17*c*, 18*a* described previously. On this point it should be recalled, for example, that in the doors of the dispensers of a known type, maintenance of the correct position of the gasket must be guaranteed through slight hot mechanical deformations of the walls that delimit the seat of said gasket. In practice, after moulding of the rigid body of the door on one production line and moulding of the gasket on a different production line, the gasket itself must be inserted into the respective seat, and the latter must subsequently undergo local deformation. In the second embodiment of the invention proposed herein, the operation of overmoulding of the single body 40 substantially replaces three distinct steps envisaged according to the known art (obtaining separately the gasket, its insertion into the seat and deformation of the seat), with evident advantages in terms of production times and costs.

Figure 25:
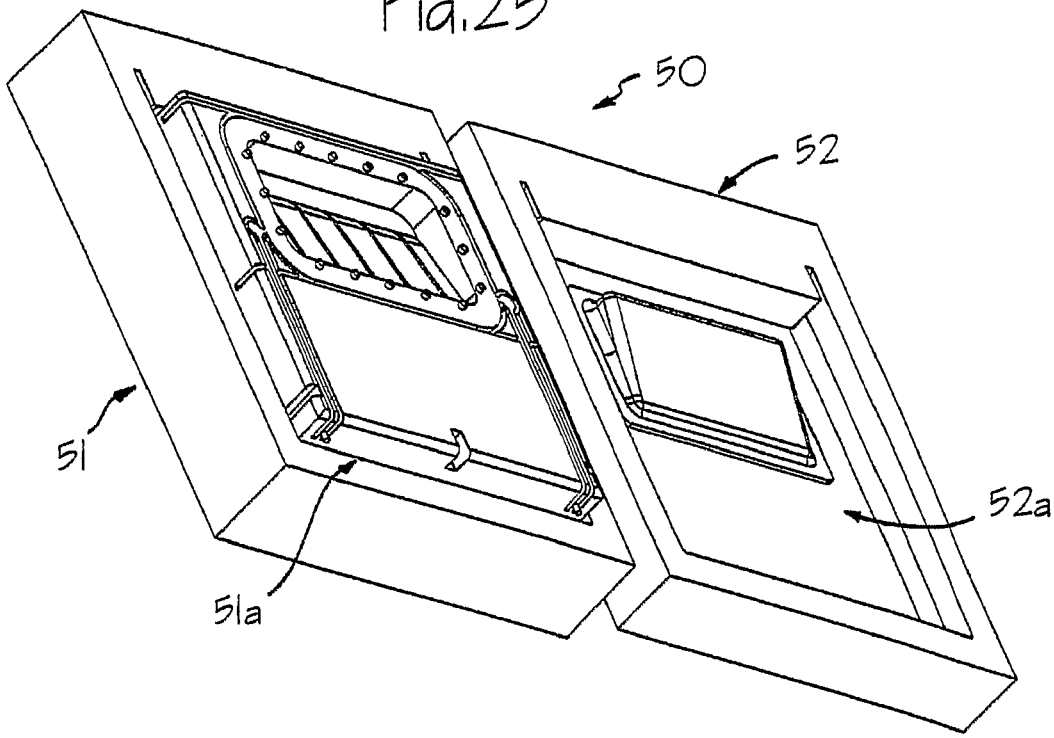
FIG. 25 is a perspective view of a moulding apparatus, used for the purposes of producing the rigid body of FIGS. 14-16.
Figure 26:
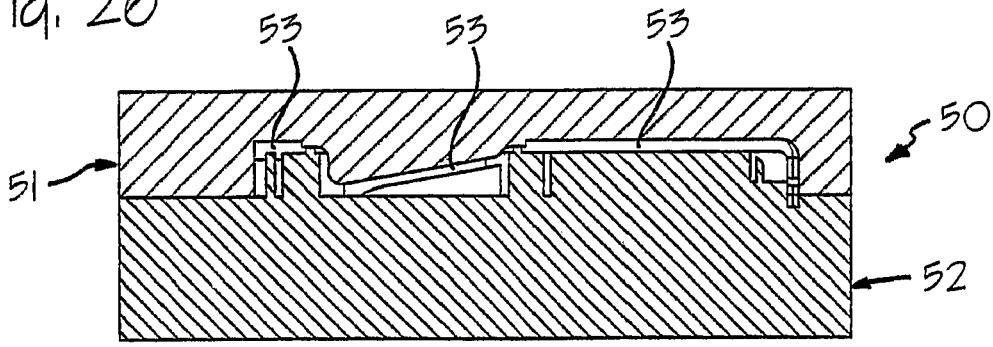
FIGS. 26 and 27 are two schematic cross-sectional views aimed at illustrating the principle of use of the apparatus of FIG. 25.

With reference to FIGS. 25-34, there will now be described a possible mode of production of the door 4 in accordance with the second embodiment of the invention, i.e., the one illustrated in FIGS. 14 to 24. In FIG. 25 there is represented schematically an apparatus, designated as a whole by 50, used for moulding thermoplastic material for the purposes of forming the rigid body 4*a* of the door. As has been said, the material used for the purpose can be polypropylene, or polyamide, or any other material designed for the purpose. In the case exemplified, the moulding apparatus or mould 50 comprises two parts, at least one of which is movable, which are designated by 51 and 52 and are designed to assume, with modalities in themselves known, at least two respective reciprocal positions, namely, a working, or closed, position and an open position. According to the known art, the parts 51 and 52 have respective impressions 51 a and 52*a*, shaped for defining an as a whole common cavity within the mould 50, when they are closed with respect to one another in the working position. Said cavity, designated by 53 in the cross-sectional view of FIG. 26, is provided for receiving the thermoplastic material designed to make the body 4*a* of the door 4 and is as a whole shaped so as to be able to define the shape of said component, as represented in FIGS. 14-16.

Figure 27:
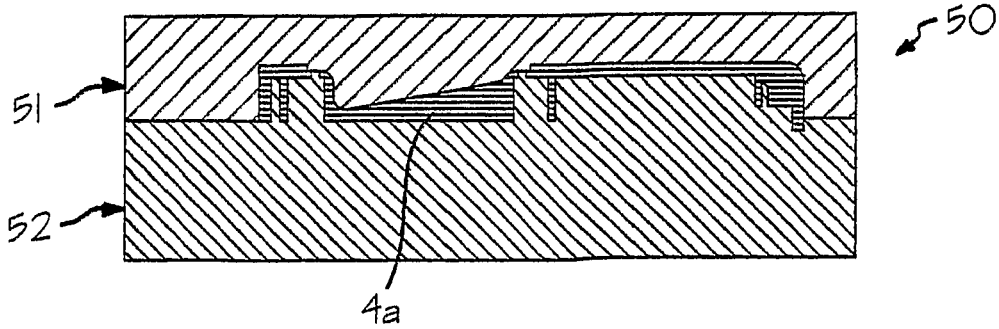
Figure 28:
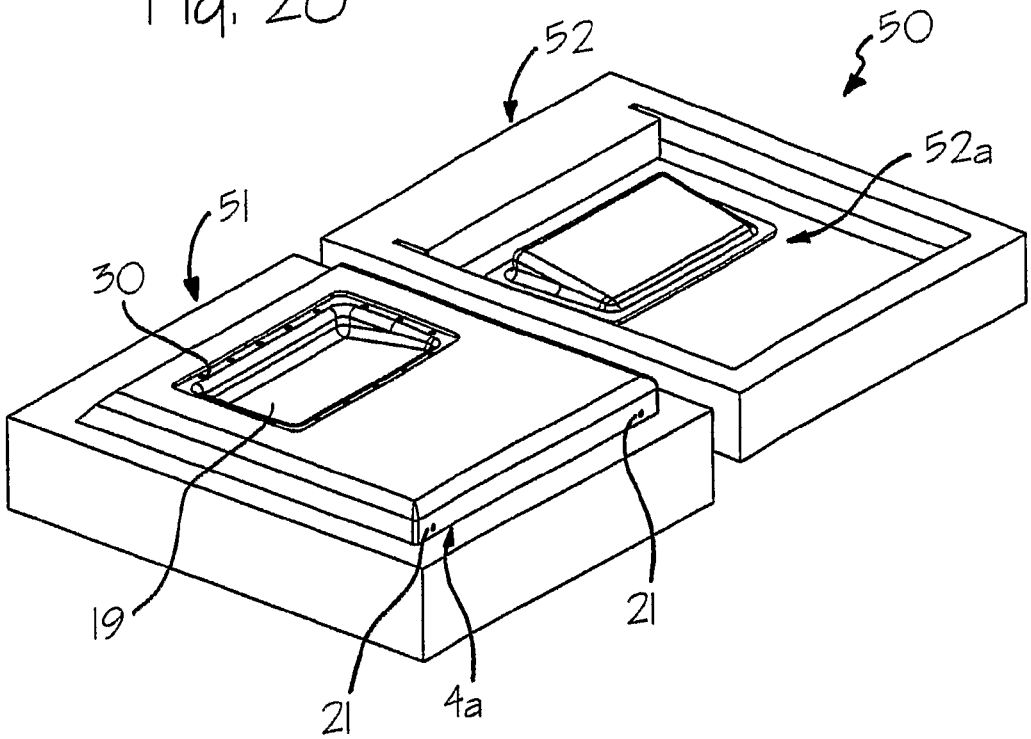
FIGS. 28 and 29 are two perspective views of the apparatus of FIG. 25, in two different conditions.
Figure 29:
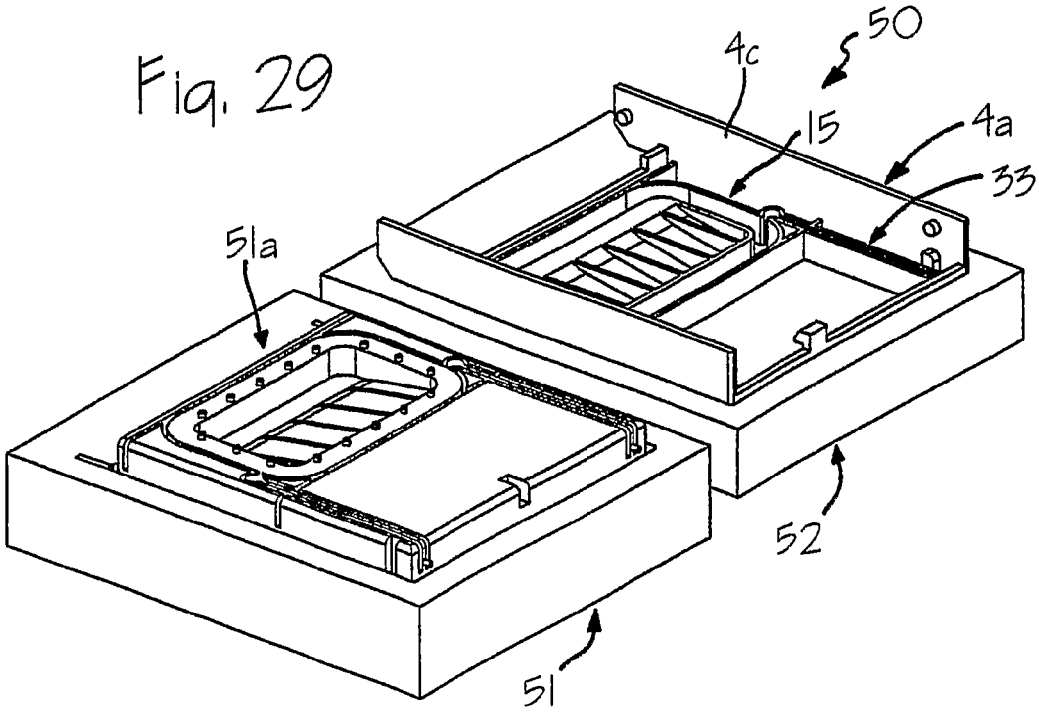
Figure 30:
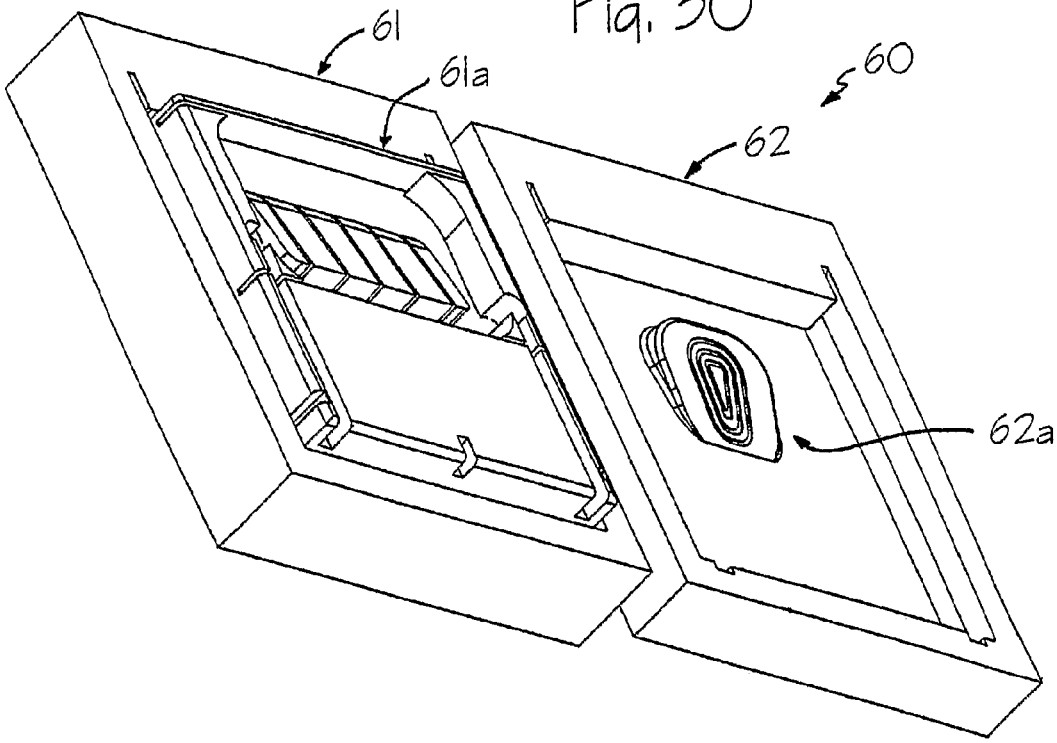
FIG. 30 is a perspective view of a moulding apparatus, used for the purposes of producing the door of FIGS. 22-24.

FIG. 26 represents the working position of the mould 50, in which the movable parts 51 and 52 are in their respective closed condition. Said movable parts are pushed into and held in said position via respective forces, generated with means in themselves known, such as to counteract the pressure of the flow of the molten thermoplastic material designed to form the body 4*a*. Said molten material is injected within the cavity 53 via a suitable injection channel (not visible but of a conception in itself known). A possible moulding sequence for obtaining the body 4*a* of the door 4, could comprise the following steps:

i) approach of the movable parts 51 and 52, under the thrust of respective forces, up to a predetermined position;

ii) closing of the movable parts 51 and 52, under the thrust of the respective forces, with which a portion of the part 51 bears upon a respective contrast surface of the part 52, or vice versa, as may be seen in FIG. 26;

iii) introduction of the molten thermoplastic material into the injection duct of the mould 50, which is in direct communication with the cavity 53, up to filling of the latter; said condition is visible in FIG. 27;

iv) waiting for enabling cooling and consequent solidification of the thermoplastic material, which thus provides the body 4*a* of the door;

v) opening of the parts 51 and 52 of the mould 50, which are moved away from one another via respective tensile forces, obtained with modalities in themselves known; for the purpose, by way of example, FIGS. 28 and 29 illustrate the mould 50 with the two parts 51 and 52 separated from one another, respectively in the case where the item obtained, i.e., the body 4*a*, is designed to remain on the part 51 or on the part 52; and vii) extraction of the body 4*a* from the part 51 (in the case of FIG. 28) or from the part 52 (in the case of FIG. 29).

Following upon said extraction, as has been said, the body 4*a* is formed with the structure previously illustrated and described with reference to FIGS. 14-16, and hence provided with the seats 15, 19 and 33, as well as with the holes 21 and 30. Next, overmoulded on said semifinished product is the soft material, for example an elastomer or other synthetic material, designed to form the single body 40 of FIGS. 17-21, which preferably integrates at least the gasket 16, the gripping element 17, and the attenuation elements 18.

Figure 31:
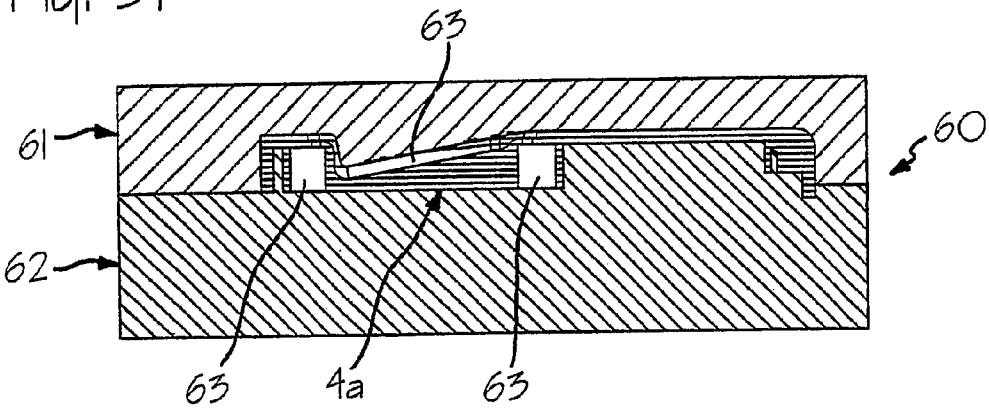
FIGS. 31 and 32 are two schematic cross-sectional views aimed at illustrating the principle of use of the apparatus of FIG. 30.
Figure 32:
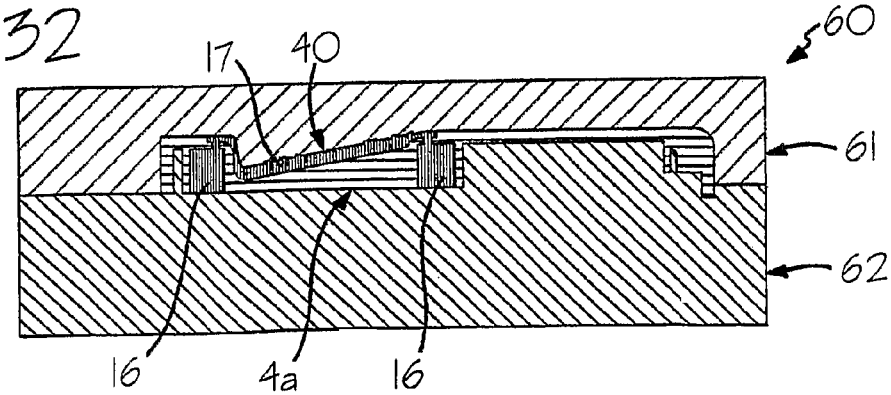

FIGS. 30-34 represent schematically an apparatus or mould 60 used for overmoulding, on the body 4*a*, the soft material designed to constitute the single body 40. Also the mould 60 comprises two parts, designated by 61 and 62, at least one of which is movable so as to assume at least two respective positions, i.e., a working, or closed, position and an open position, according to modalities in themselves known. The parts 61 and 62 have respective impressions 61*a* and 62*a*, shaped for delimiting as a whole a main cavity within the mould 60, when they are closed with respect to one another in the working position, it being possible for the body 4*a* to be housed in said main cavity, and thus in effect form a common cavity, obtained by the difference between the respective volumes (i.e., by the space of the main cavity not occupied by the body 4*a*). Said common cavity, designated by 63 in FIG. 31, is designed to receive the thermoplastic material that is to form the single body 40, defining its respective external shape. FIG. 31 represents the working position of the mould 60, in which the parts 61 and 62 are in the respective closed condition. Said parts 61 and 62 are pushed into and held in said position via respective forces, such as to counteract the pressure of the flow of the molten material designed to form the single body 40. Said molten material is injected within the cavity 63 through a suitable injection channel, not visible but of a conception in itself known. A possible moulding sequence, for the purposes of obtaining the door 4, could comprise, for example, the following steps:

i) inserting the body 4*a* into a respective part of mould, for example the part 62;

ii) closing the movable part 61, with which the latter is brought substantially to mate with the part 62, under the thrust of respective forces, as may be seen in FIG. 31;

iii) introducing the elastomeric or silicone material into an injection duct of the mould 60, which is in direct communication with the cavity 63, up to filling of the latter, as may be seen in FIG. 32;

iv) waiting to enable cooling and consequent solidification of the soft material, which thus provides the single body 40 for the door;

v) opening the parts 61 and 62 of the mould 60, which are moved away from one another via respective tensile forces, obtained with modalities in themselves known; by way of example, FIGS. 33 and 34 illustrate the mould 60 with the two parts 61 and 62 separated from one another, respectively in the cases where the item obtained, i.e., the door 4, is designed to remain on the part 61 or else on the part 62; and vii) extracting the door 4 from the part 61 (in the case of FIG. 33) or from the part 62 (in the case of FIG. 34).

In the embodiments described previously, the door 4 is of the type that can slide linearly with respect to the body 2 of the dispenser 1, but the invention can be applied also to the case of dispensers with a door that can be tilted or is angularly movable. One such embodiment is illustrated in FIGS. 35-44. In said Figures the same reference numbers as those of the previous figures are used to designate elements that are technically equivalent to the ones already described, and the numbers designating details that correspond specifically to the invention are distinguished by the indices 'and/or".

Figure 35:
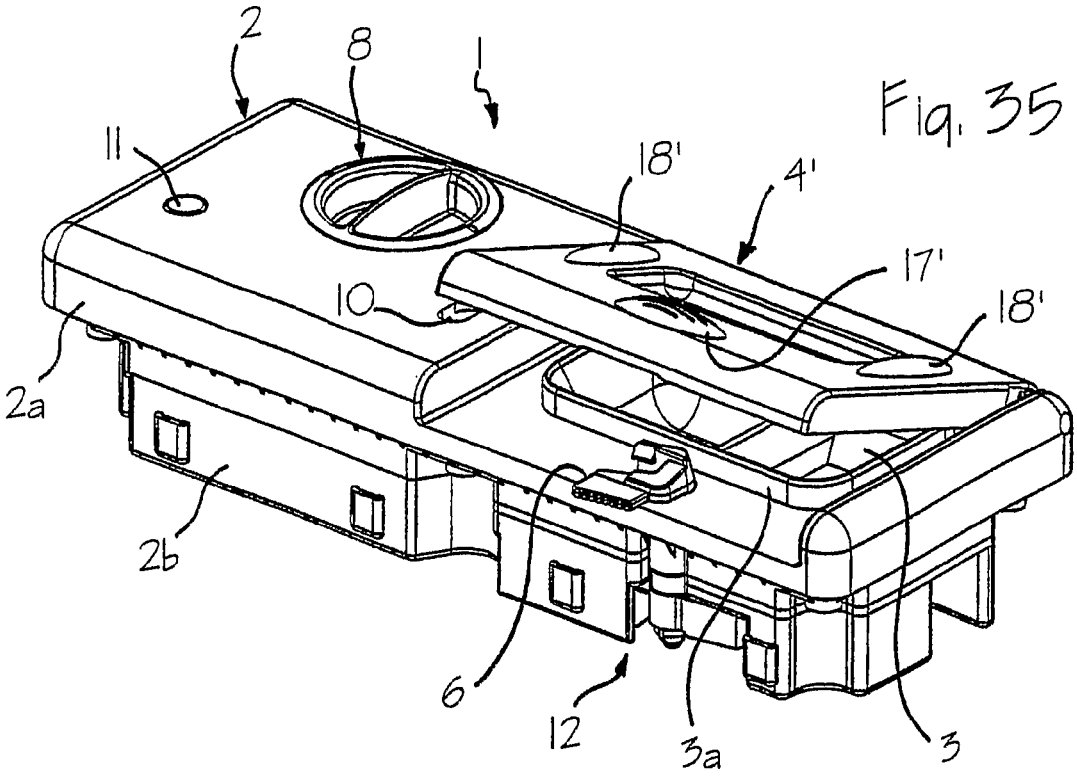
FIG. 35 is a perspective view of a dispenser in accordance with a third embodiment of the invention.
Figure 36:
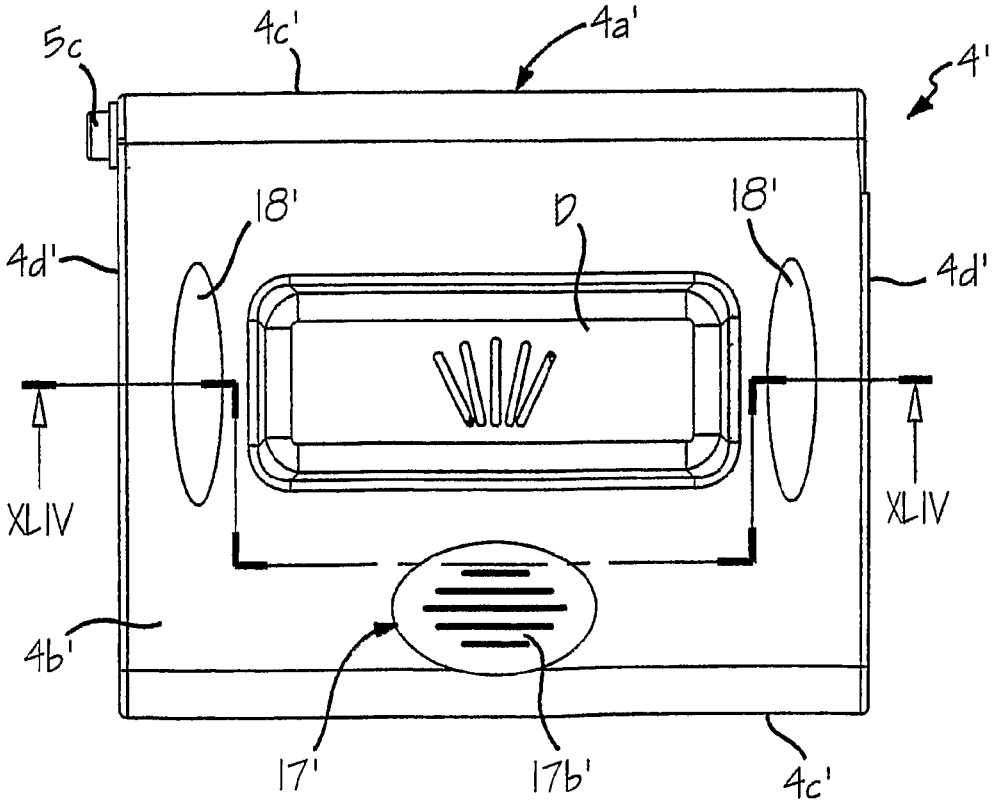
FIGS. 36, 37 and 38 are, respectively, a plan view, a perspective view and a front view of a door of the dispenser of FIG. 35.
Figure 37:
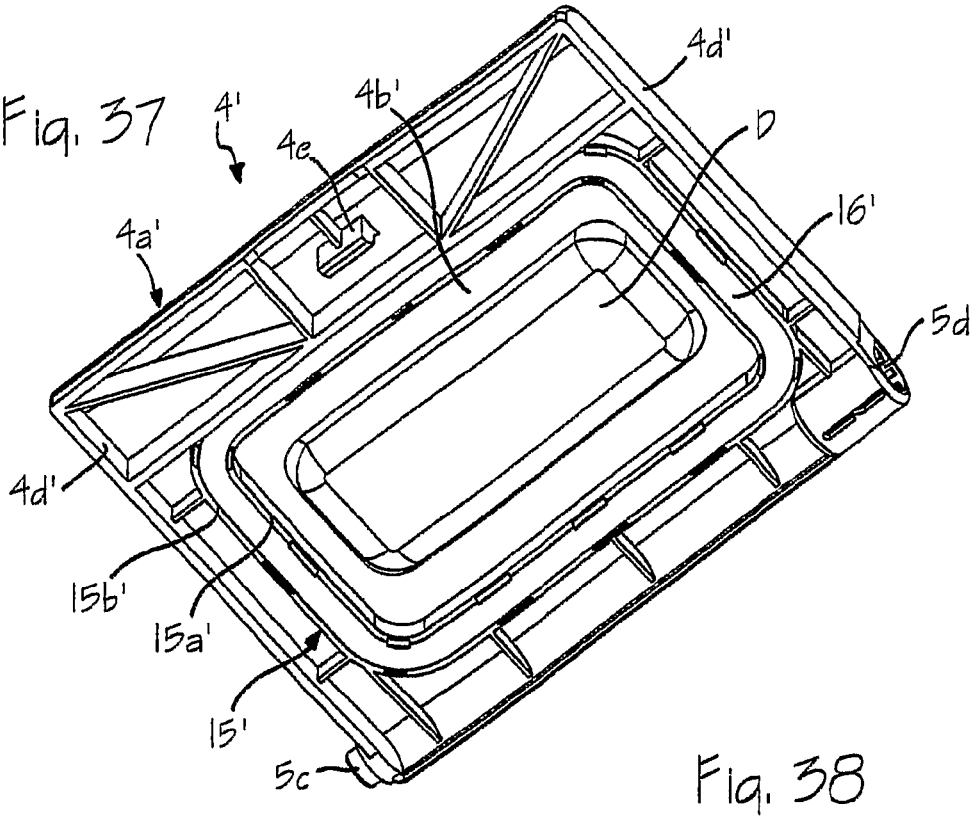
Figure 38:
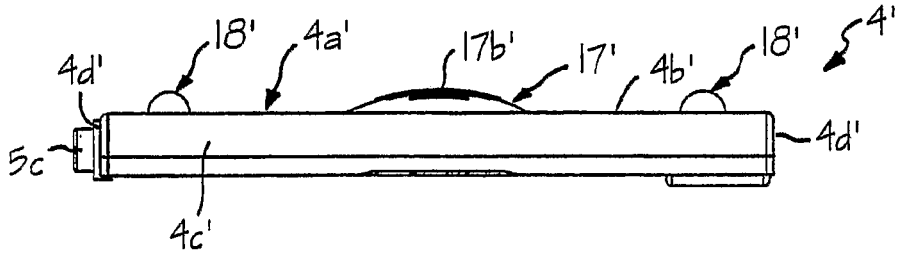

FIG. 35 represents a dispenser 1 of the type with a door that can be tilted, i.e., a door mounted on the body 2 of the dispenser so as to be able to move angularly between a closed position, in which the respective compartment 3; for the detergent is closed, and an open position, in which the compartment 3 is open. The dispenser 1 is of a substantially known general structure, with the exception of its door or member for closing the compartment 3, designated as a whole by 4', made according to the invention. In FIGS. 36-38 the door 4' is represented with various views. Also in this embodiment, the door 4' has a rigid base body 4*a'*, made of moulded thermoplastic material, for example polypropylene, with a main wall or bottom wall 4*b'*, from the edges of which there branch off orthogonally side walls 4*c'* and 4*d'*. The two smaller side walls 4*d'* of the body 4*a'* have a projecting pin 5*c* and the other a seat Sd, which are designed to co-operate, respectively, with a seat and with a pin formed or inserted in the body 2 of the dispenser 1 so as to enable angular movement of the door 4'. Also in this case, a spring is provided (not visible in the figures), which is operative for exerting a load on the door 4' in its respective open position (said spring can, for example, be mounted on the pin 5*c*, in a known way). As may be seen in FIG. 37, in the part of the wall 4*b*' designed to face the compartment 3 a housing seat 15' is present, for a sealing gasket, designated as a whole by 16', made for example of silicone rubber. Also in this embodiment, the seat 15' is basically formed by two walls 15*a*', 15*b*' having a closed profile, which are concentric with respect to one another. Associated to the body 4*a*' of the door 4' are also additional complements or elements made of elastic or soft material, for example, silicone rubber, designated by 17' and 18' in FIGS. 36 and 38. Also in this case, the element 17' constitutes principally a gripping means or grip, provided with surface corrugations or reliefs 17*b*', aimed at facilitating gripping or adhesion, or friction, of the finger of a user on the door 4', when the latter must be closed manually. The elements 18' constitute on the other hand attenuation means, aimed at buffering the impact due to an end-of-travel position of opening of the door 4' being reached and at reducing the noise of operation of the dispenser 1. It is to be noted, on the other hand, that the similar functions of end-of-travel damper are performed also by the gripping element 17', the latter having preferably a profile in relief or a projecting profile so as to enable two distinct functions to be performed.

It should be recalled that, in known dispensers, the end of travel of the movement of angular opening of the door is determined by the impact of the latter with a wall or a body present within the washing tank of the machine. In the majority of cases, the door is devised for performing a travel of opening of approximately 180°, which terminates when the door itself comes into contact with the surface of the inner door panel on which the dispenser is mounted. In other cases, the end of travel is, instead, determined by the contact of the door with a portion of one of the dish racks present in the washing tub. The impact thus determined between the door and the inner door panel or the dish rack is such as to produce both a certain amount of noise and a certain amount of vibration of the entire device, due to the impact between two substantially rigid materials. In the embodiment in question, the gripping element 17' and the attenuation elements 18' are conceived for projecting at the front from the same wall 4*b*' of the body 4*a*', as clearly visible in FIG. 38, and are arranged in different areas of said wall 4*b* in order to be able to come into contact with the inner door panel or with a possible dish rack. The location of the elements 17' and 18' can be chosen in a manufacturing step according to the type of washing machine on which the dispenser 1 is to be mounted. In this embodiment, hence, both the gripping element 17' and the attenuation elements 18 constitute damped end-of-travel means for the door 4', which enable prevention of direct impact between two substantially rigid materials (the body 4*a*' of the door and the inner door panel or the rack). The fact that the material constituting the elements 17' and 18' is elastic enables any sharp impact between the parts to be prevented, with consequent elimination of the vibrations of operation and of noises during opening.

Figure 39:
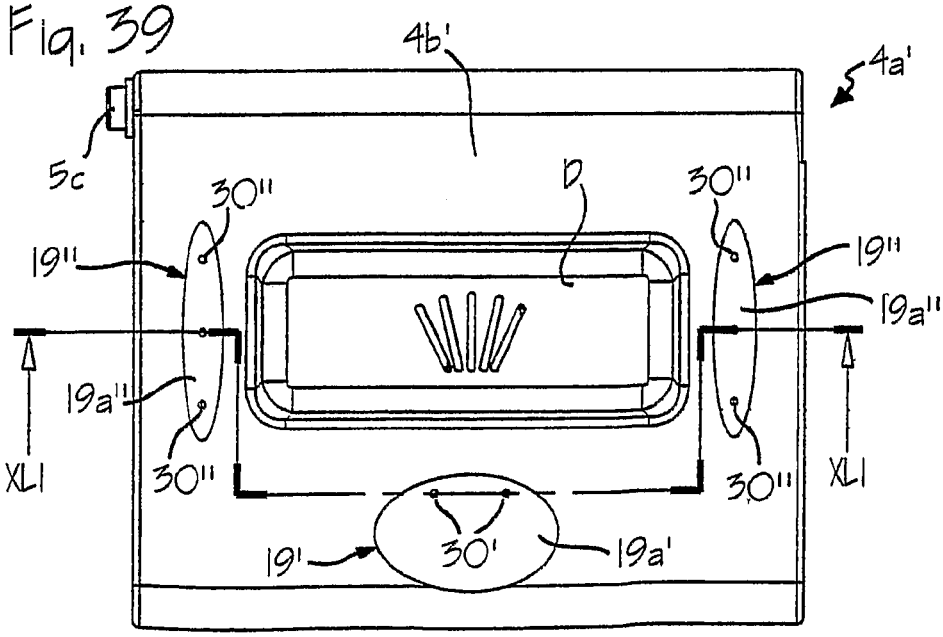
Figure 50:
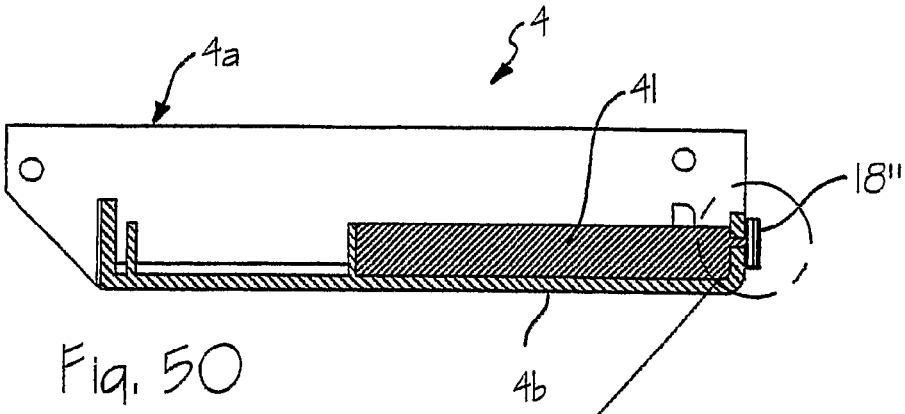
FIG. 50 is a cross-sectional view taken according to the line XL-XL of FIG. 48, at a larger scale.
Figure 51:
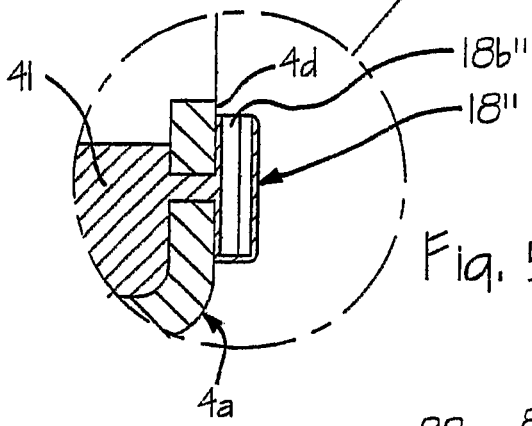
FIG. 51 is an enlarged detail of FIG. 50.

FIGS. 39-41 represent just the body 4*a*' of the door 4'. As may be noted in FIG. 39, the wall 4*b*' of the body 4*a*' has a central depression, designated by D, the end of which projects as far as within the space delimited by the seat 15' for the gasket 16' (see FIG. 40). The wall 4*b*' has at the top also a front seat 19', for housing the gripping element 17', and two side seats 19", for housing the attenuation elements 18'. In the case exemplified, the seats 19' and 19" have substantially elliptical cross sections, the seat 19' being of dimensions slightly larger than the seats 19". The seat 19' is set in the proximity of the edge of the wall 4*a*' opposite to the area of hinging of the door, in which the pin 5*c* and the seat 5*d* are present, whilst the seats 19" extend at the sides of the central depression D. As may be seen in FIG. 39, a series of holes 30' is formed in the end 19*a*' of the seat 19' and a series of holes 30" is formed in the end 19*a*' of the seats 19". As may be seen then in FIGS. 40 and 41, the aforesaid holes 30' and 30" terminate, on the opposite side of the body 4*a*', in the bottom of the seat 15' that includes the internal wall 15*a*' and the external wall 15*b*'. Via the holes 30' and 3", the seat 15' is thus connected both to the front seat 19' and to the side seats 19", respectively. Thanks to said solution, also the door 4' according to the third embodiment can be provided with a respective gasket 16', with a gripping element 17', and with at least two attenuation elements 18' made of a single body, which can be obtained via a single operation of overmoulding of elastic or soft material on the body 4*a*'.

FIGS. 42 and 43 represent, for reasons of greater clarity, just the single body made of elastic material, designated as a whole by 40', that can be obtained via the aforesaid overmoulding operation. As may be noted, also in this case, in the single body 40' the respective parts that make up the gasket 16', the gripping element 17', and the attenuation elements 18' may be identified. The attenuation elements 18' are connected to the gasket 16' via first body portions, designated by 41' in FIG. 43 and 44, which are substantially cylindrical in so far as they are formed by the overmoulding material that has filled the holes 30" of FIGS. 39-41. On the other hand, also the gripping element 17' is connected to the gasket 16' via second stretches of body 42', which are substantially cylindrical (also visible in FIG. 44) and are formed by the overmoulding material that has filled the holes 30' of FIGS. 39-41. Provision of the single body 40' enables at least two elements to be obtained, which are in themselves functionally distinct, are fixed to one another and located at two opposite ends or sides of the body 4", with the same advantages already explained previously, in terms of maintenance of the correct working position of the gasket 16' and of the elements 17' and 18', and in terms of reduction of the manufacturing steps, and hence of the times and costs. The process for manufacturing the door as described in FIGS. 35-44 can be obtained with modalities substantially similar to the ones previously exemplified with reference to FIGS. 25-34, using appropriate apparatuses for moulding the rigid body 4*a*' and for overmoulding the elastic body 40'.

FIGS. 45-51 illustrate a possible variant of the invention, based substantially upon the embodiment described previously with reference to FIGS. 14-24. Also in said variant, the door 4 hence comprises a rigid body 4*a*, substantially similar to that of FIGS. 14-16, associated to which there is a single body made of elastic material, conceptually similar to the one previously designated by 40, which integrates both a gripping element 17" and two attenuation elements 18", as well as a sealing gasket 16". In this variant, the gripping element 17" defines a respective cavity 17*a*", which is wider than that of the previous embodiments and is without surface corrugations. The attenuation elements 18" are, instead, structured in such a way as to increase their elastic and/or attenuation capacities. For this purpose, in the case exemplified, the attenuation elements 18" have basically a semi-cylindrical cross section, so that inside them a cavity 18*b*" is formed, visible in particular in the details illustrated in FIGS. 47 and 51. The presence of said cavity 18*b*" enables variation of the elasticity of the element 18" irrespective of the elasticity of the elastomeric material, thus improving the characteristics of damping with respect to the case of attenuation elements with full body of the previous embodiments. It should be noted that, in order to obtain said effect of increased elasticity, the body of the elements 18" could be shaped also in a way different from the one exemplified, presenting, for example, an active, or damping, part, which may have substantially the shape of a concertina, the shape of a spiral, a variable cross section, a number of projections set alongside one another, etc. On the other hand, the gasket 16" of the variant proposed has, basically, a completely closed exposed surface, instead of one having an annular shape. As may be seen particularly in FIGS. 46, 48 and 49, the gasket 16" comprises a substantially quadrangular base portion 16*a*", designed to be housed in the body 4*a* within the respective seat 15, and an external portion 16*b*", which forms substantially a continuous and plane wall, preferably without holes, designed to face the inside of the compartment 3 (see, for example, FIG. 4). The gasket 16" thus structured enables a dual function to be fulfilled. In particular, the peripheral area of the wall 16*b*" performs the classic functions of sealing with respect to the edge 3*a* of the compartment 3 (see, for example, FIG. 4), for the purpose of isolating at least partially the inside of the latter with respect to the external environment, when the door 4 is closed. On the other hand, the closed central area of the wall 16*b*" performs basically the functions of the ribbings 15*c* illustrated in FIGS. 6 and 16, i.e., creating a flat area designed to prevent any jamming of the movement of the door 4, when a tablet of detergent is inserted in the compartment 3. It will be appreciated that also the process for manufacturing the door illustrated in FIGS. 45-51 can be obtained with modalities substantially similar to the ones previously exemplified with reference to FIGS. 25-34.

The invention has been described previously with reference both to a linearly sliding door and to an angularly mobile door, but it may be applied also to members for closing a dispenser of washing agents of a different type, and in particular to a filler cap for closing the reservoir for the rinse aid, of the type designated previously by 8. Such an embodiment of the invention is illustrated in FIGS. 52-57, according to which the filler cap 8, in addition to being equipped with respective sealing means, is also equipped with at least one additional elastic, soft or rubbery, element provided for facilitating the manual operations of opening and/or closing of the filler cap itself.

Figure 52:
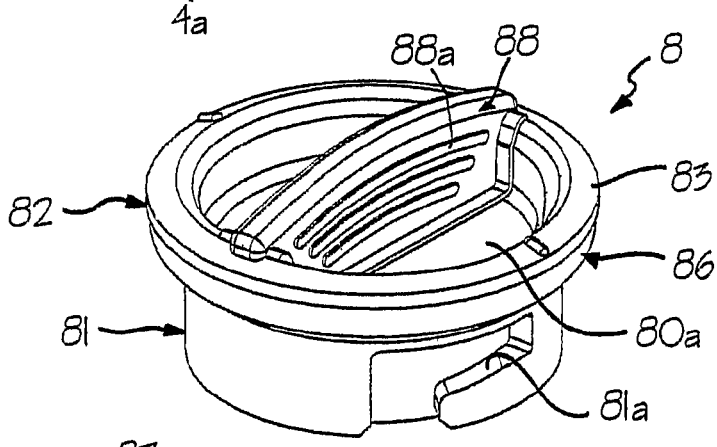
FIG. 52 is a perspective view of a filler cap of a reservoir for a liquid washing agent of a dispenser according to the invention.
Figure 53:
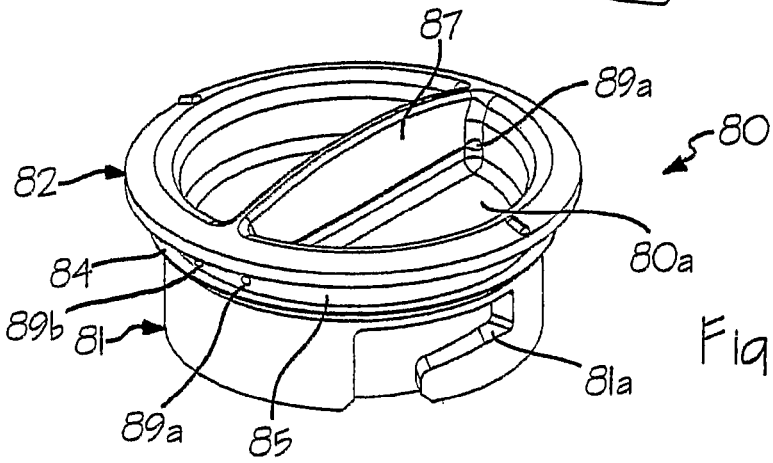
FIGS. 53 and 54 are perspective views, from different angles, of a rigid body of the filler cap of FIG. 52.
Figure 54:
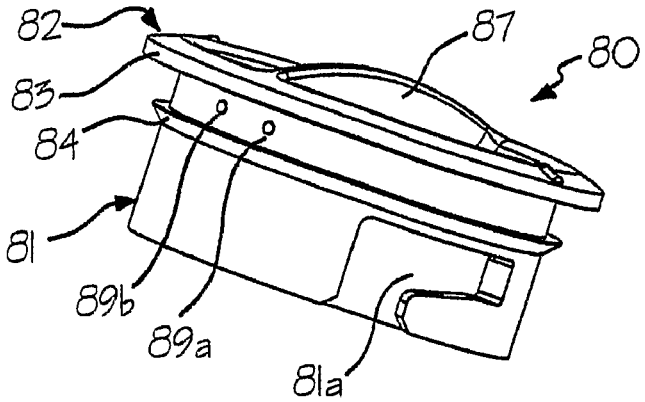

In FIG. 52 the filler cap 8 is represented as a whole, whilst in FIGS. 53 and 54 just the rigid body of the filler cap is represented, designated as a whole by 80, which is made, for example, of polypropylene or polyamide. The body 80 has an overall hollow cylindrical shape and is divided by a horizontal wall 80*a* into a lower portion 81 and a top, substantially cup-shaped, portion 82. A flange part, designated by 83 projects outwards from the edge of the cylindrical wall that forms the top portion 82. The lower portion 81 is provided with means 81*a* for coupling to the opening 9 (see, for example, FIG. 4) for access to the reservoir containing the rinsing agent. In the case exemplified, said coupling means are of the bayonet-coupling type, but it is clear that the filler cap 8 can be fixed in a removable way on the opening 9 in different ways, for example, with a coupling of the external screw/internal screw type. The flange 83, together with an intermediate peripheral relief 84 of the cylindrical portion 81, forms a seat 85 for an annular sealing gasket, designated by 86, made, for example, of silicone rubber. The gasket 86 is designed to provide sealing between the body 80 and a respective contrast surface, designated by 9*a* in FIG. 4, formed within the opening 9. The cavity of the top cup-shaped portion 82 is traversed diametrally by a wall designated by 87 in FIGS. 53 and 54. As may be noted, the diametral wall 87 divides the cavity inside the cup-shaped portion 82 into two semi-cylindrical halves.

According to the invention, the wall 87 is provided with an at least partial coating made of elastic and soft material, which constitutes a gripping element, designated by 88 in FIGS. 52 and 55-57, which is aimed at facilitating gripping of a number of fingers of a user on the filler cap 8, when the latter is to be moved angularly for its fixing to, or its removal from, the opening 9. Preferably, the gripping element 88 is provided with surface corrugations 88*a*, for the purpose of increasing friction with the user's fingers. In the preferred embodiment, the body 80 envisages, within the seat 85 for the gasket 86, at least two pairs of through holes 89*a* and 89*b*, substantially parallel to one another, each pair of holes being formed in the proximity of a respective end of the diametral wall 87. Preferably, the two holes 89*a* and 89*b* of each pair are in communication each with a respective semi-cylindrical half of the cavity inside the top cup-shaped portion 82. Thanks to said solution, the filler cap 8 can be provided with a respective gasket 86 and with a gripping element 88 made of a single body, which can be obtained with a single operation of overmoulding of elastic or soft material on the body 80.

Figure 55:
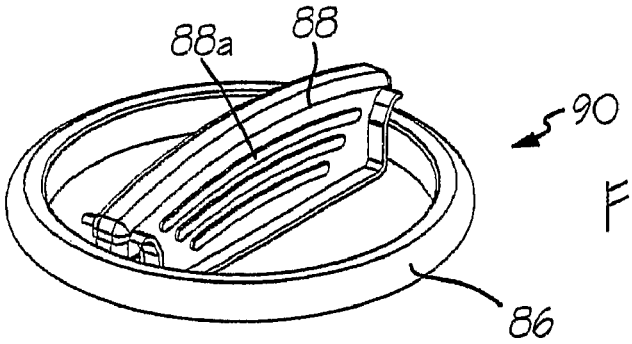
FIG. 55 is a perspective view of a body made of elastic or soft material, which in use is integrated to the rigid body of FIGS. 53 and 54.
Figure 56:
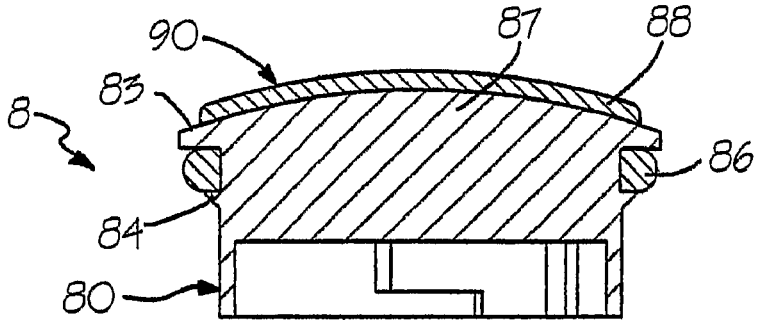
FIGS. 56 and 57 are two cross-sectional views taken along respective mutually parallel vertical planes of the filler cap of FIG. 52.
Figure 57:
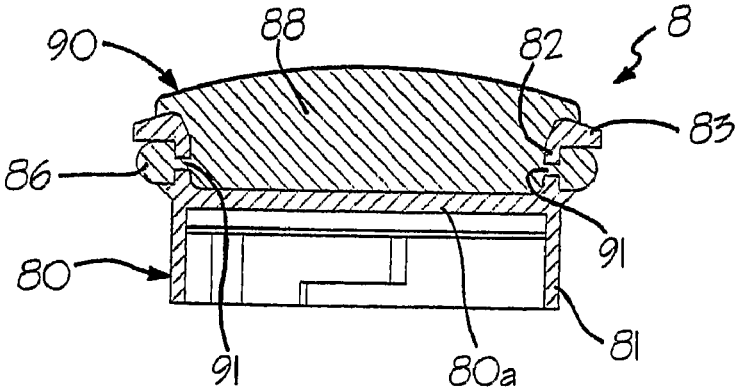

FIG. 55 represents, for reasons of greater clarity, just the single body made of elastic material obtainable via the aforesaid overmoulding operation, designated as a whole by 90. As may be noted, in the single body 90 the respective parts that make up the gasket 86 and the gripping element 88 may be identified. From FIG. 56, which is a cross-sectional view taken according to a vertical plane that traverses longitudinally the diametral wall 57, it may be noted how, following upon overmoulding, the top portion 82 of the body is provided with the gripping element 88, whilst the gasket 86 is positioned in the seat formed between the flange 83 and the relief 85. From FIG. 57, which is a cross-sectional view taken according to a vertical plane parallel to that of the cross-sectional view of FIG. 56 and not traversing the wall 87, it may be noted how the gripping element 88 is connected to the gasket 86 via substantially cylindrical body portions 91, formed by the overmoulding material that has filled the holes 89*a* and 89*b* of FIGS. 53-54. As may be appreciated, peripheral stretches of the overmoulding material extend also on the transverse wall 80. Also in this embodiment provision of the single body 90 always guarantees maintenance of the correct working position by the gasket 86 and the gripping element 88. It will be appreciated that the process for manufacturing the filler cap 8 illustrated in FIGS. 52-57 can be carried out according to a method that is conceptually similar to the one previously exemplified with reference to FIGS. 25-34, using appropriate apparatuses for moulding of the rigid body 80 and for overmoulding of the elastic body 90.

Figure 58:
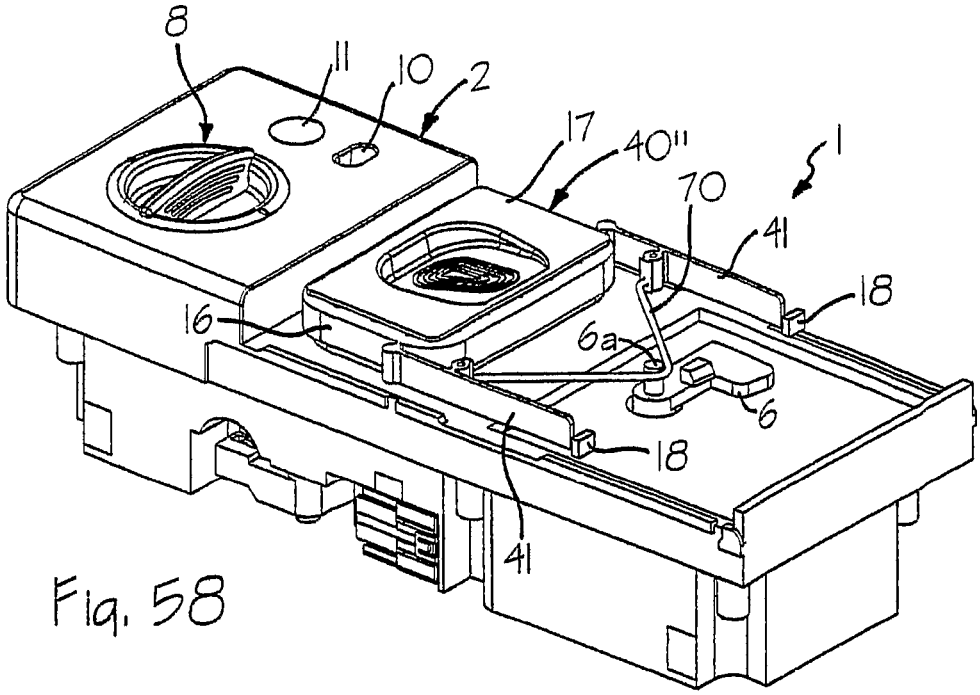
FIG. 58 is a partial exploded view of a dispenser made according to a variant of the invention, in which the rigid body of a door of the dispenser itself has been omitted.

The aforesaid single body 40, 40' made of elastic material, i.e., said overmoulded body, could integrate, either in addition or alternatively to one or more of the means mentioned above, also further and different functional elements of the dispenser 1. Such a variant is represented schematically in FIG. 58 where, for reasons of greater clarity, the rigid body of the door 4 has been omitted. As may be noted, in said embodiment a single body made of elastic material, designated by 40", is envisaged, which integrates both the gasket 16 and the gripping element 17, as well as the attenuation elements 18. In the case exemplified, the single body 40" further integrates an element or portion 70, here having a substantially filiform shape, which connects the body portions 41 together so as to provide a sort of elastic element or spring. Furthermore, in this variant, the lever 6 comprises a top projection 6*a*, which constitutes a point of constraint for an intermediate area of the aforesaid filiform portion 70. In said embodiment, the filiform portion 70 constitutes to all effects an elastic element that is operative for loading the door 4 in the direction of the open position, instead of the spring 6 of FIG. 4. Obviously, the filiform portion 70 could have a different shape and/or be constrained to a projection defined by the body 2, and more precisely by its top piece 2*a*, instead of the body of the lever 6.

Figure 59:
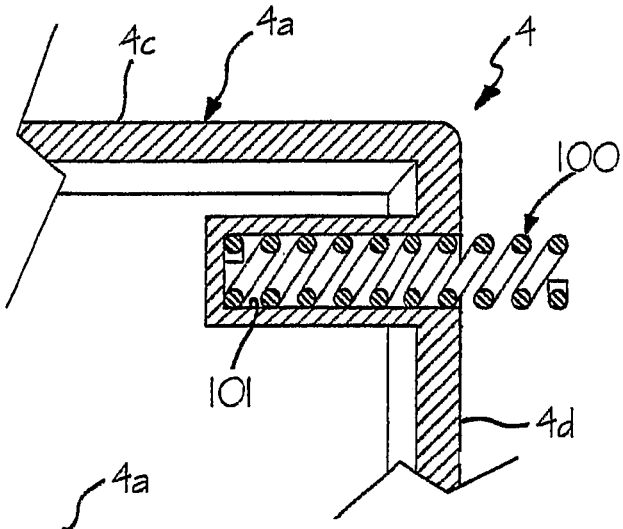
FIG. 59 is a cross-sectional view of a portion of the door of a dispenser of agents built according to another variant of the invention.
Figure 60:
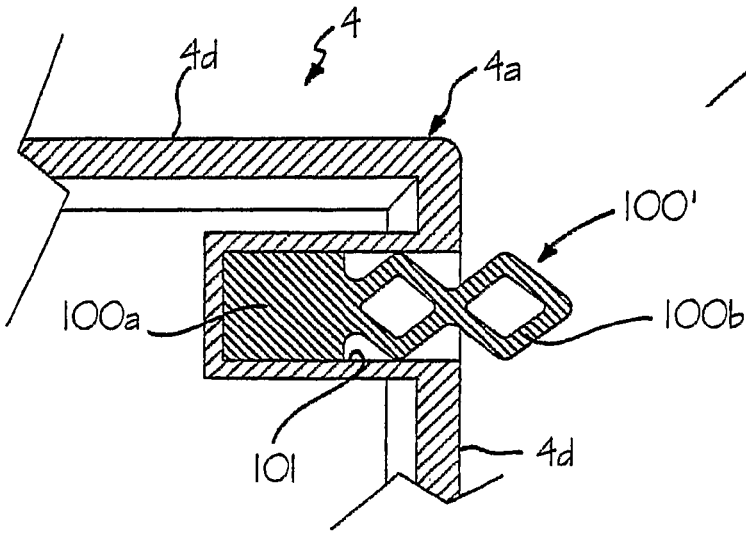
FIG. 60 is a cross-sectional view of a portion of the door of a dispenser of agents built according to another variant of the invention.

Represented in FIGS. 59 and 60, merely by way of example, are some possible alternative embodiments of the attenuation means. The attenuation means visible in FIG. 59, designated by 100, is constituted by a helical spring, for example made of metal material. In this embodiment, a first portion of each attenuation element 100 envisaged is housed in a respective seat 101 formed in the rigid body 4*a* of the door 4, said seat 101 replacing the hole 21 of the previous embodiments. A second portion of each attenuation element 100 projects, instead, on the outside of the aforesaid seat 101, and hence from the body 4*a*, so as to provide also in this case a damped means of arrest or means of end of travel against the wall 2*a*' of the body 2 (see, for example, FIG. 4). The variant illustrated in FIG. 60 is conceptually similar to the previous one, as regards location of the components, but in this case the attenuation element, designated by 100', is made of elastic material, such as silicone rubber or other elastomer, and is configured as an insert having a substantially massive or full part 100*a*, designed to be housed within the seat 101, and a part with variable geometry and/or at least locally hollow, designated by 100*b*, more conveniently deformable in an elastic way and at least in part projecting from the respective seat 101. In the case exemplified, the portion 100*b* comprises a plurality of cavities and is substantially deformable in concertina fashion. One or more attenuation elements configured as the one designated by 100' could possibly be fixed to and/or made of a single piece with the gripping element of the respective door, in particular via overmoulding or co-moulding as described previously.

Figure 61:
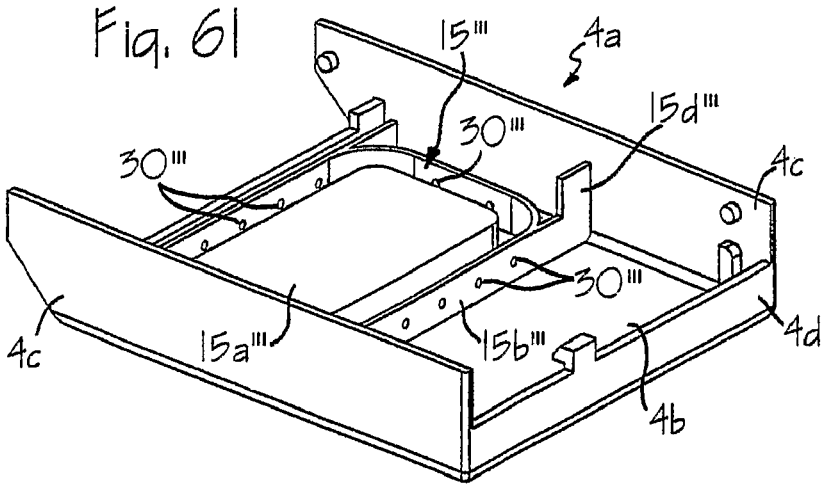
FIG. 61 is a perspective view of a rigid body of a sliding door of a dispenser built in accordance with a further variant of the invention.

In principle, there is nothing to rule out forming even just one of the sealing means, gripping means, and attenuation means by an overmoulding operation in which case anchorage in the working position of the overmoulded element (for example, the gasket) does not imply the latter being joined to another of the functional elements described (gripping element or attenuation elements). In accordance with said embodiment, formed, for said purpose, in the rigid body of the closing member, whether this is in the form of a door or of a filler cap, are suitably provided seats, channels or holes, designed to receive parts for anchorage of the elastic material that forms the overmoulded component, said parts being operative for withholding the component itself in position. Such a possibility is exemplified in FIGS. 61-63, where the same reference numbers used in the previous figures, are again used to designate elements that are technically equivalent to the ones already described. FIG. 61 represents just the rigid body 4*a* of a sliding door, of the type previously designated by 4. The body 4*a* has a seat 15'41 for the respective gasket, which is delimited externally by a wall 15*b*''' and internally by the peripheral surface of a closed portion 15*a*''' formed in the same body 4*a* (on the other hand, instead of said closed portion 15*a*''' there could be provided a wall of the type of the ones previously designated by 15*a* or 15*a*'). The external wall 15*b*''' of the seat 15''' has a series of holes, designated by 30''', which, also in the case of overmoulding of just the gasket, enable a suitable anchorage for the latter to be obtained. The door 4 provided with the overmoulded gasket, designated by 16''', is visible in FIG. 62. By virtue of the presence of the holes 30''', the gasket 16''' can be overmoulded so that parts of the soft or elastic material that constitute it form regions 16*c*''' located on the outside of the seat 15''' and in contact with the wall 15*b*''', but in any case connected to the main annular portion of the gasket itself. Said characteristic may be noted from FIG. 63, where parts of the overmoulding material that has filled the holes 30''' of FIG. 61 form substantially cylindrical portions 42'''. Said portions 42''' join locally the annular part of the gasket 16''', positioned in the respective seat 15''', to the anchorage regions 16*c*''' adjacent to respective areas of the wall 15*b*'''. As may be appreciated, in this way precise and secure positioning of the gasket 16''' within its seat 15''' is guaranteed. In the case of overmoulding of just the gasket, the gripping element and the attenuation elements can be of the type represented in FIGS. 9-12.

Figure 62:
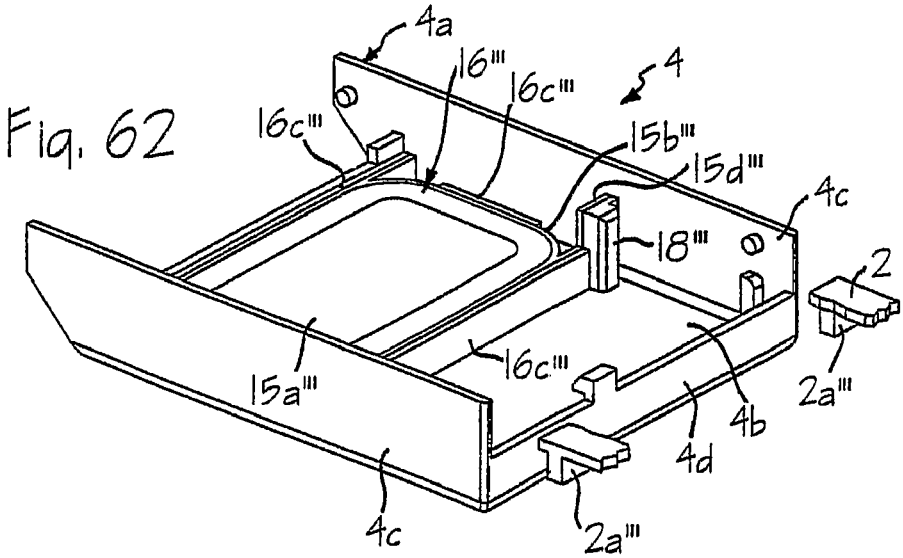
FIG. 62 is a perspective view of the door comprising the rigid body of FIG. 61.
Figure 63:
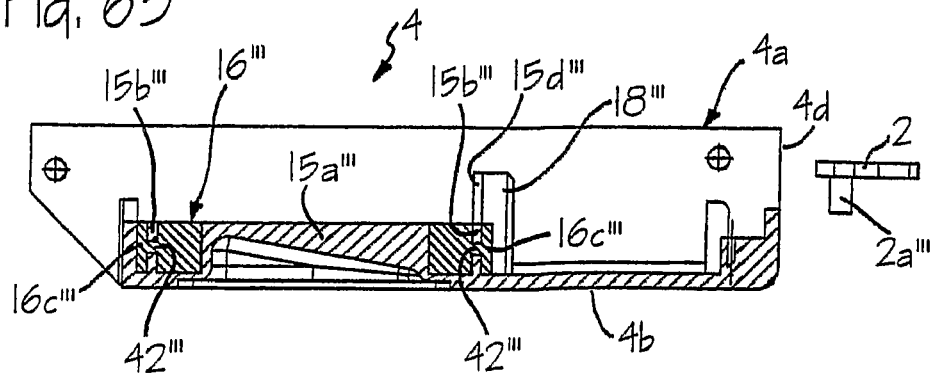
FIG. 63 is a longitudinal cross-sectional view of the door of FIG. 62.

On the other hand, also highlighted in FIGS. 61-63 is the possibility of providing the attenuation elements in an area covered by the door 4. For said purpose, in the case exemplified, the external wall 15*b*''' of the seat 15''' has two end portions in relief, set close to the side walls 4*c* of the body 4*a*; one of said portions is designated by 15*d*''' in FIG. 61. In this application, the apparatuses used for the moulding or overmoulding operation are conceived to cause part of the material constituting the regions 16*c*''' to form terminal stretches that coat also the surface of the portions 15*d*''' that faces the wall 2*d* of the body 4*a*, preferably with a larger thickness. Said terminal stretches in this way come to form attenuation elements, one of which is designated by 18''' in FIGS. 62 and 63. In this case, the elements 18''' are appropriately shaped and provided to co-operate with arrest appendages, represented only partially and designated by 2*a*''', which rise from the surface of the main body 2 of the dispenser facing the wall 4*a* of the door 4. The attenuation elements 18''' and the arrest appendages 2*a*''' thus constitute damped end-of-travel means for the movement of opening of the door.

In some of the embodiments previously exemplified, one or more additional elements of the closing member are overmoulded on the main body of the latter. Obviously, there is nothing to rule out obtaining a similar result or product with equivalent processes, as, for example, in the case of a main body overmoulded on the additional elements, i.e., with rigid material overmoulded on elastomeric material or else with processes of moulding of a number of materials simultaneously or with pre-defined sequences, said processes being comprised in the term "overmoulding", here adopted for practical reasons.

The rigid material and the elastic material can be of types that are compatible with one another in such a way that they will weld together and/or merge into one another in the contact area, in order to obtain reciprocal adhesion, bonding, or fixing. For this purpose, there could be advantageously envisaged the use of a polyamide or nylon (such as PA66) as rigid material, then overmoulded or co-moulded with a liquid silicone rubber (LSR). It should be noted that the overmoulding step can possibly be carried out using a suitable foamable or foamed material, with a process of the type described with reference to FIGS. 30-34.

Figure 64:
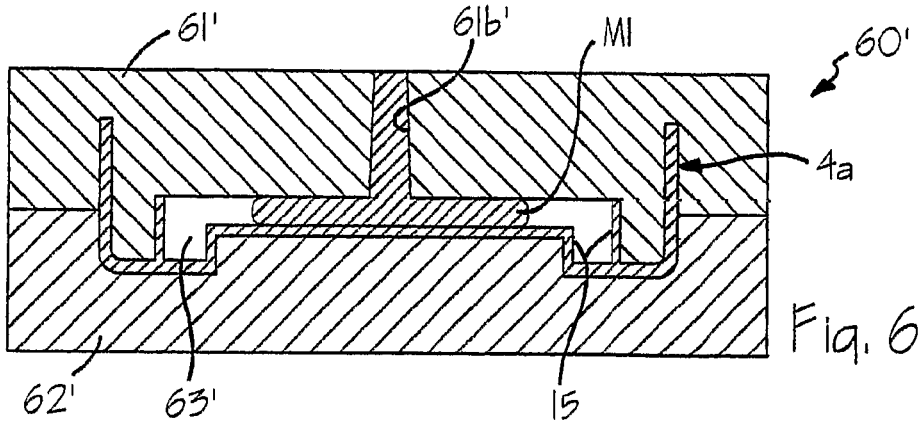
FIGS. 64-66 are schematic cross-sectional views aimed at illustrating a method of "sandwich" overmoulding that can be employed for the purposes of a possible embodiment of the invention.
Figure 65:
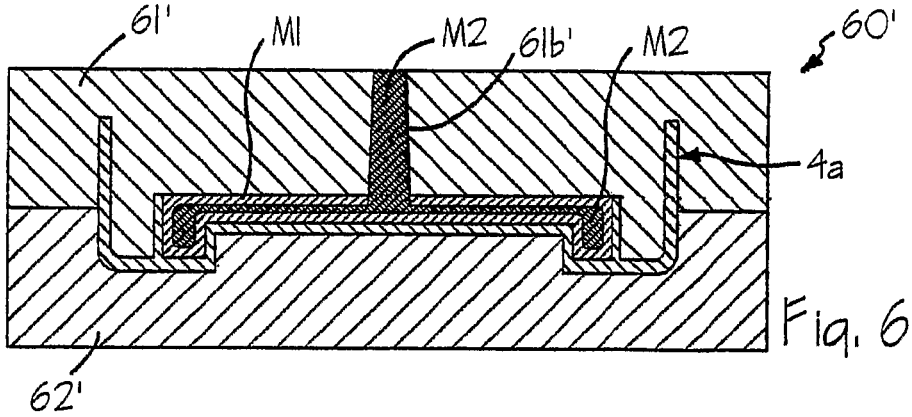
Figure 66:
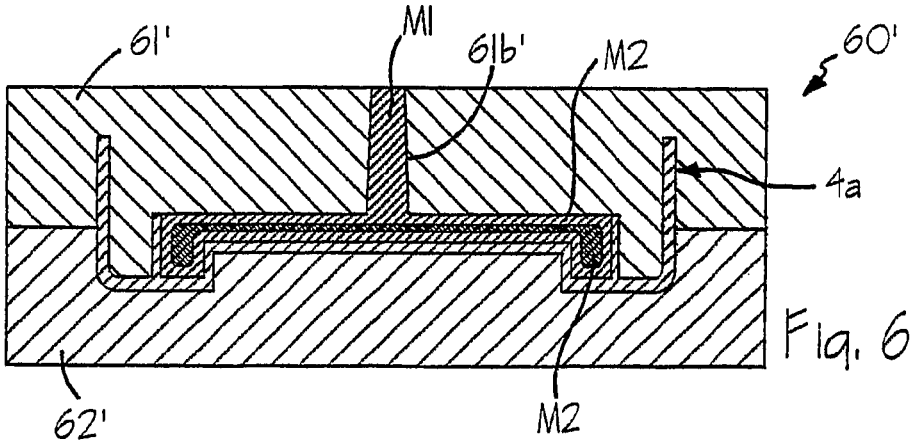
Figure 67:
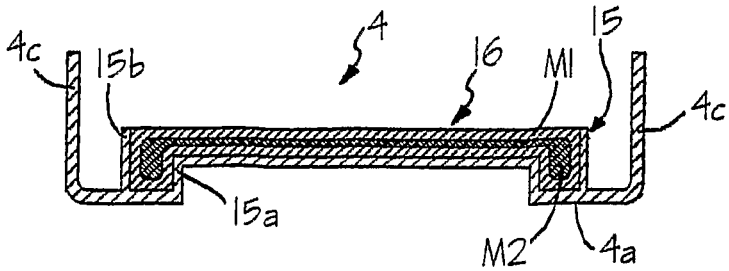
FIG. 67 is a schematic cross-sectional view of a door of a dispenser obtainable using the process of FIGS. 64-67.
Figure 74:
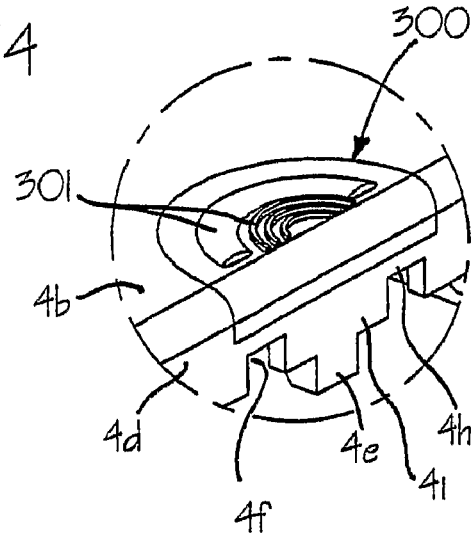
FIG. 74 is an enlarged detail of FIG. 73.

The complement or complements to be overmoulded on the rigid body of the door can also be made up of at least two parts; i.e., they may have an internal core and at least one surface layer provided with the necessary characteristics of elasticity or softness, the internal core being constituted by a cavity filled with an aeriform or else by a core made of solid material, or else by a combination of these. For said purpose, a co-injection or moulding technique or a "sandwich" technique may be used, whereby two different materials are injected into the cavity of the overmoulding die, or a solid material and an aeriform. Such a variant of the process of manufacture of the door 4 is exemplified in FIGS. 64-66, which are schematic illustrations in cross-sectional view of a die, designated by 60', comprising two parts 61' and 62' provided with respective impressions. The apparatus 60' is conceptually similar to the one illustrated in FIGS. 30-34 and is used for overmoulding on the rigid body 4*a* of the door one or more additional complements made of elastic or soft material. In the case exemplified, the component in question is a sealing gasket 16. The rigid body 4*a* is first of all positioned in the die 60', defining the seat 15 for the gasket. After closing of the parts 61' and 62' (as may be seen in FIG. 64), a first material M1 is injected in the common cavity 63' of the die 60' not occupied by the rigid body 4*a*, designed to form a surface layer of the gasket, having the necessary characteristics, such as elasticity or flexibility, for example, liquid silicone. The injection takes place via a suitable channel, designated by 61*b*', and the amount of material M1 injected is such as to fill the cavity 63' only partially. Next, as may be seen in FIG. 65, via the channel 61*b*', a gas, or else a second material, designated by M2, is injected into the die, said second material being designed to form, according to the cases, the hollow or solid or foamed core of the gasket. The second material M2 could, for example, be an elastic material of a different hardness, in particular a hardness lower than that of the first material M1. The appropriate timing of the two injection steps enables the second material injected M2 to push the first material M1, which is still in the fluid state, on the walls of the die and on the exposed surface of the body 4*a*, and hence also within the seat 15. The material M1, in contact with the appropriately thermostatted walls of the cavity 63' of the die and of the body 4*a*, starts its solidification, but at the same time forms a fluid vein inside it, where the material M2 designed to form the core continues its flow until the desired external profile for the material M1 is obtained. As may be seen in FIG. 66, if necessary, a last partial injection of the first elastic material M1 can be carried out. Said partial injection is aimed at providing basically a sort of "plug" for the external layer made of the material M1 or at causing the latter to seal or envelop completely the core made of the second material M2. Said final injection is necessary or preferable in the case where the material M2 is an aeriform. The result of the operations described above is visible in FIG. 67, which represents schematically a cross-sectional view of a door 4 provided with a respective gasket 16 having a central core made of a material M2 and an elastic surface layer made of the material M1.

It should be noted that in the case of a hollow internal core filled with an aeriform M2, the latter provides a sort of "bubble" of gas, which varies or increases its pressure when the component is compressed so as to contribute to its capacity of elastic response, i.e., enhance its behaviour as resilient element, irrespective of the elastic characteristics of the material M1.

According to a further aspect of the invention, the door of the dispenser of invention can be provided with an additional element, which is configured substantially as a push-button, in particular of the at least partially flexible or yielding or elastic type, forming part of the locking/release system of the door, and which can be pressed or in any case activated by the user in order to cause release of the door. Preferably, the part of the aforesaid push-button element designed to be activated by the fingers of a user is made of rubber or an elastomer, or other equivalent material, and can be overmoulded on, or associated to, the rigid body of the door, even together with other functional complements. Two possible embodiments in this sense are illustrated in FIGS. 68-72 and 73-76.

In general terms, it should be recalled that the dispensers are provided with hooking/release lever (of the same type as the one designated by 6 in FIGS. 4 and 35) that can co-operate with a tooth formed in the door (of the same type as the one designated by 4*e* in FIGS. 4 and 37). The dispenser is then provided with an actuation system (of the same type as the one designated by 12 in FIGS. 4 and 35), which is operative for producing actuation of the aforesaid lever in order to obtain disengagement between the latter and the engagement tooth of the door. For this purpose, the actuation system is usually operative for producing the angular movement of a shaft inserted in a passage that traverses the body of the dispenser, where the hooking/release lever is fixed to one end of said shaft. In this way, corresponding to the angular movement of the shaft is an identical angular movement of the lever. The hooking/release lever, or its shaft, usually comprises a projection that projects from the area covered by the door (see, for example, FIG. 1) and that is operable directly by the user for enabling, if need be, manual release and hence opening of the door, said projections thus providing a sort of push-button that is constrained to the main body of the dispenser or is supported thereby.

In the variants proposed in FIGS. 68-72 and 73-76, the aforesaid projection is eliminated, and the door is equipped with the aforesaid push-button device, which can be actuated by the user, having in the specific case a body, at least in part made of elastic material. Said elastic body is associated to, or overmoulded on, the rigid body of the door, preferably but not necessarily together with other functional complements of the latter.

FIG. 68 shows a dispenser 1 with a sliding door 4, substantially of the type described previously with reference to FIGS. 14-24. As may be noted, positioned in a peripheral area or area of the corner edge formed by the walls 4*b* and 4*d* of the rigid body 4*a* of the door 4 there is a push-button element, designated as a whole by 200, having a body made of elastic material, for example, elastomer or, silicone. The element 200 is anchored along the edges of an opening that extends between the walls 4*b* and 4*d*. In the preferred embodiment exemplified, the push-button element 200 is overmoulded on the rigid body 4*a* together with the gasket 16, the gripping element 17, and the attenuation elements 18, substantially with modalities similar to the ones described with reference to FIGS. 14-24. For this purpose, and as may be seen in FIGS. 69 and 70, a wall of one of the channels 33 has a respective terminal portion 33*a*' (FIG. 70) parallel to the wall 4*d* of the body 4*a*. Between said terminal stretch 33*a*' and the wall 4*d* an extension of the channel 33 is defined, which gives out into in the opening on which the elastic body of the push-button element 200 is to be formed. In this way, and as may be seen in FIG. 69, following upon overmoulding of the elastic material on the rigid body, the body of the push-button element 200 is connected, via a part of material 41*a*, to the portion 41 that connects the gasket 16 and a respective attenuation element 18 together. As may be seen in the same FIGS. 69 and 70, the push-button element 200 comprises a base wall 201 that is elastically deformable, the peripheral edge of which is constrained on the edge of the opening formed between the walls 4*b* and 4*d* (see also FIGS. 71 and 72). Projecting from the top face of the deformable wall 201 there is a relief 202, here having a substantially cylindrical shape. In FIGS. 71 and 72 the door 4 provided with the push-button element 200 is represented partially sectioned in order to clarify its operative position with respect to the hooking/release lever 6. The situation illustrated in said figures corresponds to a condition of door 4 closed and/or engaged. In FIG. 71 there is shown the lever 6, which is associated to a first end of an actuation shaft 6*b*. As previously explained, said shaft 6*b* is inserted in a respective passage that traverses the body 2 of the dispenser, so that its second end is coupled, with modalities in themselves known, to the actuation system 12. As may be appreciated also in FIG. 72, the lever 6 defines a first projection or hook 6*c*, designed to co-operate with the tooth 4*e* of the door 4 in order to keep the latter in the respective closed condition. Said lever 6 is now without the aforementioned projection projecting with respect to the door (visible for example in FIG. 1). In the case exemplified, rising from the lever 6, there is also a second appendage 6*d*, having, in the case exemplified, a respective inclined surface, which faces the relief 202 of the push-button element 200. In the condition where the door 4 is closed, the relief 202 may be at a short distance from the inclined surface of the second projection 6*d*, or else in contact therewith. By exerting a pressure with a finger on the push-button element 200 it is possible to obtain the elastic deformation of its base wall 201. In this way, the pressure exerted is transferred onto the relief 202, which presses on the inclined surface of the appendage 6*d* of the lever 6. The displacement of the relief 202 thus determines a corresponding thrust on the projection 6*d*, and hence on the lever 6, which is induced to move angularly (in a counterclockwise direction, as viewed in the figures) in the direction of disengagement of the first projection or hook 6*c* from the tooth 4*e*. The door 4 is then free to open as a result of the action of the respective elastic return means (the spring 7 of FIG. 4 or the spring 70 of FIG. 58). Advantageously, a slight translation or lifting of the door 4 and of the tooth 4*e* is envisaged at the moment in which this is disengaged from said hook 6*c*, said translation or lifting being, for example, obtained by virtue of the elastic reaction of the sealing means 16, previously compressed in the step of closing of the door. In this way, it is also prevented the possibility that the two engagement elements erroneously engage with one another at the moment of release of the pressure on the push-button 200. In order to close the door 4, the latter is brought manually into the position shown in FIGS. 71 and 72. It is to be noted that the relief 202 of the push-button element 200 can come into contact with the inclined surface of the second projection 6*d* of the lever 6 even just before the first projection 6*c* and the tooth 4*e* engage with one another. The possibility of elastic bending of the base wall 201 of the push-button element 200 in any case enables the door to proceed in the movement of sliding until engagement thereof is obtained.

Figure 75:
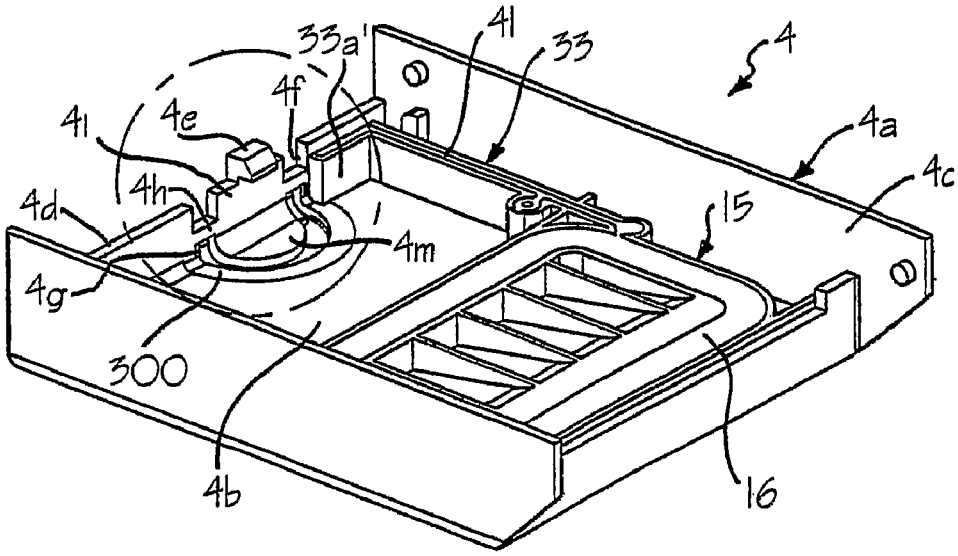
FIG. 75 is a perspective view of the bottom part of the door of FIG. 73.
Figure 76:
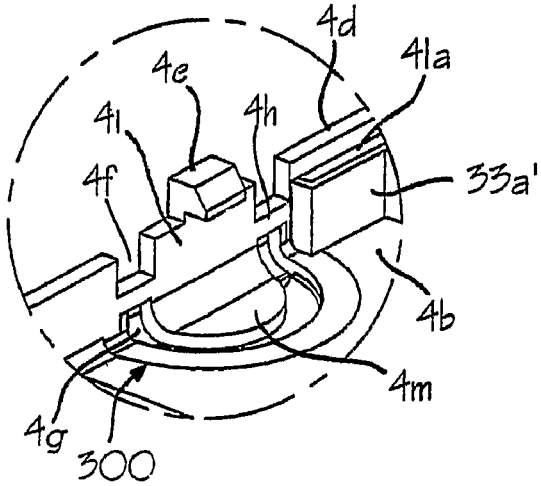
FIG. 76 is an enlarged detail of FIG. 75.

Also in the case of the embodiment of FIGS. 73-76, the door 4 is provided with a push-button element, with a deformable part made of elastic material associated to the rigid body of the door itself. In this case, however, the push-button element is part of an arrangement aimed at producing a movement of release of the tooth 4*e* of the door, instead of a movement of the lever 6. As may be seen in FIGS. 73 and 74, also in this case, in a position corresponding to an area of corner edge between the walls 4*b* and 4*d* of the rigid body 4*a* of the door, there is a push-button element, designated as a whole by 300, having a body at least in part made of elastic material, for example elastomer or silicone, with a deformable base wall, on which surface corrugations or reliefs 301 are present. The element 300 is located on the rigid body 4*a* in a position that overlies the area of the wall 4*d* in which the engagement tooth 4*e* is formed. From the annexed figures, it is in particular possible to note how in the wall 4*d* of the body 4*a* two notches are present, one of which designated by 4*f* in FIG. 74, so that a region 4*i* in which the tooth 4*e* is formed is connected to the rest of the wall 4*d* via two thin wall portions, one of which designated by 4*h* in the same FIG. 74. In FIGS. 75 and 76 it is then possible to note how also a slit or notch, designated by 4*g* in said figures is present in the main wall 4*b* of the body 4*a*, which has a substantially semicircular shape, with its two ends that are in a position corresponding to the wall portions 4*h*. Through the slit 4*g*, formed in the wall 4*b*, there is then a region 4*m* joined directly to the region 4*i* that integrates the tooth 4*e*, substantially orthogonal thereto. Also in said embodiment, the push-button element 300 is overmoulded on the rigid body 4*a*, together with the gasket 16, the gripping element 17, and the attenuation elements 18, substantially according to a principle similar to what has just been described with reference to FIGS. 68-72. For said purpose, then, and as may be seen in FIGS. 75 and 76, a wall of one of the channels 33 has a respective terminal portion 33*a*', which, together with the wall 4*d* of the body 4*a*, defines an extension of the channel 33, which gives out into the area in which the elastic body of the push-button element 300 is to be formed. Following upon overmoulding of the elastic material on the rigid body 4*a*, the body of the push-button element 300 is connected, via a part of material 41*a*, to the portion 41 that connects together the gasket 16 and a respective attenuation element 18. The base wall of the push-button element 300, which is elastically deformable, has a peripheral edge that preferably is constrained on the external edge of the slit 4*g*, and hence in part on the wall 4*b* and in part on the wall 4*d*, practically in a position corresponding to the wall portions 4*h* (see FIGS. 76 and 74). In the closed condition of the door 4, the engagement tooth 4*e* of the door 4 is engaged with the lever 6 (herein not represented), by means of a projection of the latter (said projection is substantially similar to the one designated by 61*c* in FIGS. 71 and 72). By exerting a pressure with a finger on the push-button element 300, its base wall undergoes elastic deformation. In this way, the pressure exerted is transferred principally onto the region 4*m*, to which the region 4*i* that supports the tooth 4*e* is joined. As explained, given the presence of the notches 4*f* and of the slit 4*g*, the set formed by the aforesaid regions 4*i* and 4*m* is joined to the rest of the rigid body 4*a* of the door 4 just via the wall portions 4*h*, which have a smaller cross section and are preferably made of thermoplastic material. For this reason, the pressure exerted on the push-button element 300 can be conveniently transferred onto said set 4*i*, 4*m*, with a consequent bending and/or torsion of the wall portions 4*h*. By virtue of said bending and/or torsion, the set 4*i*, 4*m* can then displace slightly downwards and/or rotate in the direction of disengagement of the tooth 4*e* from the respective projection of the lever 6. The door 4 is then free to open as a result of the action of the respective elastic return means (the spring 7 of FIG. 4 or the elastic element 70 of FIG. 58). The door 4 can then be brought manually into the closing position. In said step, the possibility of elastic bending and/or rotation both of the set 4*i*, 4 and of the base wall of the push-button element 300 enables the tooth 4*e* to "pass over" the projection purposely provided on the lever 6 and then returns elastically into position and engages therewith.

The embodiments of FIGS. 68-72 and 73-76 are of course adaptable also to the case of a door that can be tilted, for example of the type previously designated by 4'.

Figure 77:
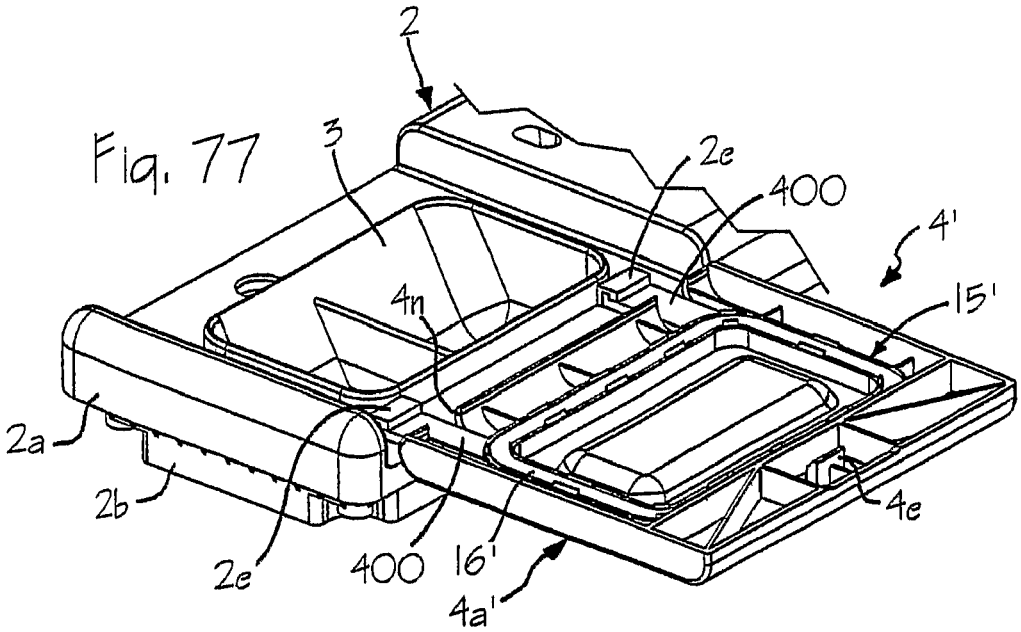
FIG. 77 is a perspective view of a part of a dispenser having a door that can be tilted, provided with hinging or articulation means made of elastic or synthetic material, the door being in an open condition.
Figure 78:
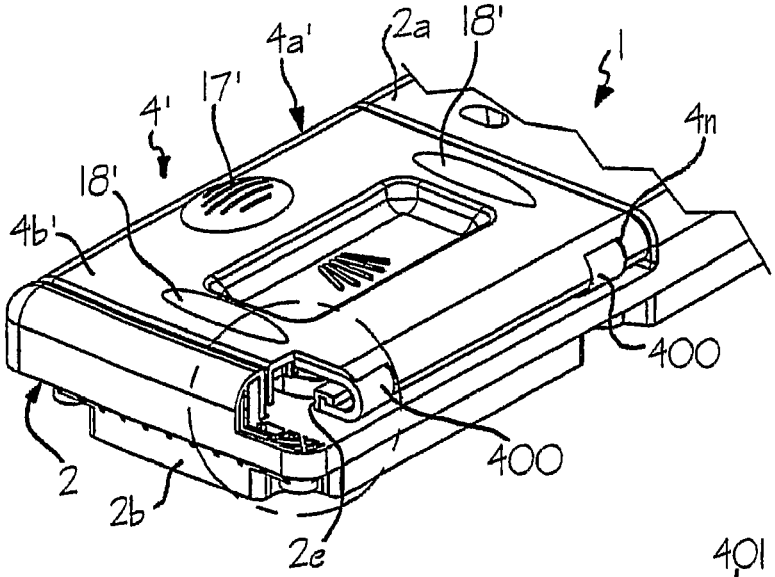
FIG. 78 is a partially sectioned perspective view of the dispenser of FIG. 78, with the door in a closed condition.
Figure 79:
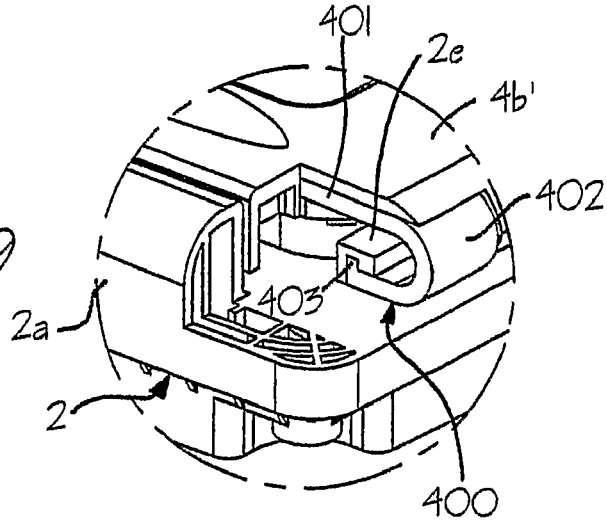
FIG. 79 is an enlarged detail of FIG. 78.

In FIGS. 77-79 there is represented a further aspect of the invention, according to which a tiltable door for a dispenser is provided with hinge means made of flexible and/or elastic material. In the case exemplified, the dispenser is substantially of the type described previously with reference to FIGS. 35-44. As may be seen in FIG. 77, the body 4*a*' of the door 4' is equipped, at the end opposite to the one in which the engagement tooth 4*e* is provided, with hinge or constraint means (it is to be noted that, in said figure, the hooking/release lever 6 designed to co-operate with the tooth 4*e* is not represented; such a lever is in any case shown, for example, in FIG. 35). In the case exemplified, the aforesaid means are constituted by two substantially parallelepipedal hinge elements 400 of small thickness, which extend mutually parallel to one another. The elements 400 each have a respective body made of flexible and/or elastic material, for example elastomer or silicone, or of some other type of material having similar characteristics or characteristics in any case suitable for the purpose that is elastically deformable. Also in said embodiment, the hinge elements can be overmoulded on the rigid body 4*a*' together with the gasket 16', the gripping element 17', and the attenuation elements 18', substantially according to a principle similar to what is described with reference to FIGS. 35-44. For said purpose, for example, there can be provided in two areas of the external wall of the seat 15' for the gasket 16 two interruptions, in a position corresponding to which the elements 400 branch off from the gasket 16. In this case, the shape desired for the elements 400 will be defined principally by a suitable profile of the overmoulding die, without any need for specific channels in the body 4*a*'. In other words, then, the elements 400 project directly from the seat 15', via the aforesaid interruptions of the latter, and the material that constitutes them is directly joined to the material forming the gasket 16'. Alternatively, the hinge elements 400 could be moulded on the rigid body 4*a*' with other channels, either independently or separately, said elements 400 being then associated to the door 4' with respective engagement means or other means designed for the purpose. The ends of the elements 400 opposite to the ones joined to the gasket 16' are shaped to engage in a stable way with respective fixing elements, designated by 2*e*, formed on the body 2 of the dispenser 1. In a position corresponding to the fixing elements 2*e*, the side of the body 4*a*' facing them has two interruptions or slots 4*n*, each provided for enabling the passage of a respective element 400. As may be seen particularly in FIGS. 78 and 79, in which the door 4' is represented in a closed condition, the elements 400 have a respective initial portion 401, designed to remain practically constantly in contact with the surface of the wall 4*b*', followed by an intermediate portion 402, designed to perform purely the function of elastic hinge. As may be noted, in the closed condition of the door 4', said intermediate part assumes a curved configuration, in a position corresponding to the interruptions 4*n* of the body 4*a*'. The hinge elements 400 finally have a terminal portion, designed to remain practically constantly in contact with the front surface of the body 2 of the dispenser. As highlighted in FIG. 79, said terminal portion is provided with a profile designed for engagement in a corresponding seat formed within the respective fixing element 2*e*. In the case exemplified, said profile comprises a relief 403, designed to be inserted, in the production stage, into a seat formed transversely in the respective element 2*e*. As may be appreciated, for the purposes of operation, the elasticity of the material constituting the hinge elements 400 enables the door 4' to perform an angular movement between the respective closed and open conditions. It is to be noted that the elastic reaction of the elements 400 can also enable the movement of opening of the door even in the absence of a specific return spring. For this purpose, the hinge elements 400 could envisage larger sections or thicknesses, or else appropriate reliefs (not represented herein), designed to be compressed elastically in the step of closing of the door 4'. Obviously, the dispenser could also be equipped with a different number of hinge elements 400 from the case represented, also ones having shapes and/or locations different from the ones represented. Preferably, the elastic hinge element or elements provided is/are moulded in the respective resting condition, i.e., with said element or elements not curved (as in FIG. 77). In this way, when the hinge element is bent (as in FIG. 78), it works as a compressed spring, which tends to re-open the door 4'. It should be pointed out that the door-open position is the less "harmful" or stressing one for the hinge elements, in so far as it is the condition in which the said elements remain for a longer time. In said version, then, the elastic hinge/spring constituted by the element or elements 400 is less subjected to stress in the course of its working life.

As regards the embodiment proposed, it should again be pointed out how, in a possible implementation, the hinge element or elements made of elastic material provided can be moulded or overmoulded simultaneously on the rigid body 4*a*' of the door 4' and on the top piece 2*a* of the main body 2 of the dispenser, or else moulded with sequences and modalities different from the preferential ones described. In said application, then, the overmoulding die used (which works according to principles similar to the ones described with reference to FIGS. 30-34), will define a common cavity designed to house both the piece 2*a* and the body 4*a*'. In said cavity there will then be injected the elastic material designed to form the hinge element or elements (and possibly other functional complements of the door), part of which will insinuate itself/themselves inside the seat formed in the fixing elements 2*e*, thus also providing the union between said piece 2*a* and said body 4*a*'.

It is to be noted that, in said step of moulding of the additional elements or functional complements 400 directly on the main body 2 of the dispenser, part of the overmoulding material could be advantageously conveyed for making the sealing means typically present on the same body 2 (see the gasket designated by 116' in FIG. 82), and envisaged for providing sealing with respect to the wall on which the dispenser is then mounted (such as, for example, a wall of the tub or the inner door panel of a dish washer).

The hinge means 400 can in any case be co-moulded on just the door 4' and subsequently associated to the body of the dispenser 1 (or also vice versa, as will be explained in what follows), preferably by inserting or engaging a corresponding portion thereof in seats 2*e* purposely provided in said body of the dispenser. Fixing in said seats can possibly be performed or enhanced by welding, bonding, or other known technique.

It should be pointed out that also the filler cap 8 could be provided with means of constraint to the body 2 of the dispenser 1, configured for example as a substantially filiform element of adequate length, obtained in a single component with the sealing means 86 and/or the gripping element 88, and having a respective end portion designed to be fixed in a respective seat provided in the body of the dispenser. Such a constraint element would have the function of supporting the filler cap 8 when this is removed from the respective opening 9, for the purposes of charging the respective reservoir with the lustring agent.

The embodiments described previously could possibly be combined together, and/or in part omitted, and it is pointed out in particular that even just two from among the sealing means, the gripping means, the attenuation means, the return means, the push-button means, and the hinge means could be obtained in a single elastic body overmoulded on the rigid body of the door 4 or 4', whilst the third of said means can be obtained separately and subsequently associated to the rigid body. In such a perspective, it will appear clear to the person skilled in the art that, for example with appropriate modifications of the rigid body of the door, the gasket and the gripping element could be obtained in a single body made of elastomer, and the attenuation element or elements could be obtained separately, as for example in the embodiment illustrated in FIGS. 11 and 12. Another possibility is that of forming in a single silicone body the gasket and the attenuation element or elements, forming then separately the gripping element and associating it to the rigid body of the door, as for example in the embodiment illustrated in FIGS. 9 and 10. Yet another possibility is that of forming in a single body the gripping element and the attenuation element or elements, making the gasket separately, and so forth. Furthermore, as has been said, there is nothing to rule out in principle forming even just one from among the sealing means, the gripping means, the attenuation means, the return means, the push-button means, and the hinge means via an overmoulding operation.

It is pointed out that the gripping elements provided on the door could be configured so as to be able to exert thereon an action other than a pressure with the fingers, and in particular a tensile force aimed at moving the door itself. In this case, said gripping elements will preferably project markedly with respect to the rigid body of the door.

What has been described previously in relation to the possibility of associating, overmoulding or co-moulding functional complements on the rigid body of a member for closing the dispenser according to the invention can be referred also to functional complements made of elastic, flexible or yielding material to be associated to the main body 2 of the dispenser 1, 1'. As already mentioned, for example, the dispensers designed to be fitted, at least partially, in a respective opening are provided with a perimetral gasket, usually made of elastomeric or silicone material, envisaged for providing a seal with respect to the wall on which the dispenser itself is mounted (typically a wall of the washing tub or the inner door panel of a dish washer). It has moreover been clarified above (see, in particular, what has been described with reference to FIGS. 77-79) how hinge means can be overmoulded on the main body of the dispenser.

Consequently, in accordance with a further aspect of the invention, one or more functional complements can be overmoulded on the main body 2 made of rigid material of the dispenser 1, 1', and possibly also on just one of its constituent pieces 2*a*, 2*b*. Said complements could comprise, for example, in the case of a dispenser with a sliding door, at least the aforesaid perimetral gasket and one or more attenuation elements, aimed at enabling a damped end of travel for the door itself. In the case of a dispenser with an angularly movable door, the complements overmoulded on the main body of the dispenser could, instead, comprise the aforesaid perimetral gasket and the hinge elements made of synthetic material. Another functional complement that can be overmoulded on the body 2 of the dispenser might be a return spring for the door, for example having a structure similar to that previously designated by 70, designed to be constrained in an intermediate point thereof to an engagement element provided for the purpose on the door of the dispenser. Obviously, also in this case a number of functional complements could be formed in a single component, via a single overmoulding operation.

Represented merely by way of example in FIGS. 80-82 are two possible embodiments in this sense. FIGS. 80 and 81 are views similar to the ones illustrated in FIGS. 2 and 1, respectively, and use the same reference numbers for designating elements that are technically equivalent to the ones already described. Also represented in FIG. 80 is the aforesaid perimetral gasket, designated by 116, which is associated to the main body 2 of the dispenser 1, and in particular to its piece 2*a*. In said variant, the door 4 is without attenuation elements, in so far as the latter are associated to the piece 2*a*, and in particular to the wall 2*a*' of the latter. In the case exemplified, two attenuation elements are provided, designated by 118, which are associated to the wall 2*a*', in such a way as to face the wall 4*d* of the door. As may be appreciated, functioning of the attenuation means 118 is altogether similar to that of the homologous attenuation means previously designated by 18. From the example represented, moreover, it may be appreciated how the perimetral gasket 116 and the attenuation elements 118 can be formed in a single component, overmoulded on the rigid body 2 or on its top piece or front piece 2*a*. For said purpose, as may be noted, the attenuation elements 118 are connected to the gasket 116 via connection portions 118*a*, formed by the overmoulding material that forms the aforesaid single component. In the example, the aforesaid connection portions 118*a* project directly with respect to the surface of the piece 2*a*, but it is clear that in the latter there could be purposely provided seats or channels for said connection portions, or also through holes in the piece 2*a*, for setting in communication the areas in which the elements 118 and the gasket 116 are to be formed. Also the same attenuation elements 118 could be at least in part set in in respective seats, and the wall 4*d* of the door 4 could be provided with reliefs or projections designed to co-operate with said elements.

FIG. 82 is a view similar to that of FIG. 78 and uses the same reference numbers for designating elements that are technically equivalent to the ones already described. Also represented in FIG. 82 is the perimetral gasket of the body 2 of the dispenser 1', designated as a whole by 116', which is associated to the piece 2*a* of the body itself. In such an embodiment, overmoulded on the piece 2*a* of the body of the dispenser 1', for example, on the body 2 of a dispenser 1' of the type illustrated in FIGS. 77-79, are both the aforesaid perimetral gasket 116' and hinge elements, designated by 400', which are, from the functional standpoint, similar to the hinge elements previously designated by 400. In this case, the elements 400' may be overmoulded on the body 2, or on the piece 2 of said body, so that a part of the material that constitutes a first end thereof insinuates itself into respective fixing seats 2*e*, previously formed in the step of moulding of the body 2 or of the piece 2*a*. The second end of the hinge elements 400' may then be fixed, in a subsequent step, to the body 4*a*' of the door 4', for example providing on the latter respective engagement seats. Fixing in said seats can possibly be obtained or enhanced by welding, bonding, or some other known technique. Also from FIG. 82 it is possible to appreciate how the perimetral gasket 116' and the hinge element or elements 400' provided can be formed in a single component, overmoulded on the rigid body 2 of the dispenser 1' or on its top or front piece 2*a*. For said purpose, as may be noted, the hinge elements 400' are connected to the gasket 116' via connection portions 116*a*', formed by the overmoulding material that forms the aforesaid single component. In the example provided, the aforesaid connection portions 116*a*' project directly with respect to the surface of the piece 2*a*, but it is evident that also in this case the piece 2*a* could be purposely provided with seats or channels for said connection stretches. Obviously, also in this case the piece 2*a* could envisage through holes for setting in communication the areas in which the elements 400' and the gasket 116' are to be formed.

In both of the solutions (with sliding door and tiltable door), for practical reasons or reasons of simplicity of production, various functional complements could be overmoulded on the top piece 2*a* of the body 2 of the dispenser 1, 1', during production thereof, said piece 2*a* being subsequently welded to the bottom piece or half-body 2*b*.

It is pointed out that, in another variant (not represented), the wall 2*a*' of the piece 2*a* can be provided with through holes, to which attenuation elements similar to the ones of FIGS. 11 and 12 can be associated, or else with seats in which attenuation elements similar to the ones of FIGS. 59 and 60 can be at least partially housed.

In the case of a linearly sliding door, the surface of arrest designed to co-operate with the attenuation elements 18 could be defined by an element extraneous to the body 2 of the dispenser, such as for example a wall or a relief obtained in the inner door panel of the machine, or else a front appendage of a dish rack. Likewise, in the case of a tiltable door, said surface of arrest could be formed in the same body of the dispenser, for example in the form of reliefs located above the area of fulcrum of the door (in this case, as compared to the one exemplified in the figures, the attenuation elements 19' could be closer to the means 5*c* and 5*d* forming the fulcrum of the door 1').

From the foregoing description the advantages of the solutions of the invention described previously emerge clearly. Amongst these it is emphasized that:

via the gripping element, the member for closing the dispenser is provided with a resting area made of elastic or yielding material, and hence of increased friction or adhesion in regard to the fingers of a user; this renders the operations of closing more convenient and secure, without any risks of the fingers slipping; the presence of the gripping element moreover enables limitation of the amount of the thrust that must be exerted on sliding doors in order to obtain the necessary sliding friction; substantially similar advantages are obtainable also in regard to the push-button element, with the corresponding arrangement for release of the door;

via the attenuation elements, the dispenser is provided with damped end-of-travel means for the movement of the door, this enabling reduction of the noisiness during the step of opening the compartment containing the detergent and a reduction in the vibrations whilst the machine is running, as well as prevention of repeated mechanical stresses on the dispenser;

the presence of the additional elements or functional complements, for example, the ones constituted by the gripping means and the attenuation means described, enables improvement of the overall styling of the dispenser; in this connection, it is pointed out that said added elements may be shaped as desired (obviously in a way compatible with the functions assigned thereto) and made also of materials having colours different from that of the main body of the closing member; in such a perspective, it is evident how the invention enables creation and combination of numerous aesthetic variants of one and the same product; and the fact that one or more from among the sealing element or gasket, the gripping element, the attenuation elements, the elastic return element of the door, the push-button element, and the hinge means can be obtained via operations of overmoulding of synthetic material simplifies the process of production of the dispenser, reducing the steps and production times, with advantages also in terms of reduction of costs; said benefits are further increased in the case where two or more of the aforesaid elements are made in a single overmoulded component.

Inventive characteristics of the solutions proposed are summarized in the annexed claims, which are to be understood as forming an integral part of the descriptive content of the present patent application.

The invention claimed is:

1. A washing-agent dispenser for a household washing machine, the dispenser comprising:

a main casing, defining at least a container for a washing agent;

a closing member of said container, which is able to assume an operative condition and an inoperative condition, in which said container is open or closed, respectively;

where at least one of said main casing and said closing member comprises a respective rigid body, which is substantially rigid and made of a first material, to which respective sealing means are associated, made at least in part of a second substantially elastic or soft material;

additional means, or functional complements, associated to the rigid body of at least one of said main casing and said closing member, which means or complements are at least in part elastic or yieldable, are functionally distinct with respect to said sealing means and are deformable in the course of use of the closing member;

wherein said rigid body of the closing member comprises a main wall and a side wall, the main wall having a first face and a second face substantially opposite to one another, to the first face there being associated said sealing means and to one of the second face and the side wall there being associated at least one of said additional means;

wherein said additional means comprise at least one of a manual gripping element and an attenuation or end-of-travel element;

wherein said closing member comprises a door, whose rigid body is at least one of slidably mounted on, and hinged to, the main casing of the dispenser; and wherein at least one of:

at said second face of the main wall at least one of a cavity, a recessed seat and a passage is formed in the rigid body of said door, in which a portion of one said gripping element or one said attenuation element is at least partially housed;

at said side wall at least one of a cavity, a recessed seat and a passage is formed, in which a portion of one said attenuation element is at least partially housed;

a plurality of attenuation elements is associated to one of said second face and said side wall;

said gripping element forms said attenuation element, or vice versa; and at least one of said gripping element and said attenuation element projects at a front thereof from said main wall.

2. The dispenser according to claim 1, wherein at least one of said gripping element and said attenuation element at least one of is made at least in part of an elastic, or soft, or yielding material; and is supported by, or associated at least in part to, said rigid body and elastically deformable following upon application of a force exerted thereon and/or on said closing member.

3. The dispenser according to claim 2, wherein at least one of said additional means and sealing means comprises an internal core and at least a surface layer made of elastic material, the internal core comprising a cavity filled with an aeriform or else a core made of solid or foamed material.

4. The dispenser according to claim 1, wherein said sealing means and at least one of said gripping element and said attenuation element are formed in a single component made at least in part of said second material.

5. The dispenser according to claim 4, wherein said single component is overmoulded on said rigid body, or vice versa.

6. The dispenser according to claim 4, wherein one or more passages is formed in said rigid body, in which part of the second material of said single component extends into said one or more passages.

7. The dispenser according to claim 6, wherein said sealing means comprise at least one gasket, which is at least partially associated to a respective housing seat, and said one or more passages has a respective first end that faces inside said housing seat.

8. The dispenser according to claim 6, wherein said passage or passages comprise at least one of:

one or more through holes formed in said rigid body;

one or more seats at least one of delimited by a number of walls and having a substantially U-shaped cross-section, formed in said rigid body; and one or more channels open at least one end.

9. The dispenser according to claim 1, wherein at least one of said sealing means, said gripping element and said attenuation element is overmoulded at least in part on said rigid body, or vice versa.

10. The dispenser according to claim 9, wherein at least one of said additional means is at least partially overmoulded or associated to a piece of said rigid body of the main casing.

11. The dispenser according to claim 1, wherein said sealing means and at least one of said additional means are operatively positioned in areas of said rigid body distinct or set at a distance from one another.

12. The dispenser, according to claim 1, wherein said sealing means comprise a gasket having at least a respective first portion that is at least partially inserted in a respective housing seat, where said housing seat delimits an area of said rigid body within which ribbings or reliefs are formed, that are operative for preventing at least one of interference and jamming of the movement of the closing member.

13. The dispenser according to claim 1, wherein said rigid body is formed with a material selected between polyamide or nylon and polypropylene, and said additional means are made at least in part of an elastomeric, silicone or foamed material.

14. A washing-agent dispenser for a household washing machine, the dispenser comprising:

a main casing, defining at least a container for a washing agent, and a closing member of said container, which is able to assume an operative condition and an inoperative condition, in which said container is open or closed, respectively, wherein at least one of said main casing and said closing member comprises a respective rigid body, which is substantially rigid and made of a first material, to which sealing means are associated, made at least in part of a second substantially elastic or soft material;

additional means, adapted to undergo elastic deformation following upon application of a force exerted thereon, the additional means being associated to the rigid body of at least one of said main casing and said closing member, which additional means are at least in part elastic or yieldable and are functionally distinct with respect to said sealing means, the additional means comprising at least one of a manual gripping element;

an attenuation or end-of-travel element;

an actuatable actuation or manual-release element;

wherein at least one of said manual gripping element, said attenuation element and said actuation element is formed of an elastomer material moulded on the first material or therewith, for anchoring said at least one of said manual gripping element and attenuation or end-of-travel element to one respective said rigid body.

15. The dispenser according to claim 14, wherein said rigid body of the closing member comprises a main wall having a first face and a second face substantially opposite to one another, where to the first face there are associated said sealing means and to the second face there is at least one of said additional means.

16. The dispenser according to claim 15, wherein said closing member comprises a door, the rigid body at least one of slidably mounted on, and hinged to, the main casing of the dispenser; and at least one of in a position corresponding to said second face at least one cavity or recessed seat or passage is formed in the rigid body of said door, in which a portion of a respective gripping element or attenuation element is at least partially housed;

said rigid body of the closing member comprises a side wall, substantially perpendicular to said main wall, at least one of a cavity, a recessed seat and a passage being formed in a position corresponding to said side wall, in which a portion of a respective attenuation element is at least partially housed;

a plurality of attenuation elements is associated to one of said second face of the main wall and said side wall;

said gripping element also forms an attenuation element, or vice versa; and at least one of one said gripping element and one said attenuation element projects at a front thereof from said main wall.

17. The dispenser according to claim 16, wherein one or more said passages are formed in the rigid body of said door, in a position corresponding to said second face at least one said cavity or recessed seat is formed in the rigid body of said door, in which a portion of a respective gripping element or attenuation element is at least partially housed, and said one or more passages have a respective second end that faces inside said cavity or recessed seat.

18. The dispenser according to claim 14, wherein said sealing means comprise a gasket having at least one respective first portion that is at least partially inserted in a respective housing seat, and a respective second portion located on the outside of said housing seat, said second portion being shaped as a continuous wall that closes an area of said rigid body delimited by at least part of said housing seat.

19. The dispenser according to claim 14, wherein said closing member comprises a filler cap that is removable from a respective mouth or seat.

20. The dispenser according to claim 19, wherein a rigid body of said filler cap has a lower portion, designed to be inserted at least partially in a mouth of said container, and an upper portion including a peripheral wall or flange, said sealing means being positioned underneath said flange, and said gripping element being positioned above said flange.

21. The dispenser according to claim 19, wherein the rigid body of said filler cap substantially has a cylindrical shape and comprises a transverse wall and a diametral wall, at least one of said additional means coating at least partially at least one of said transverse wall and said diametral wall.

22. The dispenser according to claim 14, wherein at least one of said additional means is provided with respective fast-coupling means for coupling to said rigid body.

23. The dispenser according to claim 14, wherein said actuation element has a portion that is elastically deformable following upon a pressure exerted thereon, said portion having at least one area anchored to said rigid body of the closing member, the deformation imparted upon said portion determining at least one of:

a movement of a lever or engagement element forming part of a locking/release system; and a movement of a tooth or engagement element fixed to said rigid body.

24. A process for manufacturing a dispenser of washing agents, in particular for a dish washer, comprising at least the steps of:

i) forming a main casing of the dispenser, having a respective substantially rigid body defining at least one container for a washing agent;

ii) forming a closing member for said container, the closing member comprising a door having a substantially rigid body to which one or more functional complements are anchored, amongst which sealing means, said rigid body of the closing member comprising a main wall and a side wall, the main wall having a first face and a second face substantially opposite to one another, to the first face there being associated said sealing means and to at least one of the second face and the side wall there being associated at least one said functional complements selected from a manual gripping element for the closing member, an attenuation or end-of-travel element for the closing member and an actuatable actuation or manual-release element;

iii) providing coupling means for coupling between the main casing and the closing member so that the latter is able to assume an operative position and an inoperative position in which, respectively, the container is open and closed;

wherein step ii) comprises at least one of:

forming at least one of a cavity, a recessed seat and a passage in the rigid body of said door, at said second face of the main wall, in which a portion of one said gripping element or one said attenuation element is at least partially housed;

forming at least one of a cavity, a recessed seat and a passage at said side wall, in which a portion of one said attenuation element is at least partially housed;

associating a plurality of attenuation elements to one of said second face of the main wall and said side wall; and wherein at least one of said steps comprises at least an operation of moulding of at least one first material onto, or together with, a second material, one of said first and second materials forming a said rigid body and the other of said first and second materials forming at least one of said manual gripping element and attenuation element, via the operation of moulding also anchorage of at least one of said manual gripping element and attenuation element to the respective rigid body being obtained.

25. The process according to claim 24, wherein the material used for forming at least in part one or more of said manual gripping element and attenuation element is more elastic or softer than the material used for forming said rigid body.

26. A process for manufacturing a dispenser of washing agents, in particular for a dish washer, comprising at least the steps of:

i) forming a main casing of the dispenser, having a respective substantially rigid body defining at least one container for a washing agent;

ii) forming a closing member for said container, the closing member comprising a respective substantially rigid body;

iii) providing coupling means for coupling between the main casing and the closing member so that the latter is able to assume an operative position and an inoperative position in which, respectively, the container is open and closed;

iv) providing at least one of said rigid body with one or more functional complements selected from:

a manual gripping element;

an attenuation or end-of-travel element;

an actuatable actuation or manual-release element;

wherein step iv) comprises at least an operation of moulding of at least one first material onto, or together with, a second material, one of said first and second materials forming one said rigid body and the other of said first and second materials forming said one or more functional complements, via the said operation of moulding also anchorage of said one or more functional complements to the respective rigid body being obtained.

27. The process according to claim 26, wherein via said operation of moulding at least one of:

sealing means for the closing member and one or more of said functional complements are formed in a single component; and a plurality of said functional complements is formed in a single component.

28. The process according to claim 27, wherein one or more passages are previously formed in said rigid body, in which a part for anchorage of the material constituting said single component is designed to extend, said part joining at least two of said functional complements to one another.

29. The process according to claim 26, wherein said functional complements comprise a plurality of said elements that are overmoulded on areas of said rigid body set at a distance from and distinct with respect to one another.

30. The process according to claim 6, wherein one or more passages are previously formed in said rigid body, in which a part for anchorage of a respective functional complement is to extend.

31. The process according to claim 30, wherein at least a first seat is formed in said rigid body, a first end of at least one of said passages facing inside said first seat, and in that at least a first functional complement is at least partially moulded in said first seat.

32. The process according to claim 31, wherein at least a second seat is formed in said rigid body, a second end of said at least one passage facing inside said second seat, and in that at least a second functional complement is at least partially moulded in said second seat.

33. The process according to claim 26, wherein the forming a closing member comprises said closing member being shaped to assume the form of at least one of:

a door, the rigid body of which is designed to be slidably mounted on the main casing of the dispenser;

a door, the rigid body of which is designed to be hinged to the main casing of the dispenser, so as to be angularly movable; and a filler cap to be associated to the main casing of the dispenser.

34. The process according to claim 26, wherein said rigid body is made of a material selected from the group consisting of polyamide, nylon and polypropylene, and said functional complements are made of an elastomeric, silicone or foamed material.

35. A dispenser of washing agents for a household washing machine, the dispenser comprising:

a main casing, defining at least one container for a washing agent; and a closing member for closing said container, which is able to assume an operative condition and an inoperative condition in which said container is open and closed, respectively, where the main casing and the closing member each comprise a respective substantially rigid body made of a first material, to at least one of which there are associated one or more functional complements selected among:

gripping means, defining a resting area for one or more fingers of a user and adapted to be used when the closing member must be brought manually from the operative condition to the inoperative condition and/or vice versa;

attenuation or end-of-travel means, adapted to co-operate with at least one arrest surface for constituting therewith means of damped end of travel to an opening movement of the closing member from said operative position to said inoperative position;

an actuation element, adapted to be actuated and being part of a locking/release system of the closing member, said system being manually switchable between a locking position and a release position, in which, respectively, said system holds the closing member in said operative condition or else enables passage of the closing member in the direction of said inoperative condition, said actuation element having a yielding portion deformable to cause a movement of one an engagement element forming part of said locking/release system;

wherein at least one of said manual gripping means, said attenuation means and said actuation element is formed of an elastomer moulded on, or moulded with, the first material of one said rigid body, and wherein at least one portion of said at least one of said manual gripping element, said attenuation element and said actuation element is at least partially housed and anchored in at least one of a cavity, a recessed seat and a passage defined in said one rigid body.

36. A dispenser of washing agents for a household washing machine, the dispenser comprising at least:

a main body, which is substantially rigid and defines at least a container for a washing agent;

a member for closing of said container, having a respective substantially rigid body;

means for constraining the rigid body of the closing member to a substantially pre-defined movement with respect to the main body of the dispenser, so that the closing member is able to assume an operative condition and an inoperative condition in which said container is open and closed, respectively;

a locking/release system for the closing member, which can be manually switched between a locking position and a release position, in which, respectively, said system holds the closing member in said operative condition or else enables passage of the closing member in the direction of said inoperative condition, said locking locking/release system comprising at least one of a movable engagement element mounted on the main body and a movable engagement element fixed to, or integral with, the rigid body of the member for closing;

wherein said locking/release system also comprises at least one manual actuation element comprising a body made of an elastomer material and including a yieldable portion, the body of the manual actuation element being anchored to one said rigid body at a seat or passage thereof, said yieldable portion being deformable following upon a pressure exerted thereon via at least one finger of a user for causing thereby a movement of one said movable engagement element aimed at producing a switching of said locking/release system.

37. The dispenser according to claim 36, wherein said body of the manual actuation element is overmoulded at least in part on the rigid body of the closing member.

* * * * *

UNITED STATES PATENT AND TRADEMARK OFFICE

CERTIFICATE OF CORRECTION

PATENT NO. : 7,909,938 B2
APPLICATION NO. : 11/718874
DATED : March 22, 2011
INVENTOR(S) : Cerruti et al.

It is certified that error appears in the above-identified patent and that said Letters Patent is hereby corrected as shown below:

Claim 30, at Column 30, Line 29: Delete “claim 6” and insert --claim 26--

Signed and Sealed this
Twenty-fourth Day of May, 2011

David J. Kappos

David J. Kappos
*Director of the United States Patent and Trademark Office*